US008099889B2

(12) United States Patent
Landsman et al.

(10) Patent No.: US 8,099,889 B2
(45) Date of Patent: Jan. 24, 2012

(54) RECIPIENT VERIFICATION SYSTEMS AND METHODS OF USE, INCLUDING PATIENT IDENTIFICATION

(75) Inventors: Kelly M. Landsman, Chicago, IL (US); Varsha G. Kalyankar, Chicago, IL (US); Christa L. Harris, Kansas City, MO (US); Michael LaVern Sandy, St. Charles, MO (US)

(73) Assignee: Typenex Medical, LLC, Chicago, IL (US)

( * ) Notice: Subject to any disclaimer, the term of this patent is extended or adjusted under 35 U.S.C. 154(b) by 0 days.

(21) Appl. No.: 12/465,449

(22) Filed: May 13, 2009

(65) Prior Publication Data

US 2011/0042933 A1 Feb. 24, 2011

Related U.S. Application Data

(60) Provisional application No. 61/052,811, filed on May 13, 2008.

(51) Int. Cl.
*A44C 5/00* (2006.01)

(52) U.S. Cl. ..... 40/633; 283/70

(58) Field of Classification Search ..... 40/633
See application file for complete search history.

(56) References Cited

U.S. PATENT DOCUMENTS 3,106,028 A 10/1963 Baumgartner
3,323,208 A 6/1967 Hurley et al.
3,416,200 A 12/1968 Daddona, Jr.
3,586,220 A 6/1971 Reinsberg
3,645,023 A 2/1972 Larson
3,656,247 A 4/1972 Bushnell et al.
3,660,916 A 5/1972 McDermott et al.
3,715,570 A 2/1973 Weichselbaum et al.
3,744,104 A 7/1973 Ford
3,744,691 A 7/1973 Shears
3,751,835 A 8/1973 Smith
3,965,589 A 6/1976 McDermott
4,164,320 A 8/1979 Irazoqui et al.
4,226,036 A 10/1980 Krug
4,233,715 A 11/1980 McDermott
4,377,047 A * 3/1983 Adams et al. ..... 40/665
4,914,843 A 4/1990 DeWoskin
5,002,212 A 3/1991 Charleton
5,088,159 A 2/1992 Lafleur
5,092,067 A 3/1992 Prout
5,164,575 A 11/1992 Neeley et al.
5,166,498 A 11/1992 Neeley
5,226,809 A 7/1993 Franco
5,283,969 A 2/1994 Weiss
(Continued)

*Primary Examiner* — Joanne Silbermann
*Assistant Examiner* — Kristina N Staley
(74) *Attorney, Agent, or Firm* — Dicke, Billig & Czaja, PLLC

(57) ABSTRACT

A recipient verification system including a strap, a pocket, a tether, and a label strip. The strap is configured for placement about a wearer's appendage (e.g., wrist, ankle, etc.). The pocket is coupled to the strap and forms an interior region that is exteriorly accessible via an open end. A portion of the tether is permanently captured at the pocket. The label strip is attached to the tether. The tether and the attached label strip are repeatedly transitionable between a first state and a second state. In the first state, the tether and at least a majority of the label strip is within the pocket, and thus protected. In the second state, at least a majority of the label strip is outside of the interior region of the pocket, and available for use by a user.

16 Claims, 47 Drawing Sheets

U.S. PATENT DOCUMENTS

| | | | |
|---|---|---|---|
| 5,311,689 | A | 5/1994 | Lindsey |
| 5,323,554 | A | 6/1994 | MacDonald |
| 5,343,608 | A | 9/1994 | MacDonald |
| 5,401,110 | A | 3/1995 | Neeley |
| 5,423,574 | A | 6/1995 | Forte-Pathroff |
| 5,488,846 | A | 2/1996 | Green |
| 5,499,468 | A | 3/1996 | Henry |
| 5,581,924 | A | 12/1996 | Peterson |
| 5,615,504 | A | 4/1997 | Peterson et al. |
| 5,740,623 | A | 4/1998 | Juhan et al. |
| 5,758,443 | A | 6/1998 | Pedrazzini |
| 6,092,321 | A | 7/2000 | Cheng |
| 6,255,951 | B1 | 7/2001 | De La Huerga |
| 6,349,493 | B1 | 2/2002 | Newman et al. |
| 6,421,920 | B1 | 7/2002 | Jensen |
| 6,655,063 | B2 | 12/2003 | Goodin et al. |
| 6,748,687 | B2 | 6/2004 | Riley |
| 6,922,148 | B2 | 7/2005 | Despotis |
| 6,948,271 | B2 | 9/2005 | Helgeson et al. |
| 6,976,327 | B2 | 12/2005 | Goodin et al. |
| 7,017,293 | B2 | 3/2006 | Riley |
| 7,137,216 | B2 | 11/2006 | Ali et al. |
| 7,188,764 | B2 | 3/2007 | Penuela |
| 7,197,842 | B2 | 4/2007 | Ali |
| 7,222,448 | B2 | 5/2007 | Riley |
| 7,240,446 | B2 | 7/2007 | Bekker |
| 7,286,055 | B2 | 10/2007 | Girvin et al. |
| 2004/0060216 | A1 | 4/2004 | Riley |
| 2004/0148836 | A1 | 8/2004 | Riley |
| 2004/0244251 | A1 | 12/2004 | Riley |
| 2005/0091896 | A1 | 5/2005 | Kotik et al. |
| 2005/0108912 | A1 | 5/2005 | Bekker |
| 2005/0184508 | A1 | 8/2005 | Verden et al. |
| 2006/0174527 | A1 | 8/2006 | Henley |
| 2006/0230661 | A1 | 10/2006 | Bekker |
| 2006/0242875 | A1 | 11/2006 | Wilson et al. |
| 2006/0254105 | A1 | 11/2006 | Chang |
| 2007/0028495 | A1 | 2/2007 | Kotik et al. |
| 2007/0120358 | A1 | 5/2007 | Waggoner et al. |
| 2007/0172291 | A1 | 7/2007 | Yokoyama |
| 2008/0301990 | A1* | 12/2008 | McDermott ..... 40/633 |
| 2010/0024268 | A1* | 2/2010 | Landsman et al. ..... 40/633 |

* cited by examiner 608
610

608
610
612

604
608
610
594
616
622
614
624
620
602
618
616
620
614
BBID Number
BBID Number
BBID Number
BBID Number
BBID Number

RECIPIENT VERIFICATION SYSTEMS AND METHODS OF USE, INCLUDING PATIENT IDENTIFICATION

CROSS-REFERENCE TO RELATED APPLICATION

This application claims priority under 35 U.S.C. §119(e)(1) to U.S. Provisional Patent Application Ser. No. 61/052,811, filed May 13, 2008, entitled "Recipient Verification Systems and Methods of Use, Including Patient Identification", and the entire teachings of which are incorporated herein by reference.

BACKGROUND

The present disclosure relates to recipient verification bands and related systems, for example patient identification systems. More particularly, it relates to wearable verification bands for use in various environments, such as caregiver environments, that provide users with consistent, immediate access to label(s) carrying wearer-specific information in format(s) amenable for various end use applications, and methods for making the same.

The need to assign a unique code or other identifier to a person or thing (collectively referred to as a "recipient") and subsequently employ the identifier in correlating other articles or activities to the recipient arises in a number of contexts. For example, positive patient identification is a critical step in providing medical treatment to patients in a caregiver environment (e.g., hospital). Commonly, an identification band (e.g., a flexible plastic wristband or ankle band) is issued to the patient at the time of admission to the caregiver institution, and is worn by the patient at all times. The so-issued identification/admission band typically displays (e.g., printed or labeled) patient-related information, such as name, date of birth, etc. In some instances, a unique patient identifier or other code is assigned to the patient and is displayed on the band, including, for example, bar code or numeric/alphanumeric code. The patient identifier can alternatively be supplied on a separate band (apart from the admission band), and is used to cross-reference other caregiver-related items with the patient via, for example, an electronic data base. The unique patient identifier provides an independent, physical link to the patient. For example, paperwork or other caregiver documents/medical charts relating to the patient may include the patient identifier. In addition, the patient identifier can be applied to specimen samples (e.g., test tubes for blood specimens) taken from the patient, or applied to therapeutic material(s) to be given to the patient, to better ensure that these and other items are accurately associated with the correct patient at all stages of the patient's visit with the caregiver institution. Along these same lines, similar recipient verification needs arise apart from a hospital admission environment, for example blood banks, pharmacy, trauma centers, etc.

As a point of reference, there are multiple situations where lack of immediate patient identification (or other recipient verification) can pose significant safety risks, including trauma situations and blood transfusion to name but two. To facilitate accurate transposition of the patient identifier (and possibly other patient-related information) to items apart from the band(s) worn by the patient, it is known to provide one or more labels or tags that display the same patient identifier, or permit a caregiver to enter the patient identifier on to the label/tag. While viable, the process of transferring the patient identifier from the patient to their specimens, test requests, and other items and then back to the patient is prone to error. First, if the unique patient identifier must be transcribed by hand, the potential for human error will arise. Second, the patient identifier must be correctly transferred to the specimen/item in question. If the caregiver must retrieve label(s) from a location apart from the patient (e.g., nursing station, patient chart, lab, etc.), incorrect labeling may occur. These and other concerns exist even with identification systems in which a sheet of labels are printed in conjunction with the patient identification band; the sheet can be misplaced and/or incorrectly associated with a different patient. In sum, the inability to provide a sufficient supply of prepared labels in constant, direct association with the patient at all times can pose a patient safety risk.

To possibly address one or more of the above concerns, patient identification formats have been suggested whereby one or more removable labels are physically connected to the identification band worn by the patient. Unfortunately, available systems may give rise to other concerns, such as the patient removing the band (for example, due to discomfort), an insufficient supply of labels, absence of label(s) sized/formatted for one or more common applications, damaging of otherwise unprotected labels, etc.

In light of the above, a need exists for a recipient verification system including a band to be worn by the patient (or other person for whom identity verification is desired) and providing a series of removable labels permanently carried by the band in a manner that protects the labels during periods of non-use.

SUMMARY

Some aspects in accordance with principles of the present disclosure relate to a recipient verification system including a strap, a pocket, a tether, and a label strip. The strap is configured for placement about a wearer's appendage (e.g., wrist, ankle, etc.). The pocket is coupled to the strap and forms an interior region that is exteriorly accessible via an open end. The tether has a leading side and a trailing side. In this regard, a portion of the tether is permanently captured at the pocket. Finally, the label strip is attached to the leading side of the tether. With this construction, the tether and the attached label strip are repeatedly transitionable between a first state and a second state. In the first state, at least a majority of the tether and at least a majority of the label strip are within the interior region of the pocket, thus protecting the label strip. In the second state, at least a majority of the label strip is outside of the interior region of the pocket, and available for use by a user (e.g., with a label strip carrying removable labels, one or more of the removable labels can be removed from the label strip in the second state). In some constructions, the tether is folded onto itself in the second state.

Yet other aspects in accordance with principles of the present disclosure relate to a method of manufacturing a recipient verification system. The method includes coupling a pocket to a strap for placement about a wearer's appendage. In this regard, the pocket forms an interior region that is exteriorly accessible via an open end. A tether is permanently captured at the pocket, with the tether having a leading side and a trailing side. A label strip is attached to the leading side of the tether. With this construction, the tether and the attached label strip are repeatedly transitionable between a first state and a second state. In the first state, at least a majority of the tether and at least a majority of the label strip are within the interior region of the pocket. In the second state, at least a majority of the label strip is outside of the interior region, and thus accessible by a user. In some constructions, a laminate structure is die cut to form a piece that includes the label strip, the tether, and a head as a continuous body, with the label strip carrying a plurality of removable labels. In connection with this alternative approach, identification indicia is printed onto the removable labels and the head, with the head being inserted into a pocket formed by a base piece.

Other aspects in accordance with the present disclosure relate to a method of using a recipient verification system. The method includes assembling a strap provided by the recipient verification system about a wearer's appendage. The recipient verification system further includes a pocket coupled to the strap, with the pocket forming an interior region having an open end. The recipient verification system is transitioned to a use state in which a label strip is removed from the pocket. In this regard, the label strip is connected to the strap via a tether that is permanently captured at the pocket. Further, the recipient verification system is transitioned to a storage state, with the label strip being folded and inserted into the pocket along with the tether.

DETAILED DESCRIPTION

Aspects of the present disclosure relate to various recipient verification systems useful in a variety of different environments. For example, the recipient verification systems of the present disclosure can be used in medical or patient-related contexts, such as with patient admission to a hospital (and related medical records, charts, items (e.g., clothing), etc.), testing or specimen drawing (e.g., X-rays, blood specimen, DNA specimen, organ donation, stem cell specimen, fertilized eggs, etc.) entirely apart from (or as part of) a hospital stay, blood banks, pharmacies (e.g., custom chemotherapy drugs, nuclear pharmacy, etc.), or other instances in which patient identification is needed. Other applications are equally appropriate, such as police or security situations in which a number of individuals must be quickly processed on-site, ticketing applications, etc. Thus, while several of the examples described below mention patient identification, as well as hospital admission, the systems of the present disclosure are in no way limited.

Figure 1A:
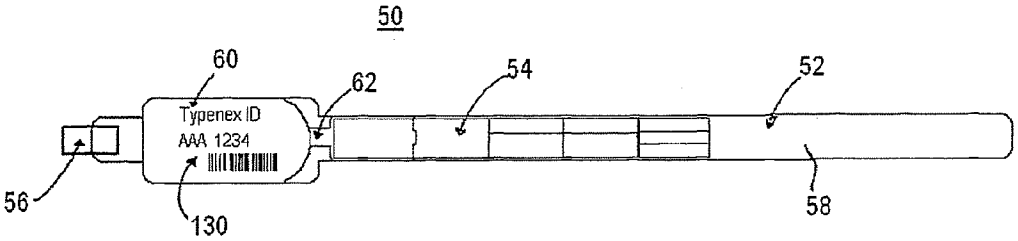
FIGS. 1A and 1B are simplified, top views of a recipient verification system in accordance with principles of the present disclosure.
Figure 1B:
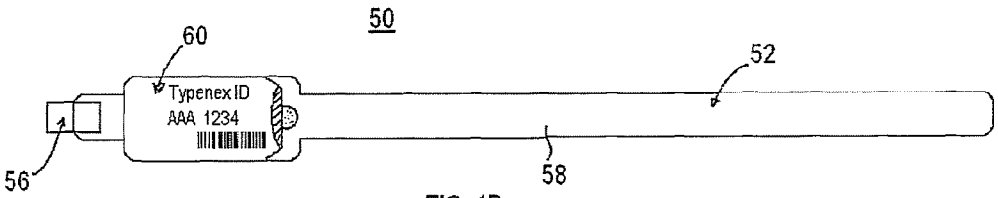

One configuration of a recipient verification system 50 in accordance with aspects of the present disclosure is shown in FIGS. 1A and 1B. The recipient verification system 50 includes a band 52, a label strip 54, and a closure device 56 (illustrated schematically). The band 52, in turn, includes a strap 58, a pocket 60, and a tether 62. Details on the various components are provided below. In general terms, the strap 58 is adapted for placement about a user's wrist, ankle or other appendage (as a point of reference, FIGS. 1A and 1B illustrate the recipient verification system 50 prior to placement about the user's appendage), with the closure device 56 effectuating a tamper-evident connection. The label strip 54 is physically connected to the band 52 in a manner that facilitates insertion of the label strip 54 into the pocket 60 during periods of non-use (storage state of FIG. 1B), and removal from the pocket 60 (use state of FIG. 1A) when a caregiver (or other third party) desires to remove a label carried by the label strip 54 for application to a separate item. At all times, however, the label strip 54 remains attached to the band 52. Thus, the recipient verification system 50 provides a highly convenient device that consistently and accurately provides necessary user identification information on both the band 52 and individual labels of the label strip 54, while protecting the label strip 54 from possible damage. Additional, optional features can be incorporated into the system 50 as described below, such as a replacement feature by which certain components of the system 50 can be assembled to a separate strap.

As used throughout this disclosure, a "pocket" (e.g., the pocket 60) is in reference to the arrangement of two (or more) opposing material layers relative to one another to define a discernable zone of separation, or interior region, therebetween, within which items can be temporarily stored. The opposing material layers are connected to one another in various fashions (e.g., adhesively bonded) to generally define a perimeter of the pocket. In this regard, the region of connection or attachment between the opposing material layers is considered to be a part of the pocket, such that any auxiliary item (e.g., the tether 62) that is also attached or connected at the region of attachment is defined as being captured "at the pocket". Further, the pocket perimeter can have a variety of different shapes, but can generally be viewed as having or defining opposing sides and opposing ends (e.g., akin to the rectangular shape). With these conventions in mind, pockets in accordance with the present disclosure can include a complete seal being formed between the opposing sides (e.g., neither of the opposing ends include a complete seal between the opposing material layers), a partial or intermittent seal between the opposing material layers at one of the ends, or a complete seal between the opposing material layers at the opposing sides and one of the opposing ends.

Figure 2A:
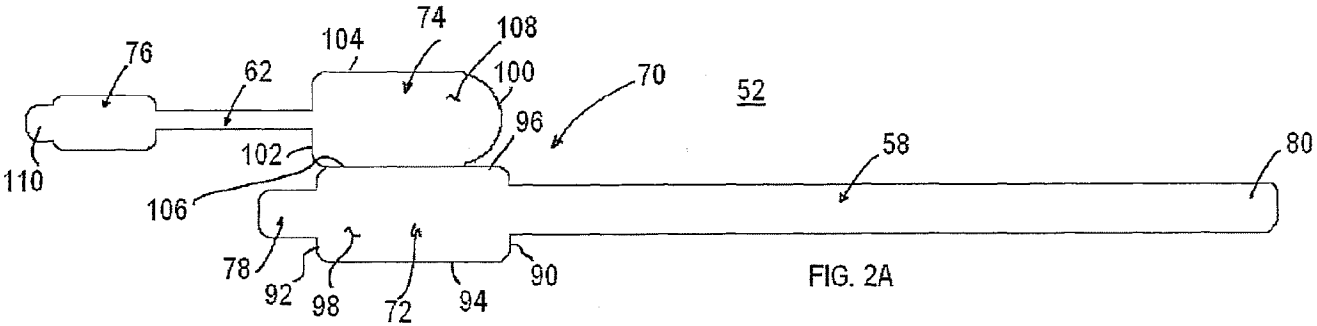
FIGS. 2A-2C illustrate assembly of one embodiment band useful with the system of FIGS. 1A and 1B.
Figure 2B:
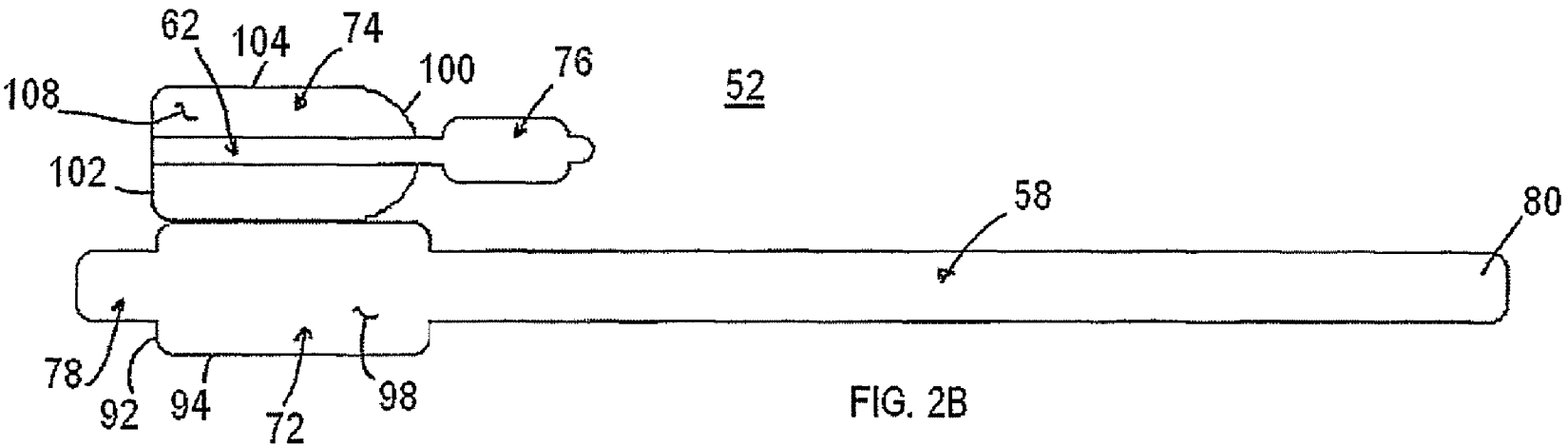
Figure 2C:
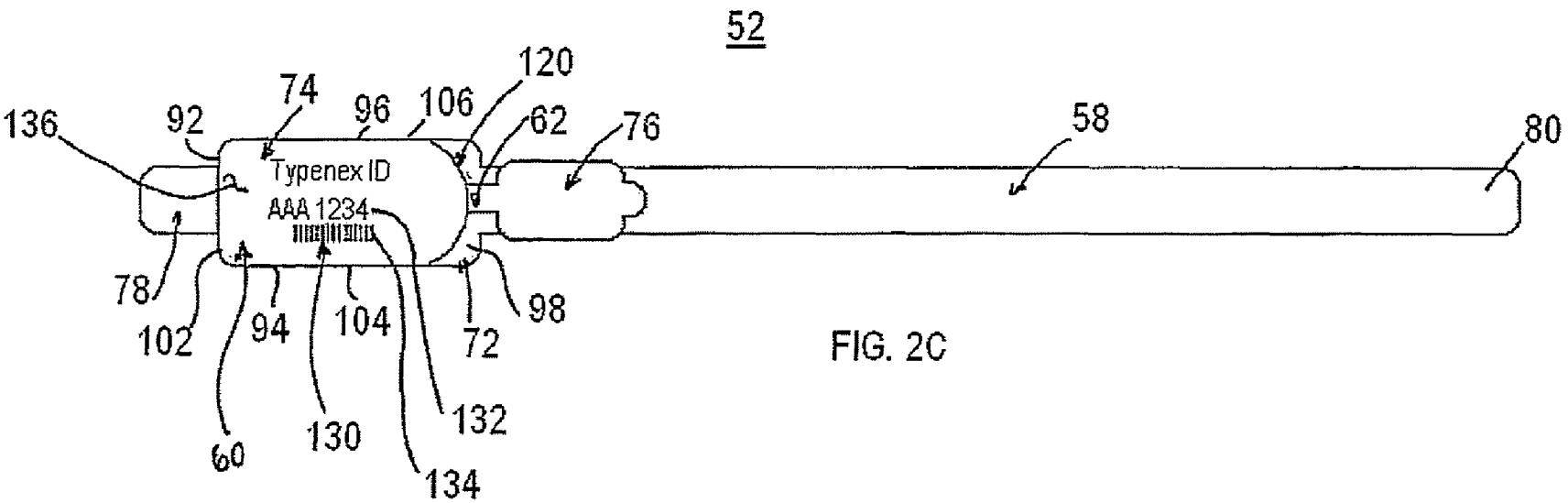

Features of the recipient verification system 50 can be formed and assembled in a variety of manners. For example, FIGS. 2A-2C illustrate but one acceptable technique for forming the band 52. Initially, the band 52 is defined as a die-cut, single- or multi-layer laminate structure 70. The laminate material(s) are selected to be flexible yet resistant to tearing, and appropriate for contact with human skin. For example, acceptable laminate material(s) include polyethylene, polyester, vinyl, nonwoven foams, low density polyethylene/COC blends, Tyvek®, etc. Regardless, with the one construction of FIG. 2A, the cut laminate structure 70 includes the strap 58, a lower pocket segment 72, an upper pocket segment 74, the tether 62, an optional head 76, and an optional strap connection segment 78. Two or more (including all) of the components 58, 62, 72-78 can be formed as a homogeneous structure (e.g., formed by at least one common, continuous material web), or can be formed of differing materials (e.g., the lower pocket segment 72 can be opaque whereas the upper pocket segment 74 can be substantially transparent).

The strap 58 is formed in-line with, and extends from, the lower pocket segment 72, terminating a tail end 80. Thus, in some constructions, the lower pocket segment 72 is a continuation or part of the strap 58. In this regard, the strap 58 can have any desired length appropriate for a desired end-user (e.g., patient). For example, a length of the strap 58 (in combination with a length of the lower pocket segment 72) can range from a larger size appropriate for placement about an adult's wrist or ankle, to a smaller size appropriate for use with children or infants. In other embodiments, the strap 58 can be modified by a caregiver (or other third party) immediately prior to use in an attempt to better match a size of the user or patient in question, for example by cutting the strap 58 (adjacent the tail end 80) to a desired length. To facilitate this approach, the strap 58 can optionally include or display indicia designating lengths and/or possible cut locations.

The lower pocket segment 72 is formed as a direct extension of the strap 58, and includes or defines opposing, first and second end edges 90, 92, opposing, first and second side edges 94, 96, an inner face 98 and an outer face (hidden in the view of FIG. 2A). As illustrated, in some embodiments, a width of the lower pocket segment 72 (i.e., distance between the side edges 94, 96) is greater than a width of the strap 58, although in other embodiments the lower pocket segment 72 and the strap 58 can have commensurate widths or the strap 58 can be wider than the lower pocket segment 72. Regardless, a major axis of the lower pocket segment 72 (i.e., parallel with the side edges 94, 96) can be axially aligned with a major axis of the strap 58.

The upper pocket segment 74 extends from the lower pocket segment 72, defining or forming opposing, leading and trailing end edges 100, 102. The upper pocket segment 74 further forms or defines opposing, first and second side edges 104, 106, with the second side edge 106 of the upper pocket segment 74 being commonly shared with the second side edge 96 of the lower pocket segment 72. Finally, the upper pocket segment 74 includes or defines an inner face 108 and an outer face (hidden in the view of FIG. 2A). With this construction, then, the upper pocket segment 74 is laterally off-set from the major axis of the lower pocket segment 72, and in particular relative to the strap 58. The upper pocket segment 74 has a size and shape generally commensurate with that of the lower pocket segment 72. For reasons made clear below, a length of the upper pocket segment 74 can be slightly less than that of the lower pocket segment 72 in some embodiments. For example, the upper pocket segment 74 can be formed such that the trailing end edge 102 is aligned with the second end edge 92 of the lower pocket segment 72. However, the leading end edge 100 is longitudinally displaced from the first end edge 90 of the lower pocket segment 72 (i.e., a longitudinal distance between the leading and trailing end edges 100, 102 is less than a longitudinal distance between the first and second end edges 90, 92 of the lower pocket segment 72). In other embodiments, the pocket segments 72, 74 can have an identical length, or the upper pocket segment 74 can be longer than the lower pocket segment 72. Further, the leading end edge 100 can have a shape differing from a shape of the first end edge 90 of the lower pocket segment 72 (e.g., the first end edge 90 can be relatively linear, whereas the leading end edge 100 is curved, for example convex, in shape).

The tether 62 is attached to, and extends directly from, the trailing end edge 102 of the upper pocket segment 74. In some constructions, the tether 62 is centered relative to a width or height of the upper pocket segment 74. Regardless, the laminate structure 70 can be initially formed such that the tether 62 extends from the upper pocket segment 74 in a longitudinal direction opposite the longitudinal direction of extension of the strap 58 from the lower pocket segment 72.

The head 76 is attached to, and extends directly from, the tether 62, and is formed opposite the point of attachment of the tether 62 to the upper pocket segment 74. With some constructions, the head 76 has a width or height greater than that of the tether 62, and terminates at a tab 110. As described below, this but one acceptable configuration provides sufficient surface area for receiving a label strip (e.g. the label strip 58 of FIG. 1A), as well as a convenient surface (i.e., the tab 110) for grasping by a user. In other embodiments, however, the head 76 can be eliminated (e.g., the tether 62 has a uniform width/height and a discernable head is not provided). Regardless, a combined longitudinal length of the tether 62/head 76 (or the tether 62 alone where the head 76 is omitted) is greater than a longitudinal length of the upper pocket segment 74 with embodiments in which the tether 62 is attached to/extends from the trailing end edge 102 of the upper pocket segment 74 as made clear below.

Finally, the optional strap connection segment 78 is formed as direct extension from the lower pocket segment 72 in a longitudinal direction opposite the strap 58. In general terms, where provided, the strap connection segment 78 facilitates assembly of the strap 58 about a wearer's appendage, and can assume a variety of shapes and/or sizes appropriate for use with the selected closure device 56 (FIGS. 1A and 1B). Along these same lines, with some constructions, the closure device 56 can be configured such that a separate attachment surface is not necessary; with these and other embodiments, the strap connection segment 78 can be omitted.

With the above configuration of the initial laminate structure 70 in mind, construction of the band 52 entails folding the tether 62 over the upper pocket segment 74 as shown in FIG. 2B. More particularly, the tether 62 is placed in loose abutment with the inner face 108 of the upper pocket segment 74, with the head 76 extending beyond the leading end edge 100. While the tether 62 may or may not be in temporary contact with the inner face 108, the tether 62 is directly attached to the upper pocket segment 74 only at the trailing end edge 102.

The upper pocket segment 74 is then folded over the lower pocket segment 72 as shown in FIG. 2C, with the inner faces 98, 108 positioned proximate one another. The fold line is defined at the commonly-shared second side edges 96, 106, with the first side edges 94, 104 being generally aligned upon final positioning of the upper pocket segment 74. Similarly, the trailing end edge 102 of the upper pocket segment 74 is generally aligned with the second end edge 92 of the lower pocket segment 72.

The lower and upper pocket segments 72, 74 are then bonded to one another along at least a portion of the corresponding perimeters, for example the first side edges 94/104 and optionally the second end edge/trailing end edge 92/102. The bonding can be performed in a variety of fashions, including adhesive, heat sealing, RF welding, ultrasonic welding, etc. Regardless, following bonding, the pocket segments 72, 74 combine to form the pocket 60. An interior region of the pocket 60 (i.e., the open space between the respective inner faces 98, 108 (FIG. 2A)) is accessible via an opening 120 (referenced generally). With some constructions, the opening 120 is formed or defined by an absence of bonding between the leading end edge 100 of the upper pocket segment 74 relative to the lower pocket segment 72. With constructions in which the leading end edge 100 is curved (i.e., the convex curvature reflected in the figures), the leading end edge 100 can be folded away from the lower pocket segment 72 to afford better access to an interior region of the pocket 60 where desired; alternatively, a portion of the first side edge 104 immediately adjacent the leading end edge 100 can be free of attachment to the lower pocket segment 72. Regardless, the tether 62 extends within the interior region of the pocket 60, with at least the head 76 projecting beyond the leading end edge 100 and thus outside of the interior region of the pocket 60. Further, the tether 62 is permanently captured at the pocket 60 via connection to the upper pocket segment 74. As described below, the tether 62/head 76 can be selectively manipulated by a user so as to dispose at least a majority, optionally an entirety, of the tether 62/head 76 (and any structure carried thereby such as the label strip 54 (FIG. 1A)) within the interior region of the pocket 60.

As a point of reference, FIG. 2C further reflects band identification indicia 130 carried by the band 52. The band identification indicia 130 can assume a wide variety of formats, and can be applied to the band 50 in various manners. For example, in some exemplary embodiments, the band identification indicia 130 includes a unique band code that is generated in one or more forms such as alphanumeric 132, barcode 134, magnetic stripe, RFID, etc. Regardless, a different, unique band code can be created for each new band 52 supplied to an institution making use of the system 50, with the institution optionally maintaining an electronic database (and/or written records) that assigns the unique band code to a particular recipient to whom the band 52 in question is applied. Subsequently, that same, unique band code is then correlated in the database with relevant recipient identification information. For example, the recipient can be a patient being admitted to a hospital and/or submitting test specimen (s) at a laboratory. Alternatively, the band identification indicia 130 can assume other forms and/or content; and in other embodiments, can be omitted.

Where provided, the band identification indicia 130 is permanently applied to the band 52. For example, the band identification indicia 130 can be printed on to a face of one of the pocket segments 72 or 74. With the constructions implicated by FIGS. 2A-2C, the band identification indicia 130 is printed onto an outer face 136 of the upper pocket segment 74. Alternatively, where the upper pocket segment 74 is substantially transparent, the band identification indicia 130 can be printed onto the inner face 98 (FIG. 2A) of the lower pocket segment 72 or the inner face 108 (FIG. 2A) of the upper pocket segment 74 prior to the folding steps described above. Even further, the band identification indicia 130 can be generated as part of a label that is permanently bonded to the band 52 (e.g., to the outer face 136 of the upper pocket segment 74, the inner face of 98 or 108 of one of the pocket segments 72 or 74 prior to folding, etc.). In this regard, the band identification indicia-bearing label can alternatively be provided as part of the label strip 54 (FIG. 1A) as described below.

Figure 3A:
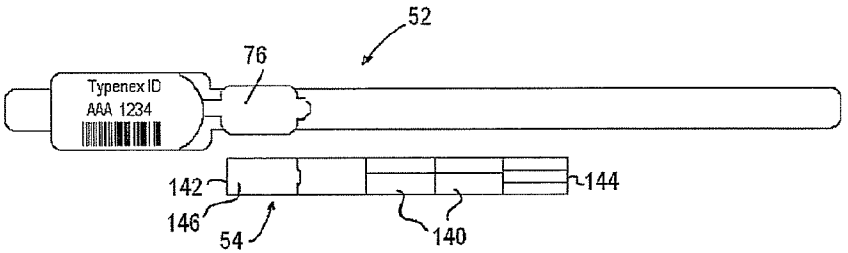
FIGS. 3A and 3B illustrate assembly of a label strip to the band of FIGS. 2A-2C.

Returning to FIGS. 1A and 1B, upon completion of the band 52, the label strip 54 is generated and applied. As a point of reference, the closure device 56 can be applied to the band 52 (or integrally formed by the band 52) prior to or after generating the label strip 54. Regardless, and as shown in FIG. 3A, the label strip 54 includes one or more removable, self-adhering label(s) 140 formed in a label stock material (e.g., die cut) and applied to or temporarily carried by a backing or release liner (hidden in FIG. 3A). The labels 140 can assume a variety of forms (in terms of shape, size, etc.) and can display various, patient-related information or data (as well as the unique band code previously described) as explained in detail below. Irrespective of an exact form, however, the label strip 54 forms or defines opposing, first and second strip ends 142, 144. A base section 146 of the label strip 54 adjacent the first strip end 142 can be adapted for permanent assembly to the band 52, for example by forming a cut (e.g., perforations) in the corresponding portion of the backing that permits removal of the backing portion to expose an adhesive side of the base section 146. To this end, the base section 146 can be akin to a label, displaying desired recipient and/or band-related information, or can more simply be blank.

Figure 3B:
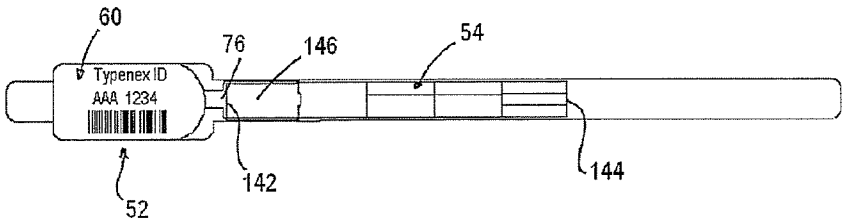

The base section 146 of the label strip 54 is then assembled to the head 76 as shown in FIG. 3B. For example, where the base section 146 is adhesive-backed, the adhesive can provide a permanent bond between the base section 146 and the head 76. Alternatively, other techniques (e.g., separately-provided adhesive, heat, welding, etc.) can be employed. Regardless, the label strip 54 is assembled such that the first strip end 142 is on or adjacent the head 76, whereas the second strip end 144 is longitudinally away from or opposite the head 76. Upon final assembly, the base section 146 cannot be removed from the head 76 under normal conditions (e.g., a patient cannot peel the base section 146 from the head 76 using his or her fingers), thus providing permanent affixation of the label strip 54 to the band 52.

Figure 4A:
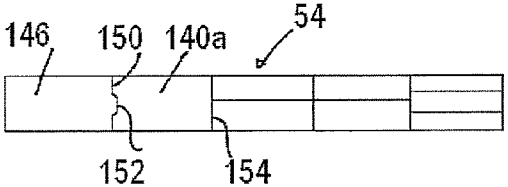
FIGS. 4A and 4B are perspective views illustrating folding of the label strip of FIGS. 3A and 3B.
Figure 4A:
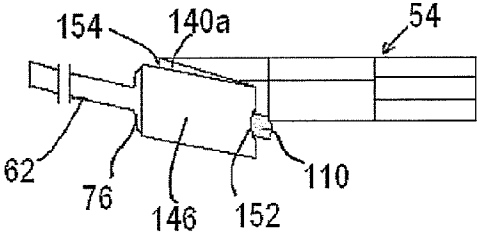

In the orientation of FIG. 3B, the label strip 54 is outside of the pocket 60, affording a caregiver or other third party user the ability to remove one or more of the labels 140 (from the corresponding release liner (not shown)) as desired. During periods of non-use, the label strip 54 can be positioned within the interior region of the pocket 60. To this end, in some embodiments, the label strip 54 is configured to facilitate folding thereof in a manner that permits convenient disposal within the pocket 60. For example, and with reference to FIG. 4A, in some constructions the label strip 54 is formed to define a first fold line 150 separating or demarcating the base section 146 from a first label 140*a*. The first fold line 150 optionally includes a central cut 152 (e.g., extending through an entire thickness of the label strip 54) having a curvature commensurate with a shape of the tab 110 formed by the head 76. With this construction, the label strip 54 can be folded along the first fold line 150 (i.e., the first label 140*a* manipulated "behind" the head 76), with the tab 110 projecting through the central cut 152 as shown. A remainder of the label strip 54 can then be folded (e.g., along additional fold lines 154 separating or demarcating sequential ones of the remaining labels 140), with each folded segment being further positioned "behind" the head 76. As a point of reference, while FIG. 4A illustrates the labels 140/folded segments as having a length (and width) commensurate with that of the head 76, in other embodiments, one or more of the labels 140 can be larger than the head 76; the labels 140/folded segments can be of any size or shape sufficient to allow for at least partial placement within the pocket 60 (FIG. 2C).

Figure 4B:
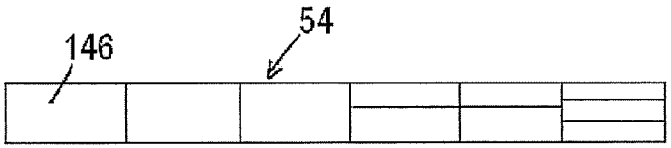

Alternatively, and as shown in FIG. 4B, the label strip 54 can be folded "in front" of the head 76. With this approach, the central cut 152 (FIG. 4A) can be omitted. A variety of other, differing techniques can also be employed for transitioning the label strip 54 from the extended or unfolded arrangement of FIG. 3B to a folded or contracted arrangement relative to the head 76.

Figure 5A:
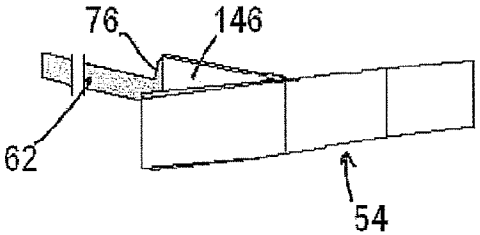
FIGS. 5A-5C illustrate use of the recipient verification system of FIGS. 1A and 1B.
Figure 5A:
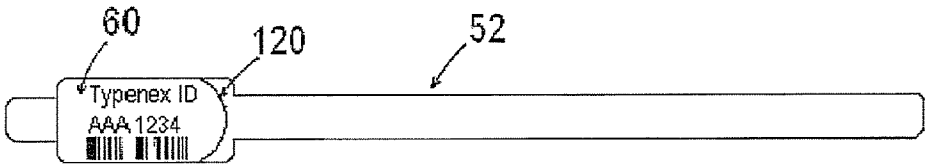
Figure 5B:
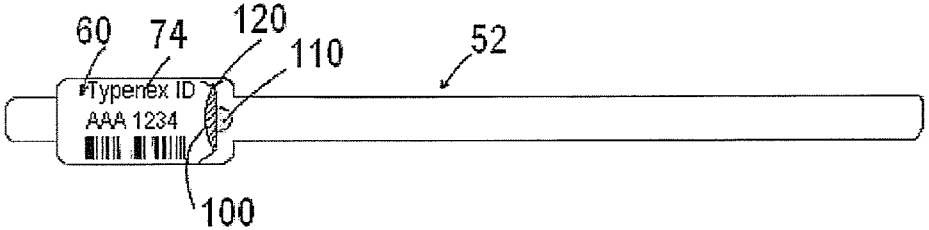
Figure 5C:
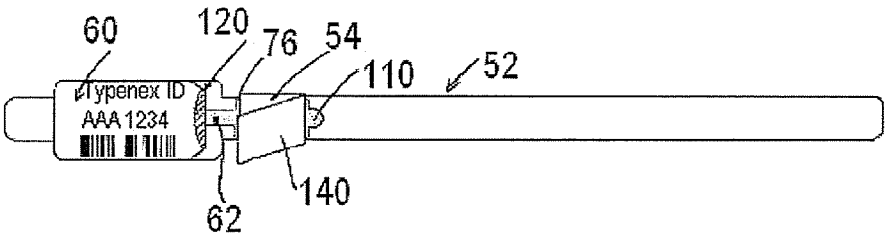

Returning to FIG. 3B, and with additional reference to FIGS. 5A and 5B, the folded label strip 54 can then be inserted into the interior region of the pocket 60, along with the tether 62 and the head 76, in transitioning the system 50 to a first or storage state. More particularly, in the folded arrangement, the label strip 54 easily slides within the pocket 60 via the opening 120. As part of this transition to the stored state of FIGS. 5A and 5B, the tether 62 readily folds upon itself or otherwise deforms within the pocket 60, allowing positioning of the head 76 and the attached label strip 54 within the interior region of the pocket 60. While FIG. 5A depicts an entirety of the label strip 54 residing within the pocket 60 in the storage state, in other embodiments, a portion of the label strip 54 and/or the tether 62 may project beyond the pocket 60 in the storage state. In more general terms, then, the storage state includes at least a majority of the label strip 54 being located within the pocket 60.

Where a caregiver or other relevant third party user of the system 50 desires access to one or more of the labels 140 carried by the label strip 54, the label strip 54 is pulled or otherwise withdrawn from the pocket 60 via the opening 120 (i.e., transitioned from the stored state of FIGS. 5A and 5B to a second or use state of FIG. 5C). In this regard, the optional tab 110 provides a convenient grasping surface for a user to applying a pulling force to the head 76 and thus the label strip 54 that is otherwise secured to the head 76. In some embodiments, the leading end edge 100 of the upper pocket segment 74 can be partially folded back (as reflected in FIGS. 5B and 5C) to more fully expose the tab 110. As a point of reference, FIG. 5A illustrates the band 52 with the leading edge end 100 unfolded, and thus the label strip 54 (hidden in FIG. 5A) fully contained within the pocket 60. Regardless, once the head 76 is removed from the pocket 60, the label strip 54 (including the remaining release liner) can be unfolded as shown in FIG. 5C, and one or more labels 140 removed from the label strip 54 as desired. The label strip 54 can subsequently be re-folded and re-inserted into the pocket 60 as described above, withdrawn from the pocket 60 for removal of one or more of the labels 140, etc. Notably, the label strip 54 remains physically secured to the band 52 (via the tether 62/head 76) at all times. Further, in the stored state, the pocket 60 protects the label strip 54/individual labels 140 from possible damage.

Figure 5D:
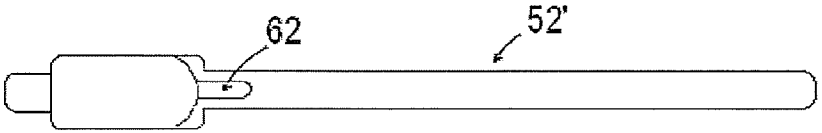
FIGS. 5D and 5E illustration portions of another embodiment recipient verification system in accordance with principles of the present disclosure.
Figure 5D:
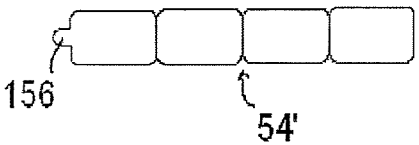
Figure 5E:
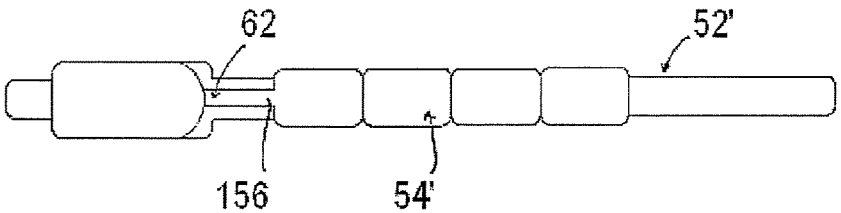

The band 52 can assume a variety of different forms that facilitate the various modes of use described above. For example, FIGS. 5D and 5E illustrate a related embodiment band 52' and a label strip 54'. The band 52' is highly similar to the band 52 described above, except that the head 76 (FIG. 3A) is omitted, and the label strip 54' includes a carrier 156 (best shown in FIG. 5D). The carrier 156 facilitates bonded assembly of the label strip 54' to the tether 62 of the band 52' as reflected in FIG. 5E.

Figure 6A:
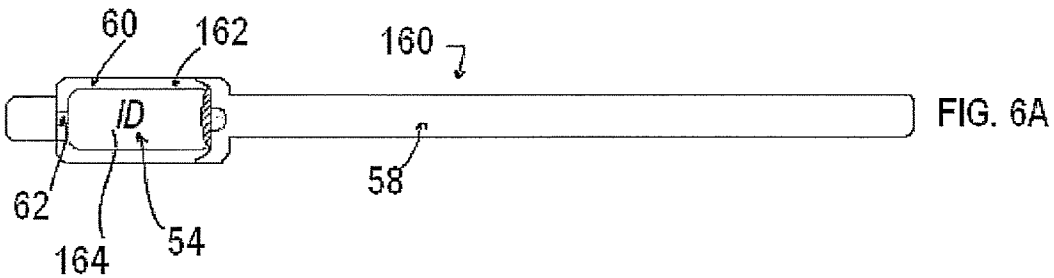
FIG. 6A is a top view illustrating another embodiment band useful with the recipient verification systems of the present disclosure.

FIG. 6A illustrates an alternative band 160 useful as part of the recipient verification systems in accordance with principles of the present disclosure. The band 160 is highly akin to the band 52 (FIG. 5A) previously described, for example in terms of components and methods of construction, and includes the strap 58, the pocket 60 and the tether 62 (referenced generally). The pocket 60 is sized to selectively receive the label strip 54 (referenced generally). With the embodiment of FIG. 6A, however, an upper pocket segment 162 of the band 160 is substantially transparent or clear. Further, the band 160 is not pre-printed or otherwise labeled with the band identification indicia 130 (FIG. 2C). Instead, a portion 164 of the label strip 54 (e.g., the base section 146 (FIG. 4A), one of the labels 140 (FIG. 4A), etc.) displays desired information, and is viewable through the upper pocket segment 162.

Figure 6B:
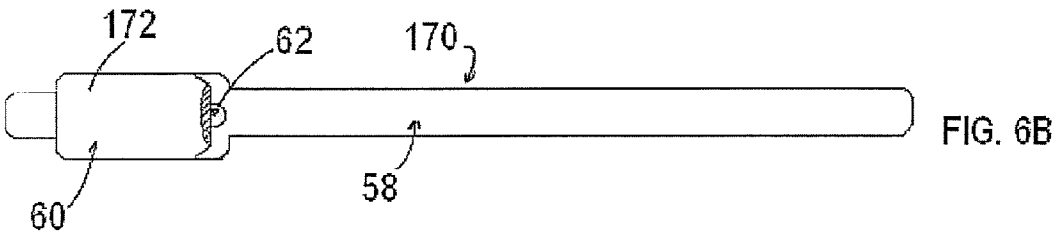
FIG. 6B is a top view of another embodiment band useful with the recipient verification systems of the present disclosure.

Another, related band 170 in accordance with principles of the present disclosure is shown in FIG. 6B, and again is akin to the band 52 (FIG. 5A) previously described, including the strap 58, the pocket 60, and the tether 62 (referenced generally). With this alternative construction, however, an upper pocket segment 172 is substantially opaque, and the band identification indicia 130 (FIG. 2C) omitted. Thus, in the stored state of FIG. 6B, recipient verification identification information otherwise associated with the label strip (hidden in FIG. 6B) is not viewable from an exterior of the band 170. With these and related embodiments, then, recipient privacy can better be ensured if desired.

Figure 7A:
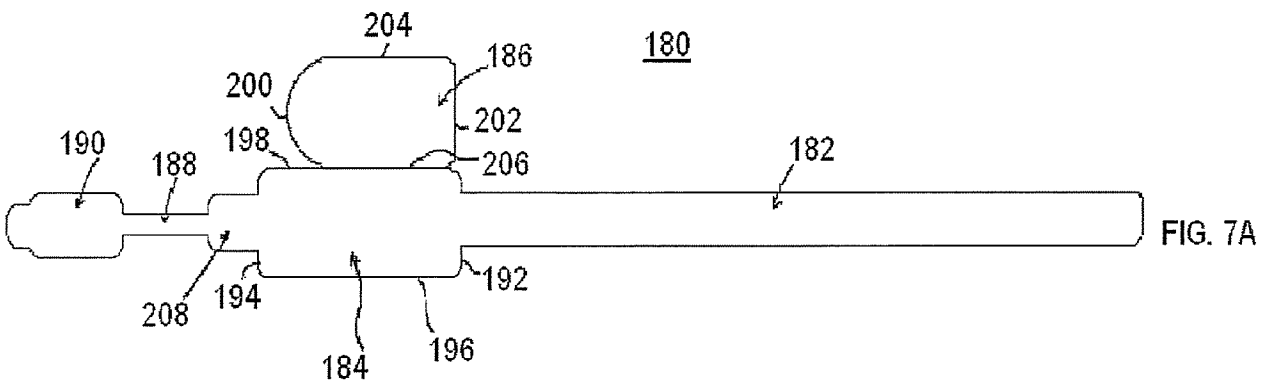
FIGS. 7A-7C are top views of another embodiment band useful with the recipient verification systems of the present disclosure.
Figure 7B:
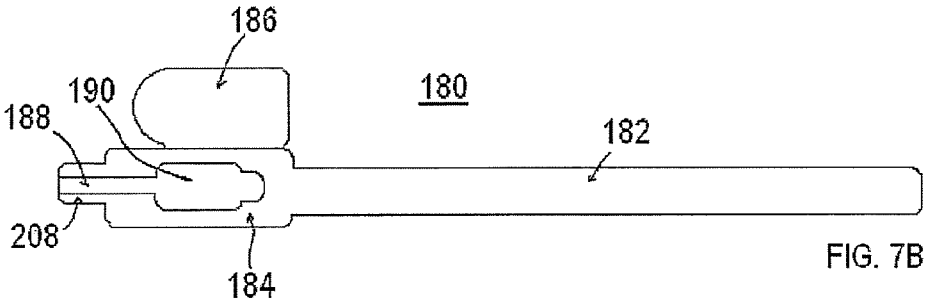
Figure 7C:
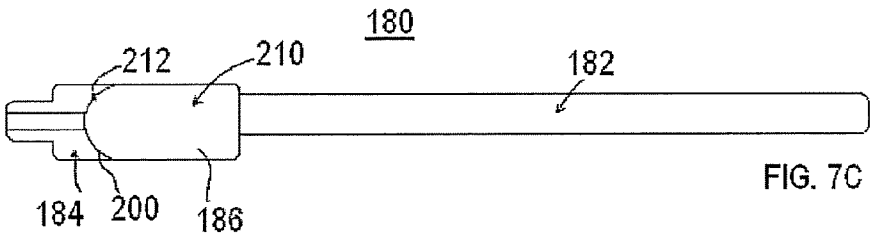

Yet another embodiment band 180 in accordance with principles of the present disclosure is shown in FIGS. 7A-7C. The band 180 is akin to previous embodiments, and is generally formed to include or define (in the initial, die cut laminate structure state of FIG. 7A) a strap 182, a lower pocket segment 184, an upper pocket segment 186, a tether 188, and a head 190. In some embodiments, two or more or all of the components 182-190 are integrally formed by at least one continuous material web. Alternatively, one or more of the components 182-190 can be separately formed and subsequently assembled.

The lower pocket segment 184 includes opposing, first and second end edges 192, 194 and opposing, first and second side edges 196, 198. The strap 182 extends from the first end edge 192 as shown. The upper pocket segment 186 also forms leading and trailing end edges 200, 202 and opposing, first and second side edges 204, 206. The second side edges 198, 206 are commonly shared by the pocket segments 184, 186, with extension of the upper pocket segment 186 from the lower pocket segment 184 being laterally off-set relative to extension of the strap 182. While the leading end edge 200 can have the curved (e.g. convex) shape as previously described, the pocket segments 184, 186 are arranged such that the leading end edge 200 of the upper pocket segment 186 is positioned opposite the strap 182 for reasons made clear below.

The head 190 extends from the tether 188. Unlike previous embodiments, however, the tether 188 extends from the lower pocket segment 184 (as opposed to the upper pocket segment 186). For example, the lower pocket segment 184 can form or be connected to a strap connection segment 208 that is akin to the strap connection segment 78 (FIG. 2A) previously described. Thus, the strap connection segment 208 can be viewed as being a component of the lower pocket segment 184 (and thus defining a portion of the second end edge 194), or as a structure apart from the lower pocket segment 184 extending directly from the second side edge 194. In any event, the tether 188 is attached to, and extends directly from, the strap connection segment 208, and is generally aligned with the strap 182.

Assembly of the band 180 is similar to previous embodiments. The tether 188 is folded over or on to the lower pocket segment 184 as shown in FIG. 7B, with the fold line being defined at an intersection of the tether 188 and the strap connection segment 208. In the folded orientation of FIG. 7B, the head 190 resides along the lower pocket segment 184, extending from the tether 188 toward the strap 182.

In FIG. 7C, the upper pocket segment 186 is folded over or on to the lower pocket segment 184, with the head 190 (FIG.

7B) and at least a portion of the tether 188 residing between the pocket segments 184, 186. At least a portion of the common perimeters of the pocket segments 184, 186 are then attached to one another as previously described, except at the leading end edge 200 of the upper pocket segment 186. As a result, a pocket 210 is collectively formed by the pocket segments 184, 186, with an opening 212 (referenced generally) to an interior region of the pocket 210 being defined at the leading end edge 200 of the upper pocket segment 186. The head 190 and at least a portion of the tether 188 are selectively positionable within, and removable from, the interior region of the pocket 210 via the opening 212. As with previous embodiments, then, a label strip (not shown, but akin to the label strip 54 of FIG. 3A) can be attached to the head 190, selectively stored inside the pocket 210, and removed from the pocket 210 when access to one or more labels is desired, with the label strip at all times remaining physically connected to the band 180 via the tether 188/head 190.

Yet another embodiment band 220 in accordance with principles of the present disclosure is shown in FIGS. 8A-8E. The band 220 is akin to previous embodiments, and is generally formed to include or define (in the initial, die cut laminate structure state of FIG. 8A) a strap 222, a lower pocket segment 224, an upper pocket segment 226, a tether 228, and a head 230. In addition, the band 220 includes a connective web 232. In some embodiments, two or more or all of the components 222-232 are integrally formed by at least one continuous material web. Alternatively, one or more of the components 222-232 can be separately and subsequently assembled.

The lower pocket segment 224 includes opposing, first and second end edges 234, 236 and opposing, first and second side edges 238, 240. The strap 222 extends from the first end edge 234 as shown. The upper pocket segment 226 also forms leading and trailing end edges 242, 244 and opposing, first and second side edges 246, 248. The second side edges 240, 248 are commonly shared by the pocket segments 224, 226, with extension of the upper pocket segment 226 from the lower pocket segment 224 being laterally off-set relative to extension of the strap 222. The leading end edge 242 can have the curved (e.g. convex) shape as previously described, and the pocket segments 224, 226 are arranged such that the leading end edge 242 of the upper pocket segment 226 is positioned adjacent the strap 222 for reasons made clear below.

Once again, the head 230 is directly connected to, or formed by, the tether 228. Unlike previous embodiments, however, the tether 228 is attached to the strap 222 via the connective web 232. In this regard, the connective web 232 extends from the strap 222 at a point proximate the lower pocket segment 224 in a generally perpendicular fashion relative to a major axis/longitudinal extension of the strap 222. Further, in some embodiments, the connective web 232 includes or forms a center section 250 disposed between opposing legs 252, 254. The center section 250 is wider than the legs 252, 254, providing sufficient surface area for securement of the tether 228 as described below. Further, the first leg 252 extends from the strap 222, whereas the second leg 254 extends from the tether 228 at a point generally opposite the head 230. Regardless, the tether 228 is generally parallel with the strap 222, with the head 230 being generally laterally aligned with the pocket segments 224, 226.

Figure 8A:
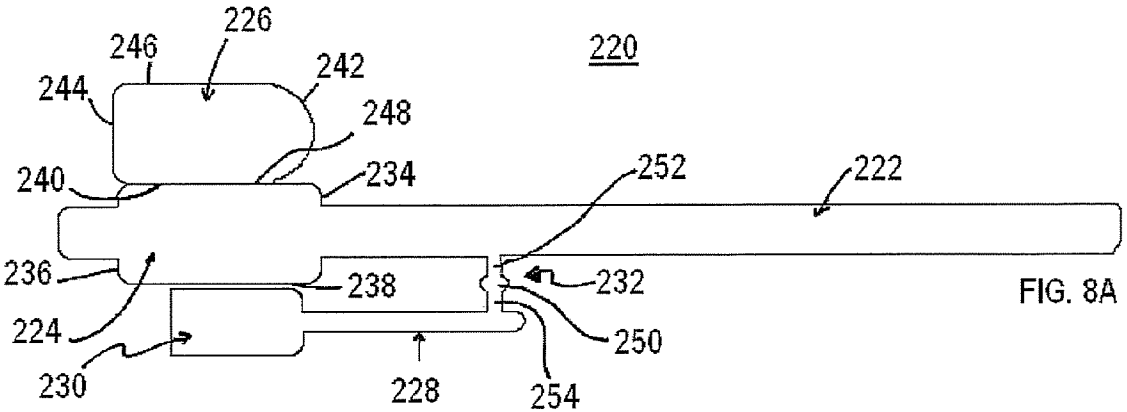
FIGS. 8A-8E are top views of another embodiment band with the recipient verification systems of the present disclosure.
Figure 8B:
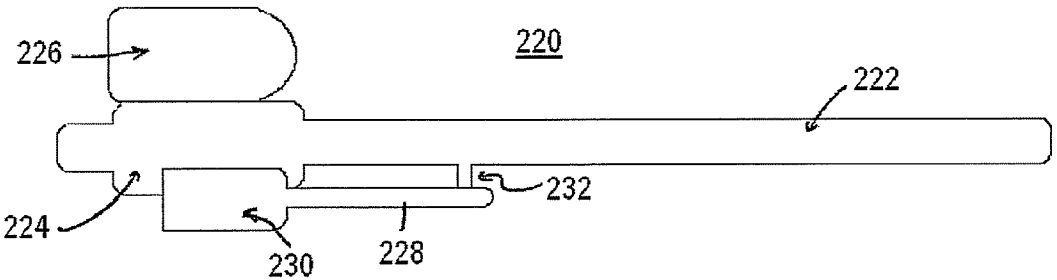

Assembly of the band 220 initially includes folding the tether 228 relative to the connective web 232 as shown by the transition from FIG. 8A to FIG. 8B. For example, the tether 228 is folded at an intersection with the second leg 254 (hidden in the view of FIG. 8A), such that the tether 228 abuts against the center section 250 (hidden in the view of FIG. 8A). As a point of clarification, with this folding step, the head 230 (otherwise carried by the tether 228) is moved to a more proximate position relative to the lower pocket segment 224.

Figure 8C:
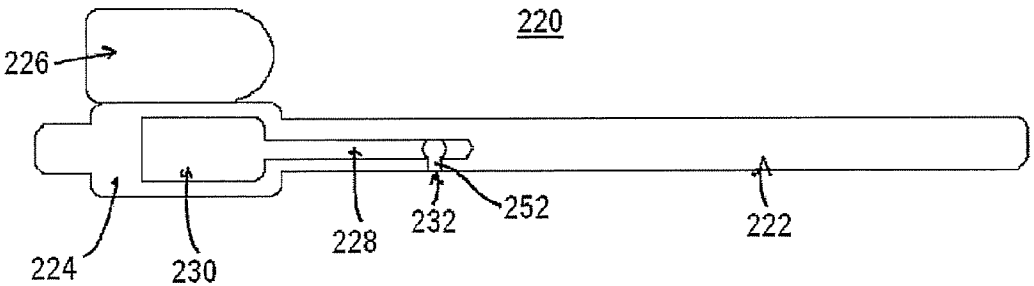

The connective web 232 is folded relative to the strap 222 (i.e., at the point of interface between the first leg 252 and the strap 222) as shown in FIG. 8C. The tether 228 is simultaneously moved with folding of the connective web 232, effectively turning over (relative to the orientation of FIG. 8B) and being generally aligned with the strap 222. The head 230 also transitions with movement of the tether 228, coming into placement against the lower pocket segment 224.

Figure 8D:
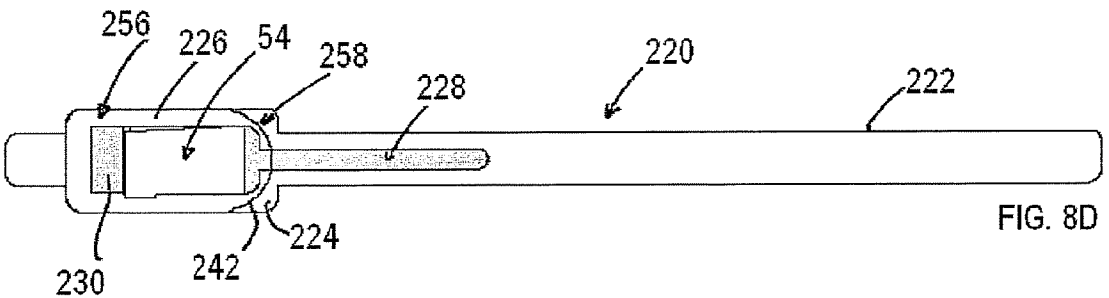
Figure 8E:
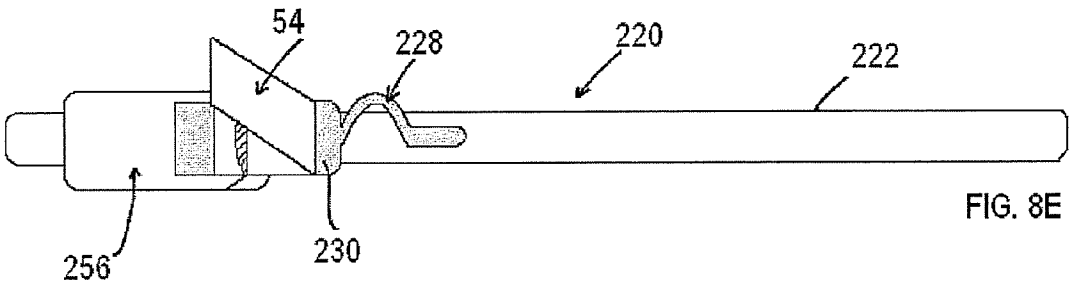

The upper pocket segment 226 is then folded onto the lower pocket segment 224 as with previous embodiments, resulting in formation of a pocket 256 as shown in FIG. 8D. As a point of reference, FIG. 8D further illustrates the label strip 54 mounted to the head 230. The pocket segments 224, 226 are bonded to one another along at least a portion of the corresponding perimeters, except at the leading end edge 242 of the upper pocket segment 226, thereby forming an opening 258 to an interior region of the pocket 256. The tether 228 can similarly be bonded to the strap 228 (e.g., adhesive, heat seal, welding, etc.) in a region of the center section 250 of the connective web 232 (FIG. 8C).

With the above construction, the head 230 and at least a portion of the tether 228, as well as the label strip 54 carried by the head 230, can be selectively inserted into and removed from the interior region of the pocket 256 via the opening 258. For example, FIG. 8D illustrates the stored state of the band 220 in which the folded label strip 54 is stored in the pocket 256. Where access to the label strip 54 is desired, the head 230 is removed from the pocket 256 by, for example, pulling on the tether 228. In the use state of FIG. 8E, then, the tether 228 has been flexed in withdrawing the head 230/label strip 54. As all times, however, the tether 228 remains bonded to the strap 222, such that the label strip 54 remains physically connected to the band 220.

Yet another embodiment band 270 in accordance with principles of the present disclosure is shown in FIGS. 9A-9E. The band 270 is akin to previous embodiments, and is generally formed to include or define (in the initial, die cut laminate structure state of FIG. 9A) a strap 272, a lower pocket segment 274, an upper pocket segment 276, a tether 278, and a head 280. In some embodiments, two or more or all of the components 272-280 are integrally formed by at least one continuous material web. Alternatively, one or more of the components 272-280 can be separately formed and subsequently assembled.

The lower pocket segment 274 includes opposing, first and second end edges 284, 286 and opposing, first and second side edges 288, 290. The strap 272 extends from the first end edge 284 as shown, and terminates at tail end 291. The upper pocket segment 276 also forms leading and trailing end edges 292, 294 and opposing, first and second side edges 296, 298. The second side edges 290, 298 are commonly shared by the pocket segments 274, 276, with extension of the upper pocket segment 276 from the lower pocket segment 274 being laterally off-set relative to extension of the strap 272. The leading end edge 292 can have the curved (e.g. convex) shape as previously described, and the pocket segments 274, 276 are arranged such that the leading end edge 292 of the upper pocket segment 276 is positioned adjacent the strap 272 for reasons made clear below.

In addition, a slit or slot 300 is formed through a thickness of the upper pocket segment 276 adjacent the leading end edge 292. The slit 300 extends in a generally perpendicular fashion relative to a longitudinal orientation of the upper pocket segment 276 (e.g., perpendicular to an extension of the strap 272), and has a length commensurate with (e.g., slightly greater than) a width of the strap 272. As described below, the slit 300 facilitates a more complete closure of a subsequently-formed pocket.

The tether 278 is attached to, and extends directly from, the trailing end edge 294 of the upper pocket segment 276, terminating at or forming the head 280.

Figure 9A:
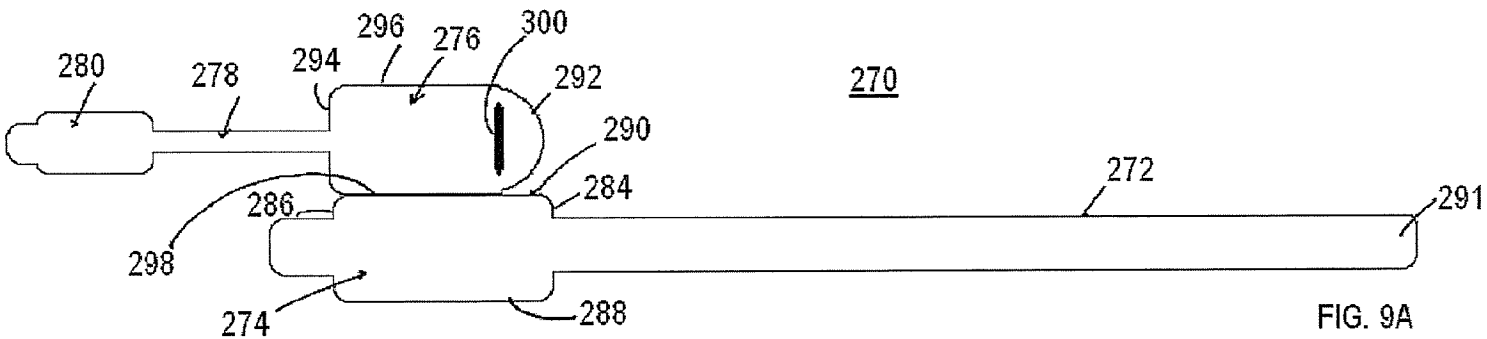
FIGS. 9A-9E are top views illustrating another embodiment band useful with the recipient verification systems of the present disclosure.
Figure 9B:
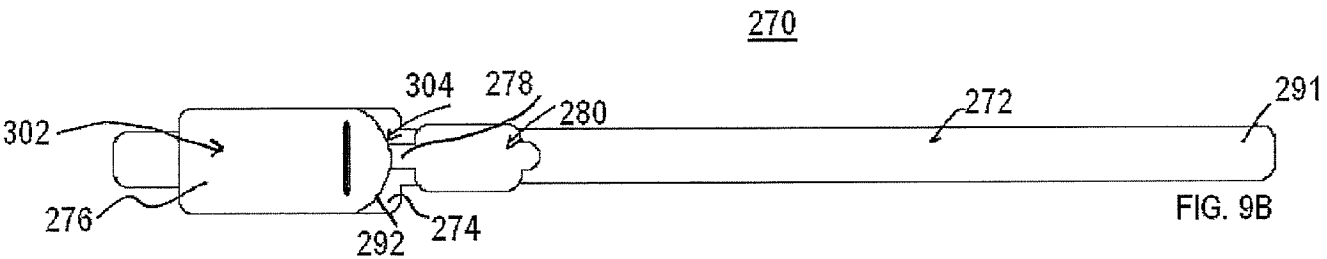
Figure 9C:
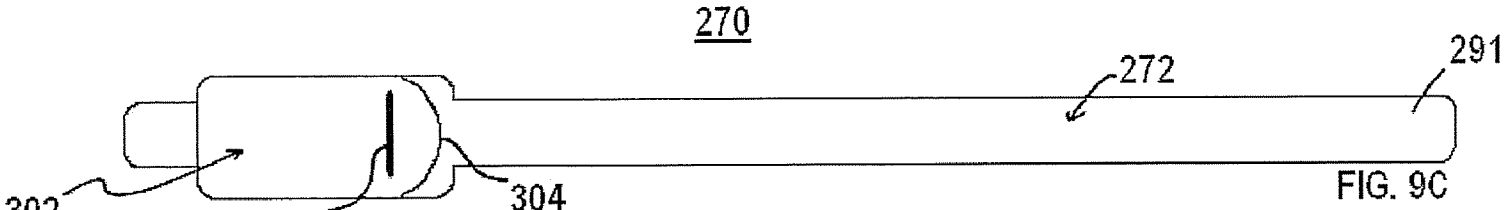

Assembly of the band 270 (and related recipient verification system) includes folding the tether 278 over the upper pocket segment 276, followed by folding of the upper pocket segment 276 on to the lower pocket segment 274, as shown in FIG. 9B. As with previous embodiments, the pocket segments 274, 276 combine to define a pocket 302 forming an interior region within which at least a portion of the tether 278 is maintained. Access to an interior region of the pocket 302 is provided via an opening 304 defined by the leading end edge 292 of the upper pocket segment 276. In this regard, at least portions of corresponding perimeters of the pocket segments 274, 276 can be attached to one another, except along the leading end edge 292.

In the state of FIG. 9B, a caregiver or other third party user can apply any desired identification information/indicia to the head 280. For example, a single label (not shown) displaying information of interest can be adhered to the head 280; alternatively, a label strip (not shown, but akin to the label strip 54 (FIG. 3A) described above) can be affixed to the head 280 as with previous constructions. Even further, desired identification information can be directly printed on to the head 280 (before or after formation of the pocket 302). Regardless, the tether 278/head 280 are then inserted (partially or fully) into the pocket 302 via the opening 304, resulting in the storage state of FIG. 9C.

Figure 9D:
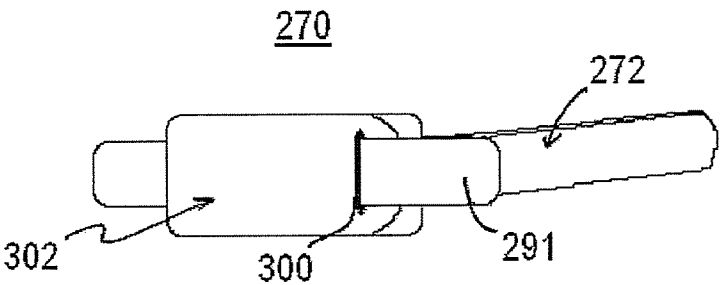
Figure 9E:
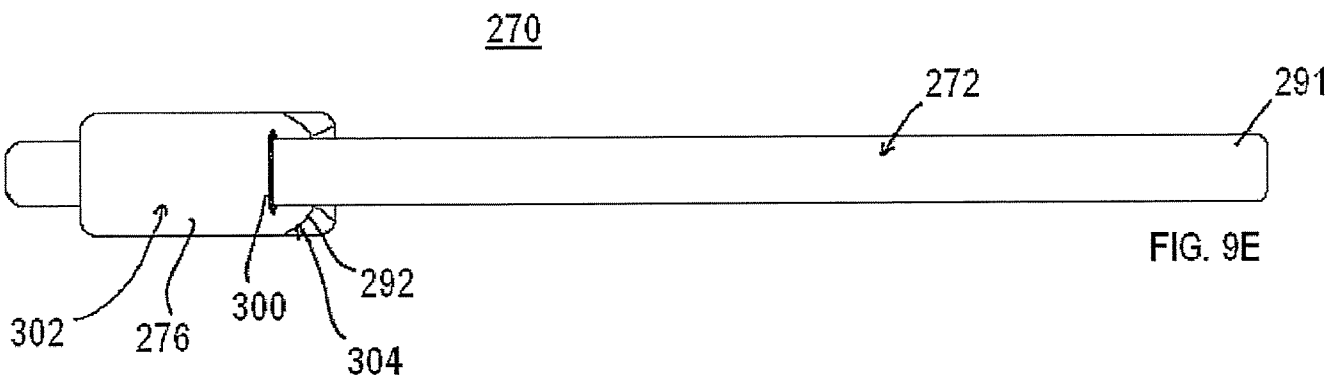

The tail end 291 of the strap 272 is then fed into the pocket 302 via the opening 304, and then threaded through the slit 300 such that the tail end 291 is external the pocket 302 as shown in FIG. 9D. Once so arranged, the tail end 291 is further pulled away from the pocket 302 until the strap 272 is relatively taut as reflected in FIG. 9E. As shown, the strap 272 extends across the leading end edge 292 of the upper pocket segment 276, thereby effectuating a more complete closure of the opening 304. This but one acceptable configuration of the band 270 is well-suited for end use applications in which subsequent, repeated access to contents of the pocket 302 is unnecessary, but a more rigorous protection of the contents desired.

In related, alternative embodiments, an additional slit (not shown) can be formed in the lower pocket segment 274 that is identical to, and aligned with, the slit 300 upon folding of the upper pocket segment 276. With this construction, the tail end 291 can be threaded in a variety of manners that to promote desired access (or limitations on access) to the contents of the pocket 302. For example, the tail end 291 can be threaded through the opening 304 and the slit 300 in the upper pocket segment 276 as described above. Alternatively, the tail end 291 can be threaded through both of the slits 300 (as opposed to extending through the opening 304), it being understood that the tether 278/head 280 will be positioned away from the aligned slits 300 to permit insertion of the strap 272. With either of these arrangements, the so-positioned strap 272 impedes (and protects) access to the opening 304. Conversely, the tail end 291 can be threaded through the slit in the lower pocket segment 274 and then fed outwardly from the pocket 302 via the opening 304, or more simply not fed through either of the slits 300. With this arrangement, the opening 304 is not obstructed by the strap 272 (e.g., where the strap 272 extends only through the slit in the lower pocket segment 274, the tether 278/head 280 is effectively positioned to be moveable "over" the strap 272), allowing selective access to contents of the pocket 302 as described above. Thus, the alternative band 270 provides a number of different end-use arrangements that can be selected based on caregiver preferences.

Figure 10A:
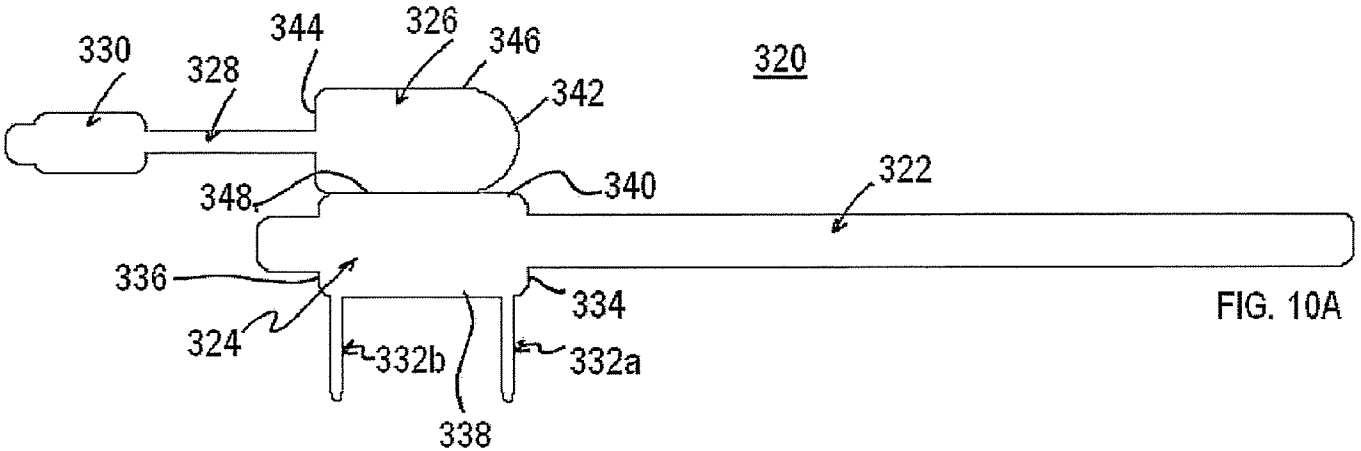
FIGS. 10A-10C illustrate another embodiment band useful with the recipient verification systems of the present disclosure.
Figure 10B:
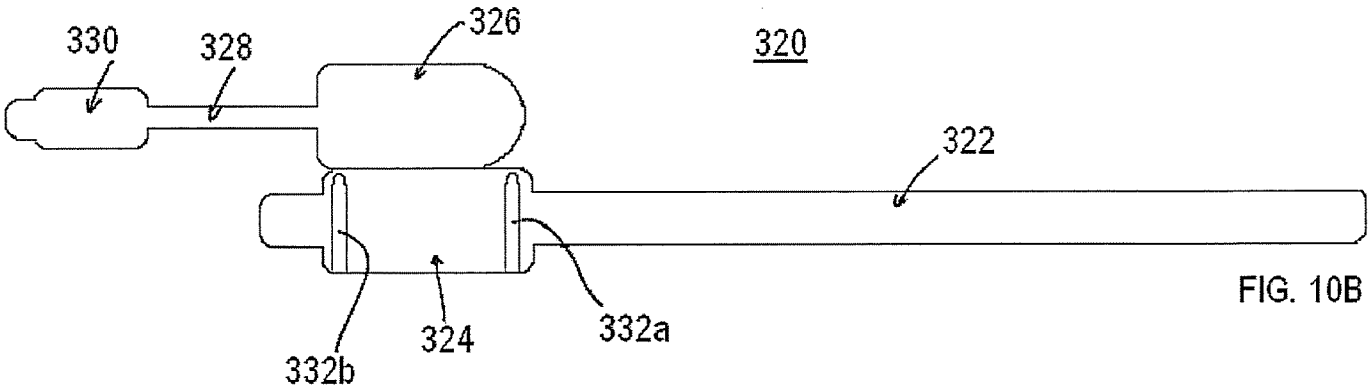
Figure 10C:
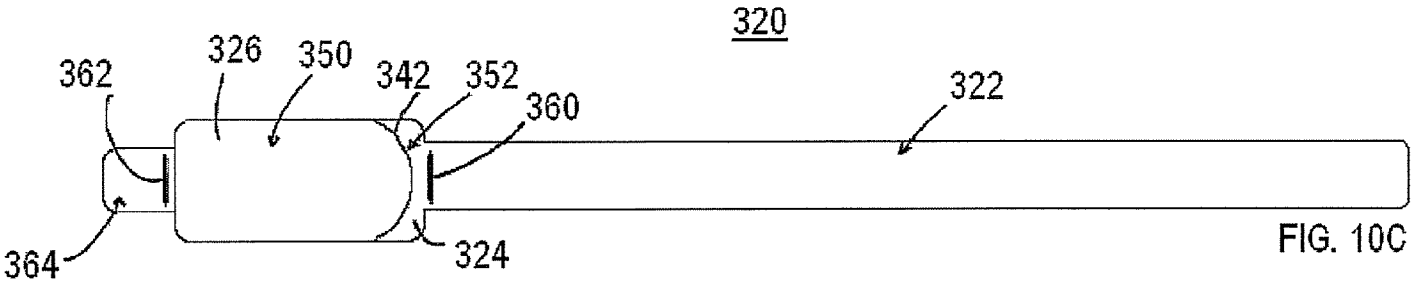

Yet another embodiment band 320 in accordance with principles of the present disclosure is shown in FIGS. 10A-10C. The band 320 is akin to previous embodiments, and is generally formed to include or define (in the initial, die cut laminate structure state of FIG. 10A) a strap 322, a lower pocket segment 324, an upper pocket segment 326, a tether 328, and a head 330. In addition, the band 320 includes reinforcement strips 332*a* and 332*b*. In some embodiments, two or more or all of the components 322-322*b* are integrally formed by at least one continuous material web. Alternatively, one or more of the components can be separately formed and subsequently assembled.

The lower pocket segment 324 includes opposing, first and second end edges 334, 336 and opposing, first and second side edges 338, 340. The strap 322 extends from the first end edge 334 as shown. The upper pocket segment 326 also forms leading and trailing end edges 342, 344 and opposing, first and second side edges 346, 348. The second side edges 340, 348 are commonly shared by the pocket segments 324, 326, with extension of the upper pocket segment 326 from the lower pocket segment 324 being laterally off-set relative to extension of the strap 322. The leading end edge 342 can have the curved (e.g. convex) shape as previously described, and the pocket segments 324, 326 are arranged such that the leading end edge 342 of the upper pocket segment 326 is positioned adjacent the strap 322 for reasons made clear below.

The reinforcement strips 332*a*, 332*b* extend from the first side edge 338 of the lower pocket segment 324 in a generally perpendicular fashion relative to a longitudinal length thereof. In this regard, the reinforcement strips 332*a*, 332*b* are laterally spaced from one another, positioned adjacent the opposing end edges 334, 336, respectively. While two of the reinforcement strips 332*a*, 332*b* are shown, in other embodiments, a greater or lesser number can be provided. Regardless, the reinforcement strips 332*a*, 332*b* have a length (i.e., dimension of extension from the first side edge 338) commensurate with a width of the lower pocket segment 324.

Assembly of the band 320 includes folding the reinforcement strips 332*a*, 332*b* over or on to the lower pocket segment 324 as shown in FIG. 10B. The reinforcement strips 332*a*, 332*b* can be bonded to the lower pocket segment 324 (e.g., adhesive, heat, welding, etc), or the remaining manufacturing steps performed with the reinforcement strips 332*a*, 332*b* loosely maintained against the lower pocket segment 324. Regardless, the tether 328 is folded over or on to the upper pocket segment 326, followed by folding of the upper pocket segment 326 over or on to the lower pocket segment 324 as with previous embodiments, resulting in the formation of a pocket 350 shown in FIG. 10C.

With continued reference to FIGS. 10B and 10C, at least portions of perimeters of the pocket segments 324, 326 are bonded to one another to complete the pocket 350, except at the leading end edge 342 of the upper pocket segment 326, thereby defining an opening 352 (reference generally) to an interior region of the pocket 350. The resultant recipient verification system is thus repeatedly transitionable between a storage state and a use state similar to previous embodiments. In this regard, the reinforcement strips 332*a*, 332*b* serve to reinforce the pocket 350 periphery, better ensuring consistent placement and protection of the tether 328/head 330 (and any structures attached to the head 330, such as the label strip 54 (FIG. 3A)) within the pocket 350. Further, the reinforcement strips 332*a*, 332*b* facilitate an enhanced usefulness of the pocket 350 with an optional replacement strap as described below.

Figure 10D:
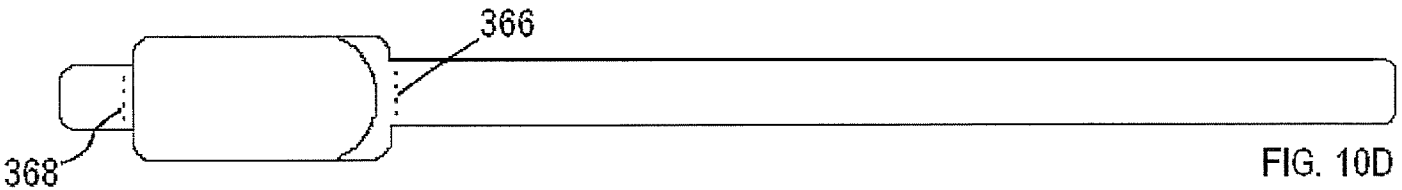
FIGS. 10D and 10E are top views illustrating modifications of the band of FIGS. 10A-10C.
Figure 10E:
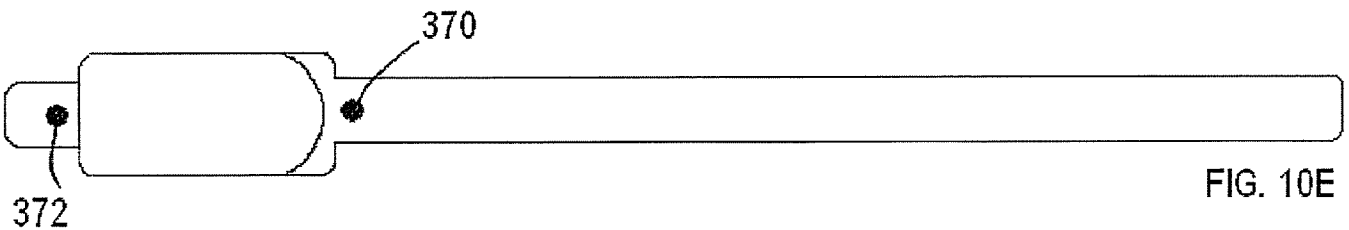

Application of the pocket 350 (and tether 328/head 330) with a replacement strap may be desirable under various circumstances, such as when the strap 322 is damaged, is uncomfortable when worn by the wearer (e.g., is secured too tightly about the patient's wrist), etc. Under these and other scenarios, the caregiver or other third party user may desire to employ a new or replacement strap for the recipient while not be required to generate new recipient identification information and corresponding label(s). In some embodiments, in addition or as an alternative to the reinforcement strips 332*a*, 332*b*, first and second slits or slots 360, 362 are formed at opposite sides of the pocket 350, in relatively close proximity thereto. For example, the first slit 360 can be formed through a thickness of the strap 322, whereas the second slit 362 is formed through a thickness of a strap connection segment 364 otherwise formed as an extension of the lower pocket segment 324. Other formats for the slits 360, 362 can be employed, such as perforations 366, 368 as shown in FIG. 10D or holes 370, 372 as shown in FIG. 10E.

Figure 11A:
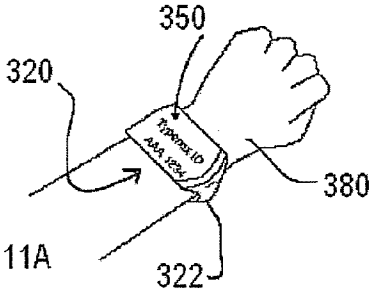
FIGS. 11A-11E illustrate implementation of a replacement strap with band portions in accordance with principles of the present disclosure.
Figure 11B:
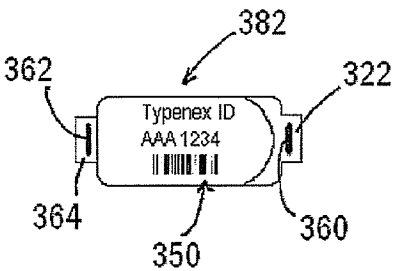

Regardless of an exact form of the slits 360, 362, the band 320 (as well as the label strip (not shown) carried thereby) is secured about an appendage of a wearer/recipient, for example a recipient's wrist 380 as illustrated in FIG. 11A. When a need arises to replace the strap 322 while maintaining use of the pocket 350 and related structures, the user simply cuts the strap 322 adjacent the slits 360, 362 (FIG. 10C) opposite the pocket 350. The resultant, cut pocket structure 382 is shown in FIG. 11B. As illustrated, the cut pocket structure 382 includes the pocket 350, as well as minor sections of the strap 322 and the strap connection segment 364 within which the slits 360, 362 are otherwise formed. Further, though hidden in the view of FIG. 11B, the tether 328/head 330 (FIG. 10B) and the attached label strip remain physically connected to the pocket 350.

Figure 11C:
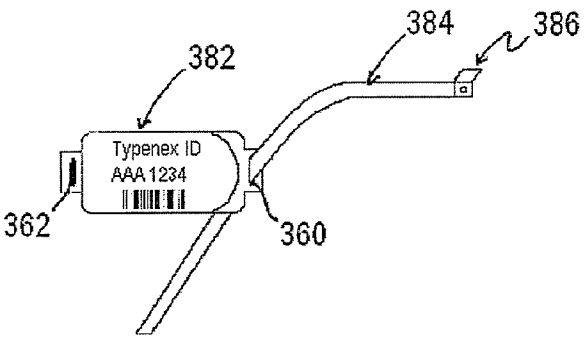
Figure 11D:
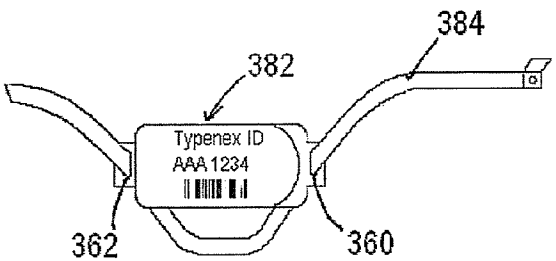
Figure 11E:
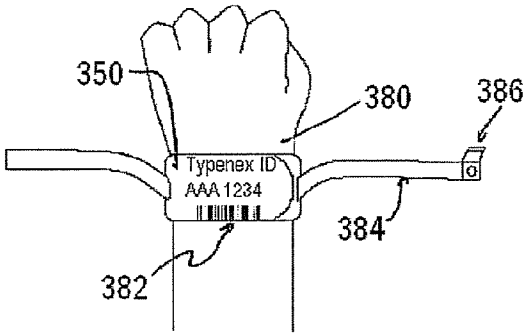

A replacement strap 384 is then provided and assembled to the pocket structure 382 as shown in FIGS. 11C and 11D. The replacement strap 384 can assume a variety of forms, and is generally constructed to be flexible, sized for placement through the slits 360, 362. Further, the replacement strap 384 can maintain a closure device 386. With this in mind, the replacement strap 384 is threaded through the first slit 360, under the pocket structure 382, and through the second slit 362 (or vice-versa). Once so-connected, the replacement strap 384 can be secured about the recipient's appendage 380 as shown in FIG. 11E, for example by deployment of the closure device 386. Regardless, the pocket structure 382 presents the pocket 350 (and related components including the label strip (not shown)) for use by caregivers or other third party users as previously described, with the optional reinforcement strips 332*a*, 332*b* (FIG. 10B) serving to reinforce the pocket structure 382 in a region of the slits 360, 362, impeding possible fraying or other deterioration of the pocket structure 382.

The replacement feature embodied by the band 320 (e.g., the slits 360, 362 at opposite sides of the pocket 350) and corresponding recipient verification system is equally applicable to any other embodiments of the present disclosure. Thus, it is contemplated that any of the previously or subsequently described bands of the pending application (e.g., any of the bands 52, 52', 160, 170, 180, 220, 270) can include, or be modified to include, the slits 360, 362 or similar replacement feature.

Figure 12A:
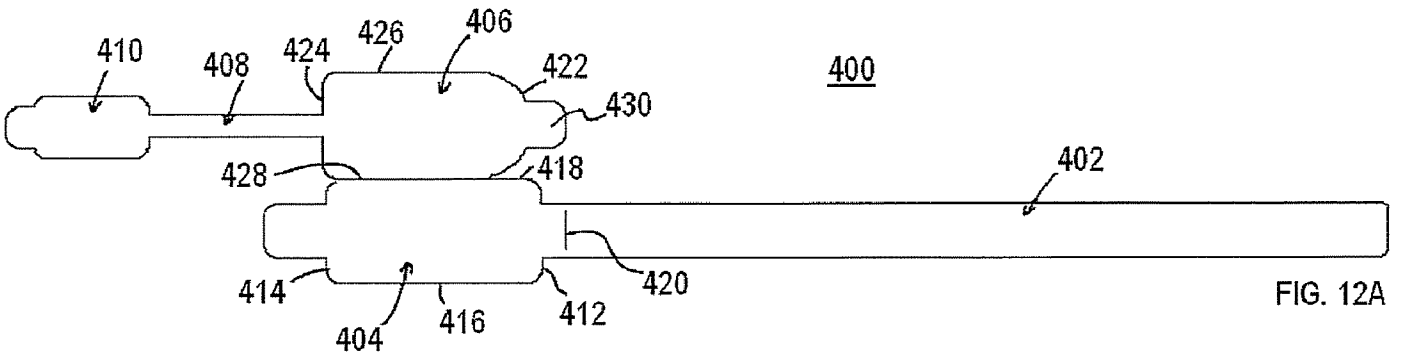
FIGS. 12A-12C are top views illustrating another embodiment band useful with the recipient verification systems of the present disclosure.
Figure 12B:
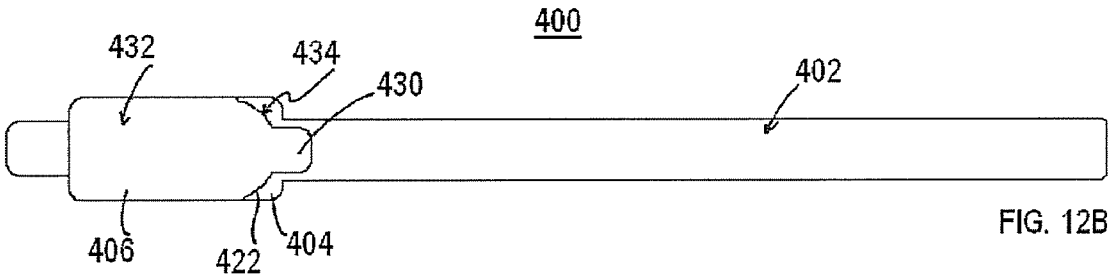
Figure 12C:
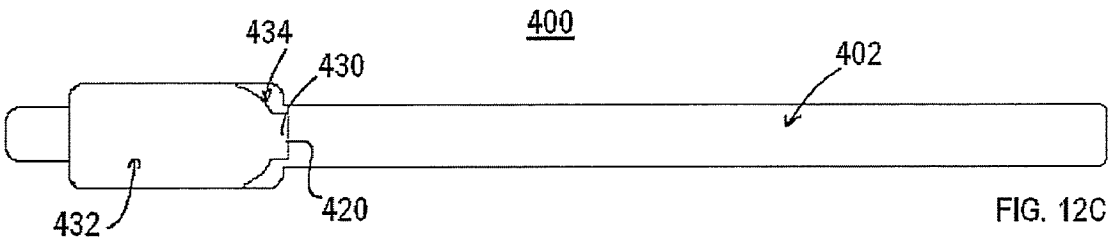

In addition or as an alternative to the above-described replacement feature, one or more slits can be provided with any of the bands of the present disclosure, serving one or more other purposes. For example, yet another embodiment band 400 in accordance with principles of the present disclosure is shown in FIGS. 12A-12C. The band 400 is akin to previous embodiments, and is generally formed to include or define (in the initial, die cut laminate structure state of FIG. 12A) a strap 402, a lower pocket segment 404, an upper pocket segment 406, a tether 408, and a head 410. In some embodiments, two or more or all of the components 402-410 are integrally formed by at least one continuous material web. Alternatively, one or more of the components 402-410 can be separately formed and subsequently assembled.

The lower pocket segment 404 includes opposing, first and second end edges 412, 414 and opposing, first and second side edges 416, 418. The strap 402 extends from the first end edge 412 as shown. A slit 420 is formed through a thickness of the strap 402 adjacent the first end edge 412, and is sized in accordance with a feature of the upper pocket segment 406. The upper pocket segment 406 also forms leading and trailing end edges 422, 424 and opposing, first and second side edges 426, 428. The second side edges 418, 428 are commonly shared by the pocket segments 404, 406, with extension of the upper pocket segment 406 from the lower pocket segment 404 being laterally off-set relative to extension of the strap 402.

Unlike some previous embodiments, the upper pocket segment 406 has a longitudinal length greater than that of the lower pocket segment 404. More particularly, while a portion of the leading end edge 422 can have the curved (e.g., convex) shape and is arranged to be adjacent the strap 402, the upper pocket segment 406 further forms a nose 430 at the leading end edge 422. The nose 430 is defined as a centrally positioned, longitudinal extension of the upper pocket segment 406 in a same direction as extension of the strap 402 from the lower pocket segment 404. Further, a width of the nose 430 can be commensurate (e.g., slightly smaller than) a length of the slit 420. Alternatively, the nose 430 can assume a wide variety of other shapes or constructions appropriate for insertion within the slit 420 (e.g., can include deformable ears that can be deflected for insertion into the slit 420). Even further, other connection type components (e.g., adhesive, Velcro, etc.) can be included.

The tether 408 is attached to, and extends directly from, the trailing end edge 424 of the upper pocket segment 406, terminating at or forming the head 410.

Assembly of the band 400 (and corresponding recipient verification system) includes folding the tether 408 over the upper pocket segment 406, followed by folding of the upper pocket segment 406 on to the lower pocket segment 404, as shown in FIG. 12B. As with previous embodiments, the pocket segments 404, 406 combine to define a pocket 432 within which at least a portion of the tether 408 (FIG. 12A) is maintained. Access to an interior region of the pocket 432 is provided via an opening 434 defined by the leading end edge 422 of the upper pocket segment 406. In this regard, portions of corresponding perimeters of the pocket segments 404, 406 can be attached or bonded to one another, except along the leading end edge 422. Thus, the nose 430 is freely movable relative to the lower pocket segment 404 and the strap 402. As a point of reference, in the view of FIG. 12B, the tether 408/head 410 extend across the pocket 432 similar to previous embodiments, but are "covered" by the upper pocket segment 406 (and particular the nose 430). The upper pocket segment 406 is sized and arranged relative to the lower pocket segment 406 such that the nose 430 extends beyond the slit 420 (FIG. 12A) in the position of FIG. 12B.

The band 400 can be used as previously described as part of a recipient verification system that further includes a label strip (e.g., the label strip 54 of FIG. 3A). Where desired, the opening 434 can be closed by inserting the nose 430 into the slit 420 as shown in FIG. 12C, thereby more completely protecting contents of the pocket 432.

Figure 13:
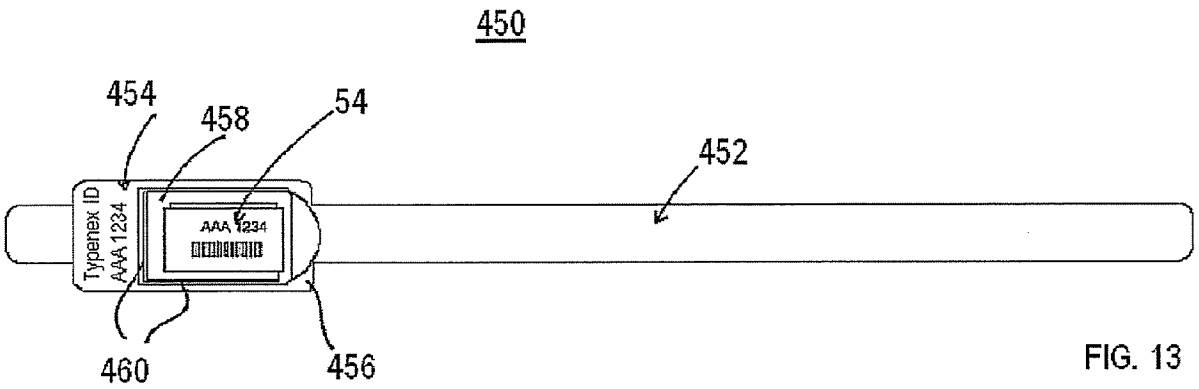
FIG. 13 is a top view of another embodiment band and related label strip useful with the recipient verification systems of the present disclosure.

As an alternative or in addition to the slit 420/nose 430, an adhesive can be employed to effectuate a more complete, selective closure of the pocket opening 434. For example, FIG. 13 illustrates yet another alternative embodiment band 450 in accordance with principles of the present disclosure. The band 450 includes a strap 452 and a pocket 454 defined by a lower pocket segment 456 and an upper pocket segment 458. The band 450 can optionally further include a tether/head (not shown) similar to previous embodiments that maintain the label strip 54 within an interior region of the pocket 454. With the construction of FIG. 13, the upper pocket segment 458 is removably assembled to the lower pocket segment 456 along a sealing interface 460 (referenced generally). The sealing interface 460 can be established by an applied adhesive (e.g., a pressure sensitive adhesive) that permits the upper pocket segment 458 to be repeatedly removed and replaced relative to the lower pocket segment 456 to permit access, withdrawal, and replacement of the label strip 54 to and from an interior region of the pocket 454.

Yet another embodiment band 470 in accordance with principles of the present disclosure is shown in FIGS. 14A-14E, along with the label strip 54. The band 470 is akin to previous embodiments, and is generally formed to include or define (in the initial, die cut laminate structure state of FIG. 14A) a strap 472, a lower pocket segment 474, an upper pocket segment 476, and a tether 478. Unlike some aspects of previous embodiments, the tether 478 is formed or provided separately from the remaining components 472-476.

The lower pocket segment 474 includes opposing, first and second end edges 482, 484 and opposing, first and second side edges 486, 488. The strap 472 extends from the first end edge 482 as shown. The upper pocket segment 476 also forms leading and trailing end edges 492, 494 and opposing, first and second side edges 496, 498. The second side edges 488, 498 are commonly shared by the pocket segments 474, 476, with extension of the upper pocket segment 476 from the lower pocket segment 474 being laterally off-set relative to extension of the strap 472.

The tether 478 is separately formed from the strap 472 and the pocket segments 476-478, and generally includes a head 500, a base 502, and a tab 504. A width or height of the base 502 is greater than that of the head 500, and is commensurate (e.g., slightly less than) a width or height of the pocket segments 474, 476. Further, the tether 478 has a length that is commensurate with (e.g., slightly less than) a longitudinal length of the pocket segments 474, 476.

Figure 14B:
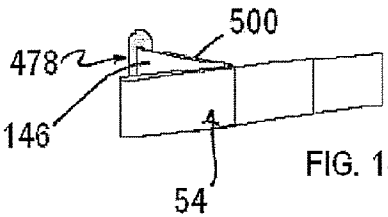
FIGS. 14A-14E are top views illustrating another embodiment band and use thereof as part of systems in accordance with the present disclosure.
Figure 14A:
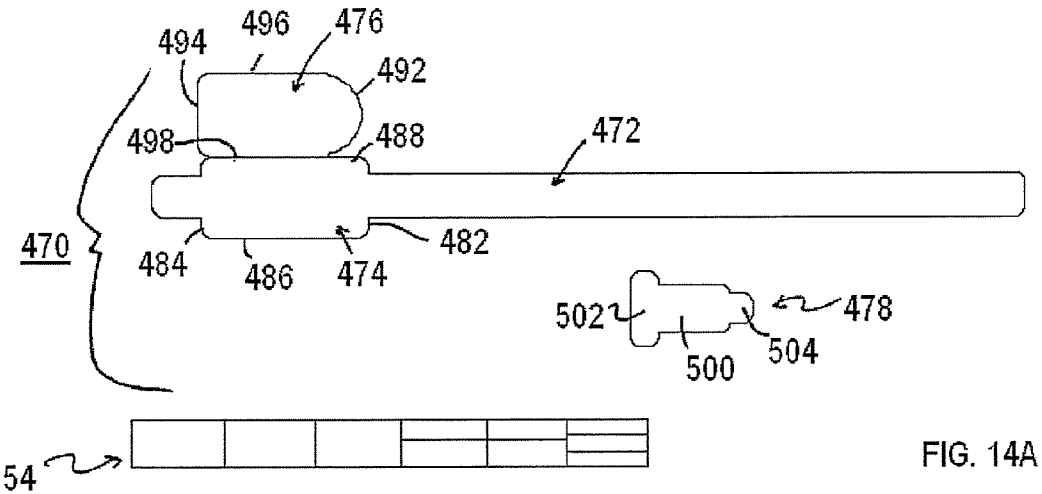
Figure 14C:
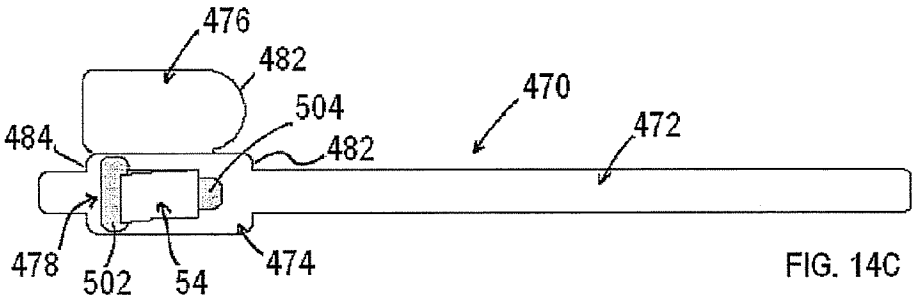

With additional reference to FIG. 14B, assembly of the band 470 as part of a recipient verification system includes securing the label strip 54 to the tether 478. In particular, the base section 146 is mounted to the head 500, followed by folding of the label strip 54 onto itself. The combination tether 478/folded label strip 54 is then placed onto the lower pocket segment 474 as reflected in FIG. 14C. As shown, the base 502 is positioned adjacent the second end edge 484, and the tab 504 is located adjacent the first end edge 482.

Figure 14D:
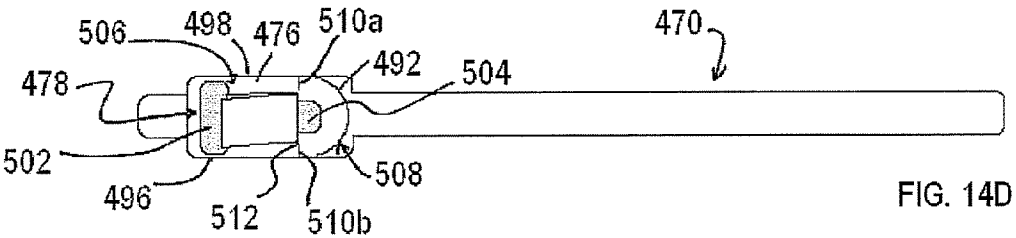
Figure 14E:
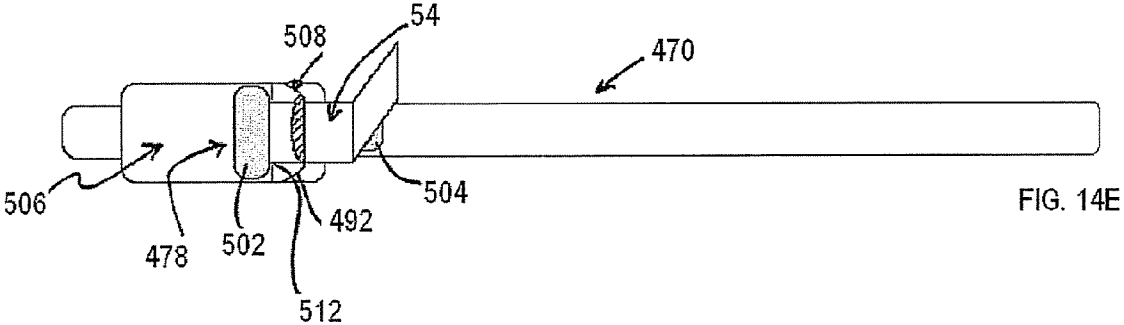

The upper pocket segment 476 is then folded relative to the lower pocket segment 474, thereby sandwiching the tether 478/folded label strip 54 between the pocket segments 474, 476. At least portions of common perimeters of the pocket segments 474, 476 are then secured to one another as previously described, except at the leading end edge 482 of the upper pocket segment 476. As a result, a pocket 506 is formed, with access to an interior region of the pocket 506 being provided by an opening 508 defined at the leading end edge 482 as shown in FIG. 14D. In this regard, opposing seal lines 510*a*, 510*b* are formed proximate the leading end edge 492 that further secure the pocket segments 474, 476 to one another. The seal lines 510*a*, 510*b* extend in a generally perpendicular fashion relative to the corresponding side edge 496 or 498, and combine to establish a gap 512. A size of the gap 512 is greater than a width or height of the head 500 (FIG. 14A) and the label strip 54, but is less than a width or height of the base 502. With this construction, the tether 478/folded label strip 54 is selectively maintained within an interior region of the pocket 506 in the stored state of FIG. 14D. The tether 478 is slidable relative to the pocket 506.

Where access to the label strip 54 is desired, the leading end edge 492 is retracted to expose the tab 504 of the tether 478. With reference to FIG. 14E, the tether 478 is then partially withdrawn from the pocket 506 via the opening 508, with the head 500/folded label strip 54 sliding through the gap 512. However, because a size of the gap 512 is less than a size of the base 502, the tether 478 cannot be completely removed from the pocket 506; instead, the seal lines 510*a*, 510*b* serve as a stop to sliding movement of the tether 478 from the pocket 506. In the orientation of FIG. 14E, the label strip 54 is exteriorly exposed relative to the pocket 506, affording a user the ability to access one or more of the labels carried by the label strip 54 as desired. As with previous embodiments, however, the tether 478 remains connected to, or captured at, the pocket 506, such that the label strip 54 is physically connected to the band 470 at all times.

Figure 14F:
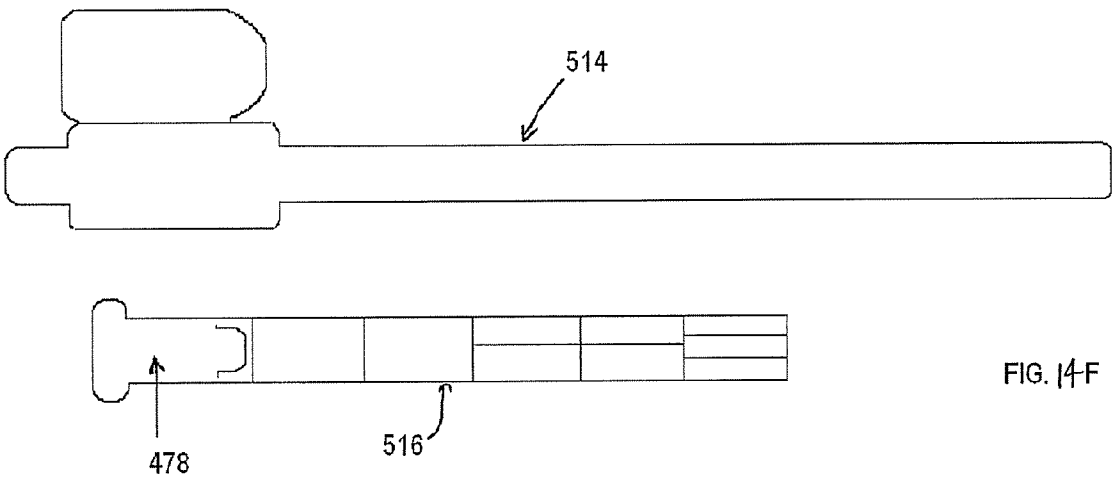
FIG. 14F is another embodiment band and label strip akin to the band and label strip of FIGS. 14A-14E.

FIG. 14F illustrates a related embodiment band 514 and label strip 516. The label strip 516 forms the tether 478, with the components 514, 516 being assembled as described above.

Figure 15:
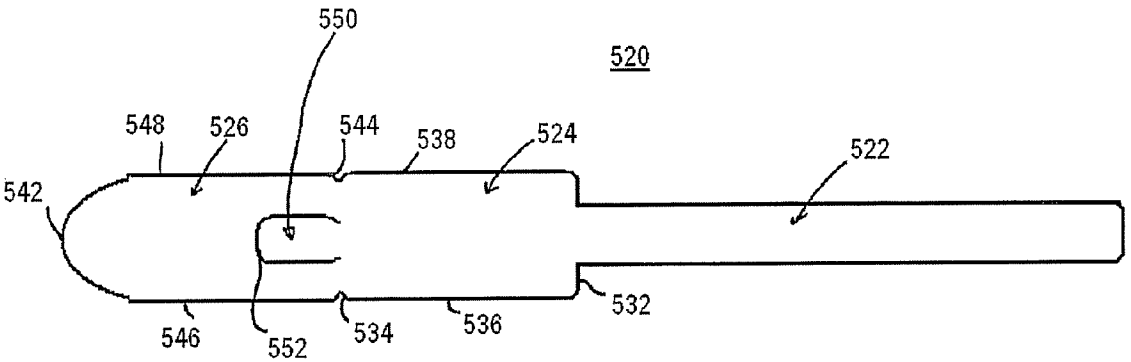
FIG. 15 is a top view of another embodiment band useful with the recipient verification systems of the present disclosure.

Yet another, related embodiment band 520 in accordance with principles of the present disclosure is shown in FIG. 15. The band 520 is akin to previous embodiments, and is generally formed to include or define (in the initial, die cut laminate structure state of FIG. 15) a strap 522, a lower pocket segment 524, an upper pocket segment 526, a tether 528, and a head 530. As with the band 450 (FIG. 14A), the tether 528/head 530 is initially provided apart from the other components 522-526 of the band 520.

The lower pocket segment 524 includes opposing, first and second end edges 532, 534 and opposing, first and second side edges 536, 538. The strap 522 extends from the first end edge 532 as shown. The upper pocket segment 526 also forms leading and trailing end edges 542, 544 and opposing, first and second edges 546, 548. In contrast to several of the previous embodiments, the pocket segments 524, 526 are arranged such that the second end edge 534 of the lower pocket segment 524 is commonly shared with the trailing end edge 544 of the upper pocket segment 526. Thus, extension of the upper pocket segment 526 from the lower pocket segment 524 is longitudinally aligned with extension of the strap 522. Further, the lower pocket segment 524 forms a flap 550 adjacent the trailing end edge 544. The flap 550 can be defined in a variety of manners, for example via an appropriately-shaped cut through a thickness of the lower pocket segment 524. Regardless, the flap 550 defines an aperture 552 relative to a remainder of the upper pocket segment 526, with a size of aperture 552 being greater than a width of the tether 528, but less than a width of the head 530.

Assembly of the band 520 includes placing the tether 528/head 530 on the lower pocket segment 524 and then sliding a portion of the tether 528 through the aperture 552 of the flap 550. Where desired, the tether 528 can be bonded to the flap 550 and/or other structures applied to slidably capture the tether 528 relative to the flap 550. Regardless, the upper pocket segment 526 is folded onto the lower pocket segment 524, resulting in a pocket (not shown) having an opening (not shown) defined by the leading end edge 542 of the upper pocket segment 526 that is otherwise not secured to the lower pocket segment 524. The head 530 is slidably removable from the so-formed pocket, with the tether 528 facilitating this desired manipulation via sliding along or through the aperture 552.

Figure 16A:
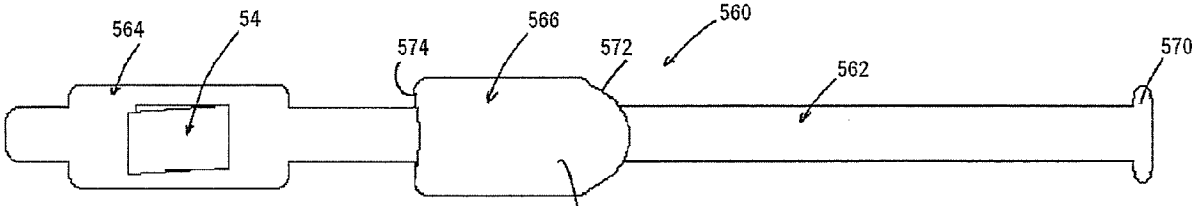
FIGS. 16A and 16B illustrate another embodiment band and related label strip in accordance with principles of the present disclosure.
Figure 16B:
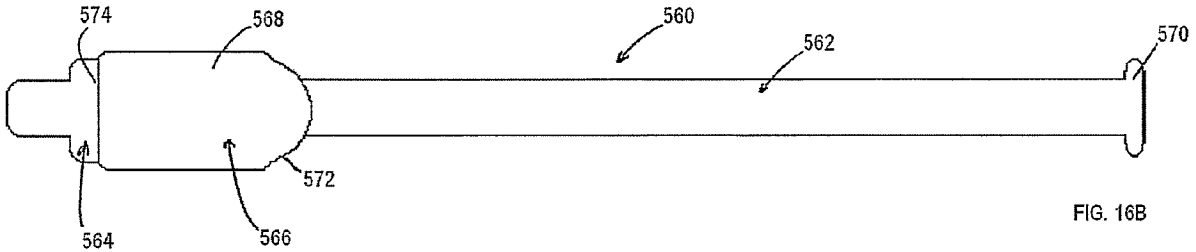

Yet another embodiment band 560 in accordance with principles of the present disclosure is shown in FIGS. 16A-16B, along with the label strip 54 as part of a recipient verification system. The band 560 is similar to previous embodiments, and includes a strap 562, a head 564, and a pocket 566. The pocket 566 is initially formed apart from the strap 562/head 564, and can be formed by or include an upper pocket segment 568 and a lower pocket segment (hidden in the views).

The strap 562 extends from the head 564, and terminates at a foot 570. As shown, a width of the strap 562 is less than a width of the head 564, except at the foot 570. That is to say, the strap 562 has a relatively uniform width along all regions except for the enlarged-width foot 570.

The pocket 566 is slidably assembled to the strap 562, and defines an interior region (not shown). In this regard, the interior region is open at leading and trailing ends 572, 574 of the pocket 566. More particularly, the pocket 566 is formed such that a lateral dimension of the opening provided at the leading end 572 is greater than a width of a majority of the strap 562, but is less than a width of the head 564 and the foot 570. Conversely, a lateral dimension of the opening at the trailing end 574 is greater than a width of the head 564. With this construction, then, the pocket 566 is slidable along the strap 562 between the positions of FIGS. 16A and 16B.

In the orientation of FIG. 16A (i.e., use state), the pocket 566 is displaced from the head 564, thereby exposing and permitting access to the label strip 54 otherwise secured to the head 564. Conversely, in the orientation of FIG. 16B (i.e., storage state), the pocket 566 is disposed over the head 564, thereby encompassing and protecting the label strip 54 (FIG. 16A). In this regard, due to a reduced size of the lateral dimension of the opening at the leading end 572, the pocket 566 cannot be fully slid over the head 564. That is to say, interface between the head 564 and the leading end 572 of the pocket 566 prevents further sliding movement of the pocket 566 beyond the position of FIG. 16B (i.e., relative to the orientation of FIG. 16B, the pocket 566 is prevented from sliding further leftward). A similar captured relationship is established between the leading end 572 of the pocket 566 and the foot 570. Thus, the pocket 566 is physically connected to the strap 562 at all times, affording consistent, selective access to, and protection of, the label strip 54.

Figure 17:
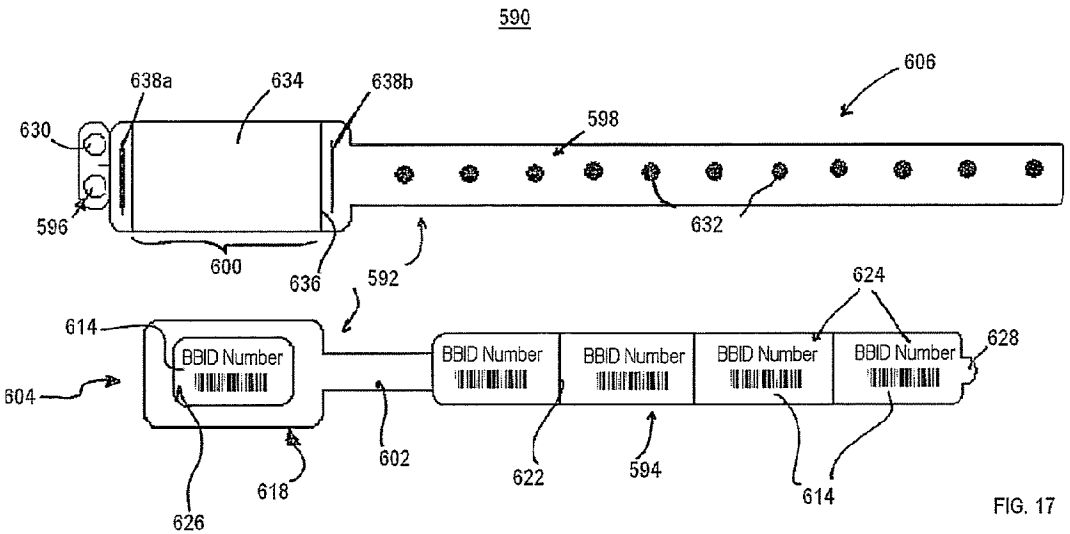
FIG. 17 is a top, exploded view of another recipient verification system in accordance with principles of the present disclosure.

Another recipient verification system 590 in accordance with principles of the present disclosure is shown in FIG. 17, and includes a band 592 (referenced generally), a label strip 594, and a closure device 596. The band 592, in turn, includes a strap 598, a pocket 600, and a tether 602. Details on the various components are provided below. In general terms, however, the label strip 594 and the tether 602 are initially formed as discernable parts of a unitary insert piece 604 that is subsequently assembled to the strap 598 and other components (e.g., the pocket 600) that can otherwise be initially provided as a base piece 606.

Figures 18A, 18B, 18C:
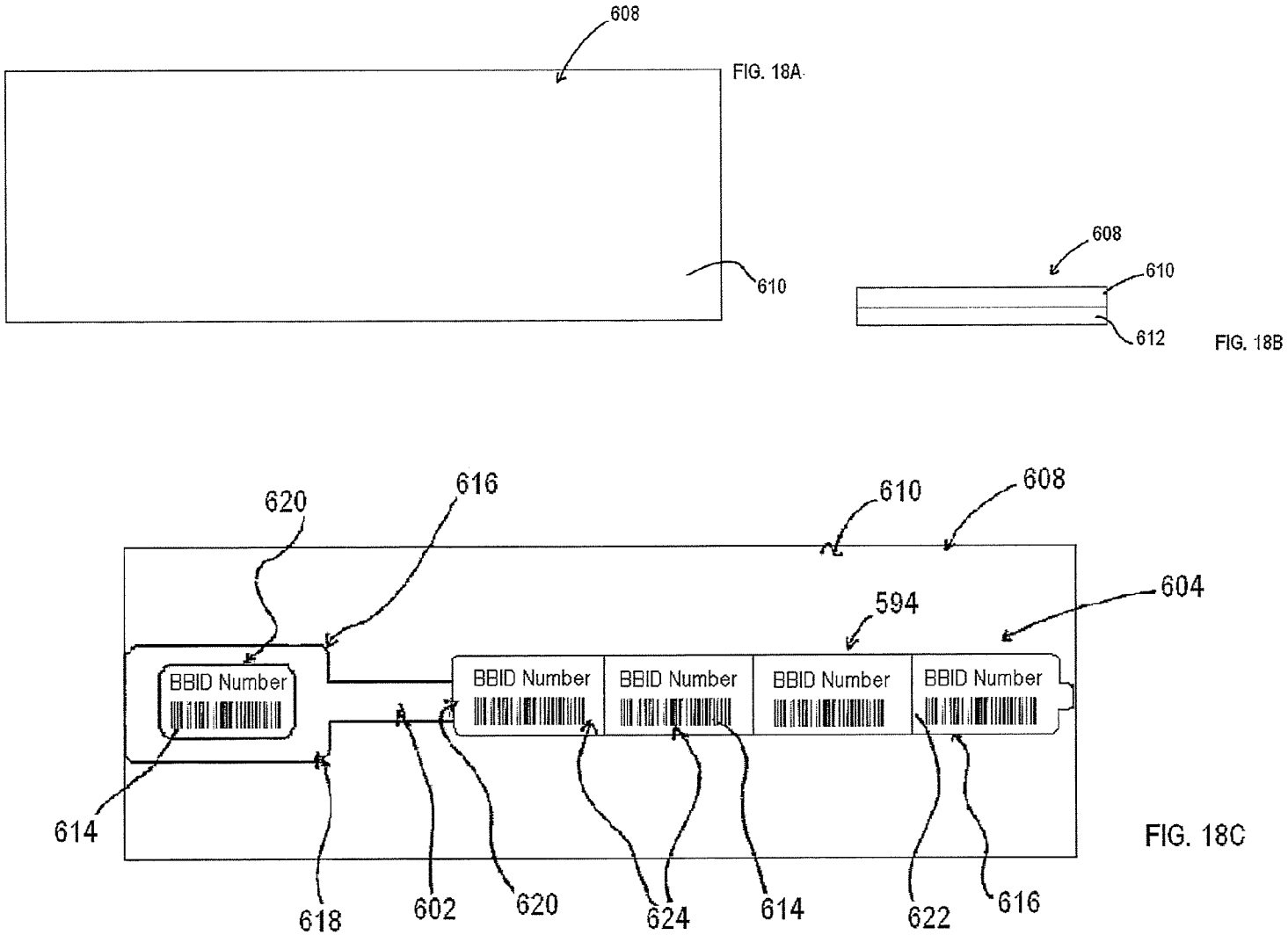
FIGS. 18A-18C illustrate manufacture of an insert piece useful with the recipient verification system of FIG. 17.

For example, the insert piece 604 can be generated from a laminate structure 608 as generally shown in FIGS. 18A and 18B. The laminate 608 can assume a variety of forms, and generally includes a face stock layer 610 and a liner layer 612. The face stock layer 610 can be formed of web-like materials (e.g., polyester, polypropylene, vinyl, Valeron®, etc.), and is printable, flexible, water-resistant, and durable. For example, the face stock layer 610 is adapted to be printed by any number of methods including, but not limited to, thermal, laser, EBI, etc. The liner layer 612 is also a web of material(s) that is printable, flexible (e.g., little stretch), water-resistant, and durable. For example, the liner layer 612 can be formed of, or includes, Tyvek®, Valeron®, vinyl, etc. Regardless, the liner layer 612 is coated with a release agent on its upper surface to facilitate removal of the face stock layer 610, and with a heat sealable material (or adhesive or equivalent) on its upper surface for later assembly.

The laminate structure 608 is then subjected to printing and die cutting operations. As shown in FIG. 18C, for example, band identification indicia 614 is printed on to the face stock layer 610 at various locations, and can assume any of the formats described above. Full thickness cuts 616 (referenced generally) are formed through a thickness of the laminate 608 to define a perimeter of the insert piece 604, and in particular the label strip 594, the tether 602, and a head 618. Partial cuts 620 (referenced generally) are formed through the face stock layer 610 in a region of the head 618 and the label strip 594 for reasons made clear below. Finally, lines of weakening (e.g., perforations) 622 are formed through the face stock layer 610 at various locations along a length of the label strip 594 to form removable labels 624 (i.e., each removable label 624 is defined by a printed segment of the face stock layer 610 that is otherwise removable from the underlying liner layer 612 apart from other ones of the removable labels 624).

Following completion of the printing and die cutting operations, the insert piece 604 is removed from a remainder of the laminate structure 608 along the full thickness cuts 616. Further, the face stock layer 610 is removed from the head 618 and the tether 602 via the partial cuts 620. Returning to FIG. 17, then, the resultant insert piece 604 includes the label strip 594, the tether 602, and the head 618. A permanent label 626 remains on the head 618 (i.e., the remaining face stock layer 610 on the head 618), and displays the same band identification indicia 614 as is otherwise displayed on the removable labels 624 that are otherwise defined along the label strip 594 and separable from one another via the lines of weakening 622. In some constructions, the label strip 594 can be formed or cut to terminate in a tab 628.

The base piece 606 can assume a variety of forms, and generally include the closure device 596, the strap 598, and the pocket 600. The closure device 596 can assume any of the forms described herein, and in some constructions include interlocking protrusions 630 that are insertable through one of a plurality of holes 632 formed along a length of the strap 598. Other configurations capable of providing irreversible attachment of the strap 598 are also contemplated.

The pocket 600 can be formed in a variety of manners, and in some constructions includes a transparent upper pocket segment 634. Regardless, the pocket 600 forms an interior region (not shown), access to which is provided via an open end 636. In some embodiments, slots 638*a*, 638*b* are formed at opposite sides of the pocket 600, respectively, and provide the system 590 with a replacement feature as described above. Alternatively, the slots 638*a*, 638*b* can be eliminated.

Figure 19A:
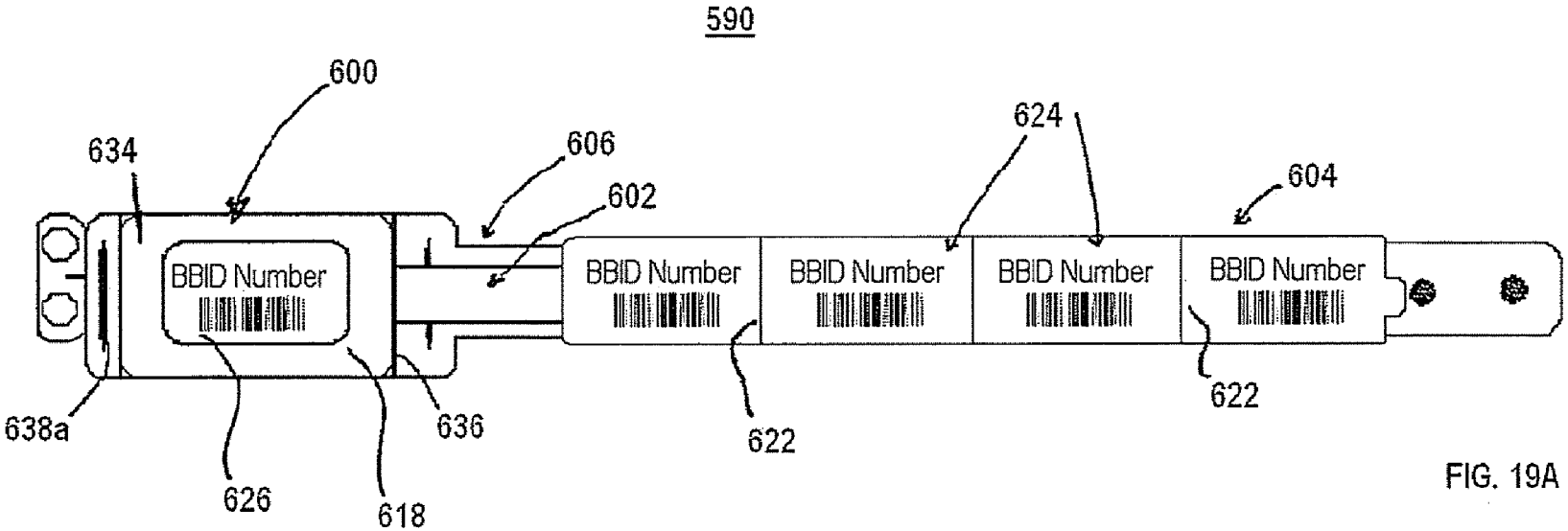
FIG. 19A is a top view of the recipient verification system of FIG. 17 upon final assembly and in a use state.

With additional reference to FIG. 19A, the recipient verification system 590 is completed by assembling the insert piece 604 to the base piece 606. The head 618 is inserted into the pocket 600, with the tether 602 extending beyond the open end 636. With embodiments in which the upper pocket segment 634 is transparent, the permanent label 626 is thus readily viewable. The head 618 is adhered to the pocket 600 (e.g., heat, adhesive, etc.), and in particular the upper pocket segment 634. In this regard, connection of the head 618 to the pocket 600 is such that the interior region of the pocket 600 remains, and is accessible via the open end 636. Further, the tether 602 is permanently captured at the pocket 600 via connection to the head 618.

Figure 19B:
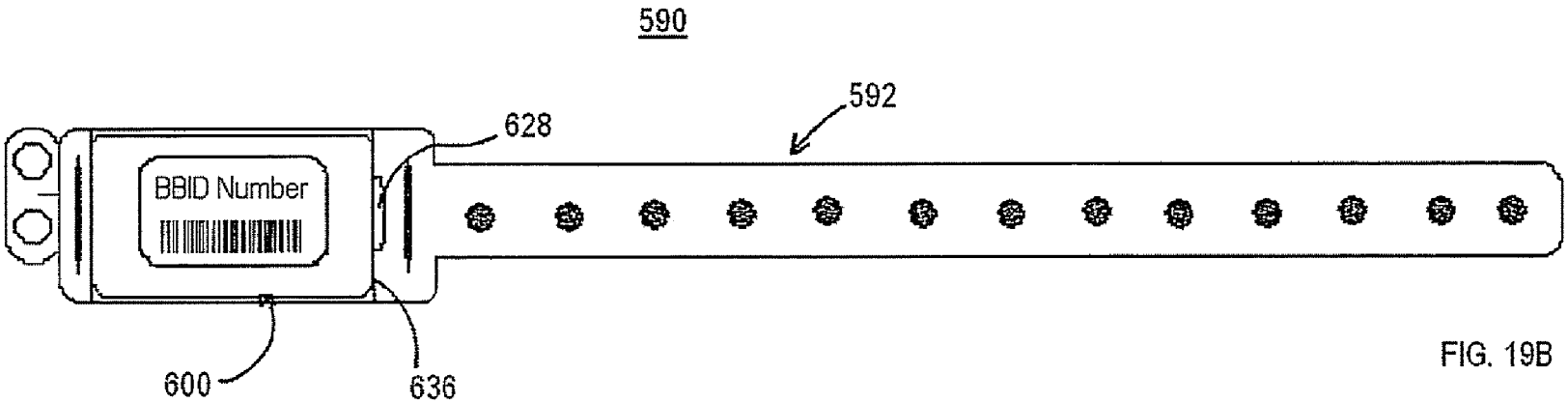
FIG. 19B is a top view of the recipient verification system of FIG. 19A in a storage state.

The recipient verification system 590 can be repeatedly transitioned between the use state of FIG. 19A in which the removable labels 624 are accessible by a user, and the storage state of FIG. 19B. More particularly, the label strip 594 is folded (e.g., along the perforations 622) onto itself and inserted into the pocket 600 via the open end 636, along with the tether 602. Where provided, the tab 628 can project beyond the open end 636 in the storage state, and provides a convenient surface for grasping and pulling the label strip 594 from the pocket 600. Regardless, the tether 602 ensures that the label strip 594, and thus the removable labels 624, are physically attached to the band 592 at all times.

Figure 20:
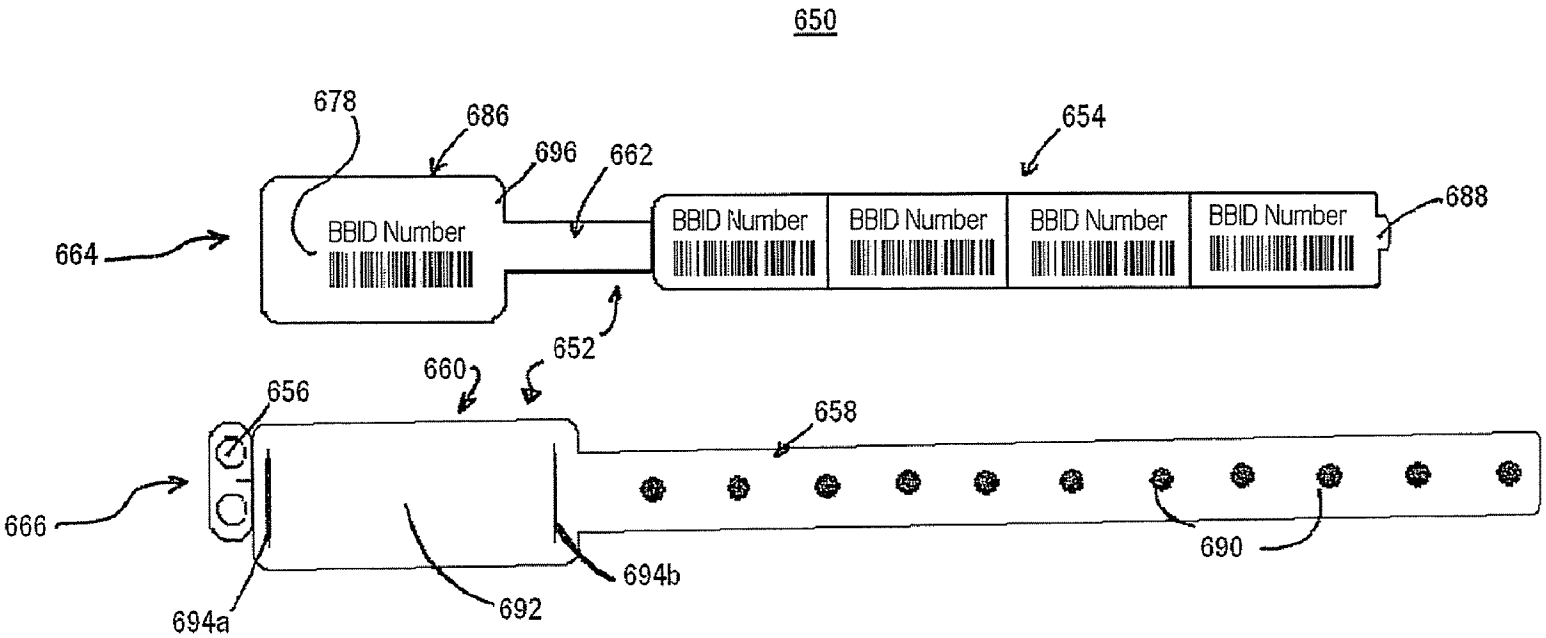
FIG. 20 is a top, exploded view of another recipient verification system in accordance with principles of the present disclosure.

Yet another embodiment recipient verification system 650 in accordance with principles of the present disclosure is shown in FIG. 20, and includes a band 652 (referenced generally) and a label strip 654. The system 650 is akin to the system 590 (FIG. 17) described above, with the band 652 including, in some embodiments, a closure device 656, a strap 658, a pocket 660 (referenced generally), and a tether 662. Further, in some constructions, the label strip 654 and the tether 662 are initially formed as an insert piece 664 that is subsequently assembled to other components of the band 652 that are otherwise initially formed as a base piece 666.

Figure 21B:
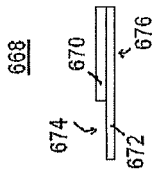
FIGS. 21A-21C illustrate manufacture of an insert piece useful with the recipient verification system of FIG. 20.
Figure 21A:
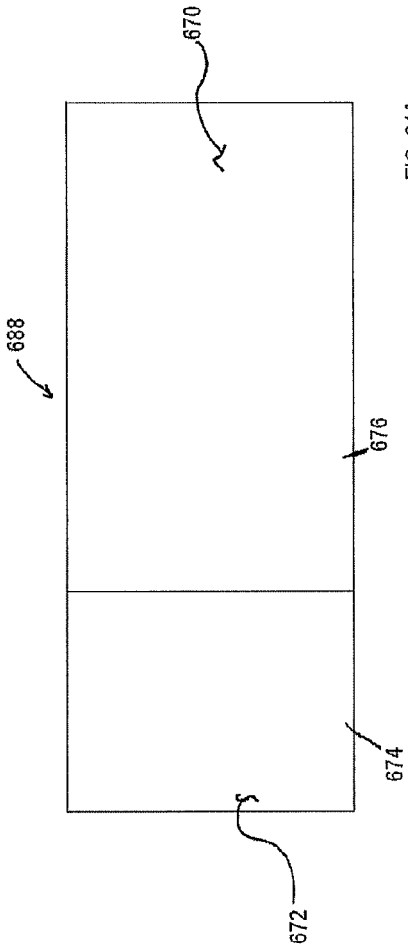

The insert piece 664 can formed from a laminate structure 668 as shown in FIGS. 21A and 21B. The laminate structure 668 includes a face stock layer 670 and a liner layer 672 as described above with respect to the face stock layer 610 and the liner layer 612 (FIGS. 18A and 18B). With the construction of FIGS. 21A and 21B, however, the laminate structure 668 is formed as a variable laminate, defined by first and second regions 674, 676. The liner layer 672 is continuous across the first and second regions 674, 676, whereas the face stock layer 670 is provided only at the second region 676. Thus, the first region 674 includes the liner layer 672 as a flexible, printable, water-resistant, and durable material with a heat sealable, heat activated, or equivalent coating on a bottom side thereof. The second region 676 includes the liner layer 672, as well as a release layer (not shown), an adhesive layer (not shown) and the face stock layer 670.

Figure 21C:
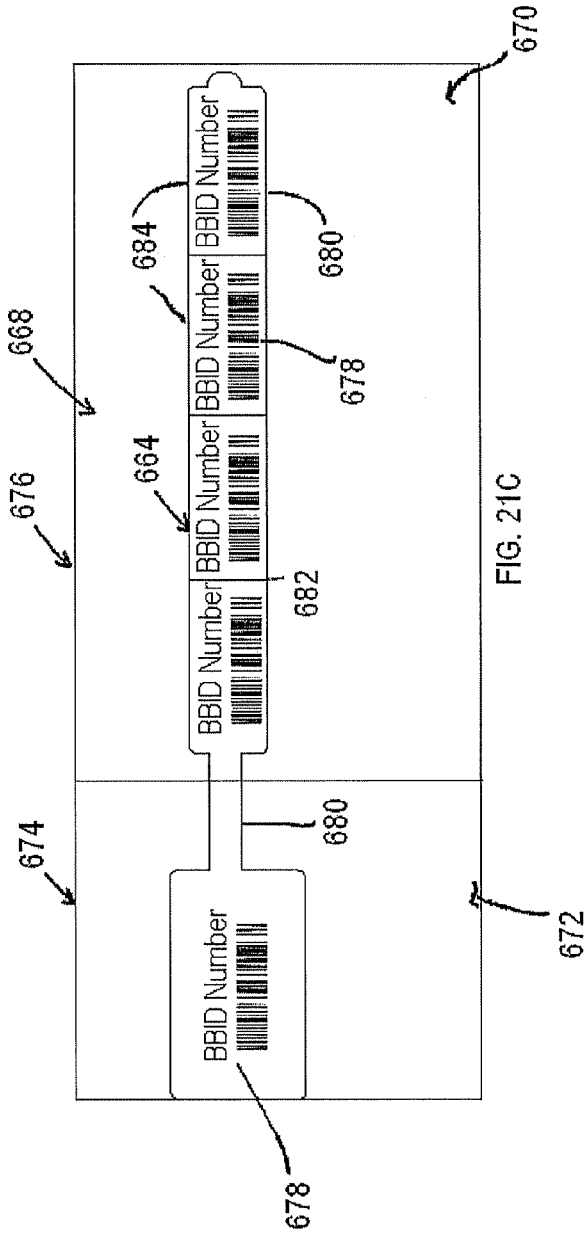

The laminate structure 668 is subjected to printing and die cutting operations, as represented in FIG. 21C. For example, band identification indicia 678 as described above is printed onto the liner layer 672 in the first region 674, as well as onto the face stock layer 670 at various locations along the second region 676 as shown. Full thickness cuts 680 (referenced generally) are formed through an entire thickness of the laminate 668 in the first and second region 674, 676, thereby defining a perimeter of the insert piece 664. Lines of weakening (e.g., perforations) 682 are formed through the face stock layer 670 to define a plurality of removable labels 684, each displaying the band identification indicia 678 (i.e., each removable label 684 is defined by a printed segment of the face stock layer 670 that is otherwise removable from the underlying liner layer 672 apart from other ones of the removable labels 684).

Following completion of the printing and die cutting operations, the insert piece 664 is removed from a remainder of the laminate structure 668 via the full thickness cuts 680. Returning to FIG. 20, then, the insert piece 664 includes the label strip 654, the tether 662, and a head 686 at which the band identification indicia 678 is displayed. An optional tab 688 can also be formed.

The base piece 666 can assume any of the forms described above with respect to the base piece 606 (FIG. 17), and can include one or more holes 690 along a length of the strap 658 for engagement with the closure device 656. In some constructions, the base piece 666 does not form, in and of itself, the completed pocket 660. Instead, a lower pocket segment 692 is defined that combines with the insert piece 664 to form the pocket 660 upon final assembly as described below. The base piece 666 can optionally further include opposing slots 694*a*, 694*b* that provide a replacement feature as described above.

Construction of the recipient verification system 650 is completed by joining the insert piece 664 and the base piece 666. With embodiments in which the base piece 666 does not provide a completed pocket, the head 686 of the insert piece 664 is disposed over the lower pocket segment 692 of the base piece 666, and the components 686, 692 adhered to one another (e.g., adhesive activation, RF welding, heat sealing, etc.). In this regard, a perimeter of the head 686 is bonded to the lower pocket segment 692 at various locations (e.g., opposing sides), but is not bonded at a leading end 696 thereof. The head 686 thus serves as an upper pocket segment, combining with the lower pocket segment 692 to form the completed pocket 660. An interior region of the so-defined pocket 660 is accessible via an opening defined between the head 686 and the lower pocket segment 692 at the leading end 686.

Figure 22A:
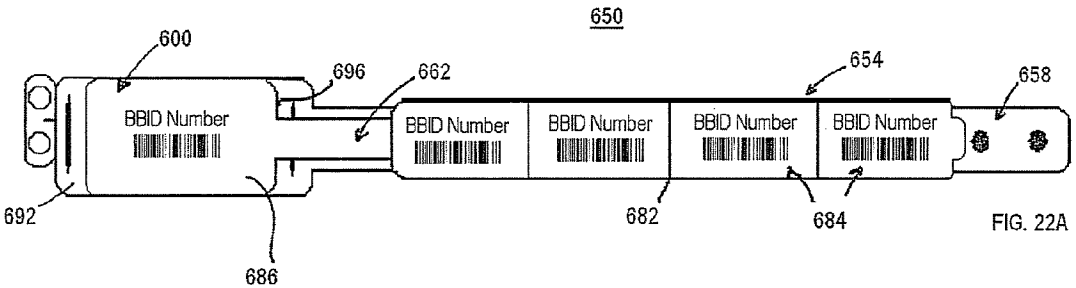
FIG. 22A is a top view of the recipient verification system of FIG. 20 upon final assembly and in a use state.
Figure 22B:
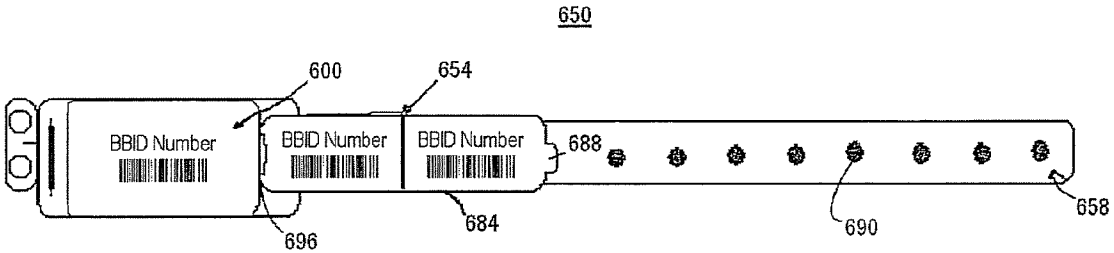
FIG. 22B is a top view of the recipient verification system of FIG. 22A in a storage state.

In the use state of FIG. 22A, the label strip 654 is removed from the interior region of the pocket 660, with the removable labels 684 available to a user. The recipient verification system 650 can be repeatedly transitioned between the use state and a storage state (partially reflected in FIG. 22B) by folding the label strip 654 onto itself (e.g., at the lines of weakening 682), and then inserting the folded label strip 654 and the tether 662 into the pocket 660 via the open end 696. Regardless, the label strip 654, and thus the removable labels 684, are permanently attached to the band 652 via the tether 662.

Figure 23:
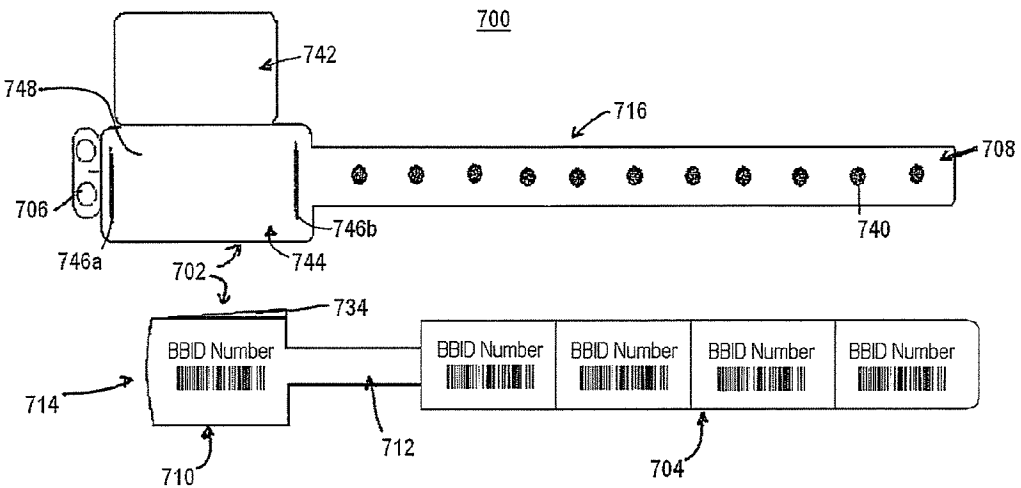
FIG. 23 is a top, exploded view of another recipient verification system in accordance with principles of the present disclosure.

Another embodiment of a recipient verification system 700 in accordance with the present disclosure is shown in FIG. 23 and includes a band 702 (referenced generally) and a label strip 704. As with previous embodiments, the band 702 includes a closure device 706, a strap 708, a pocket 710 (referenced generally), and a tether 712. The label strip 704 and the tether 712 are initially formed as an insert piece 714 that is assembled to a base piece 716 in completing the recipient verification system 700.

Figure 24A:
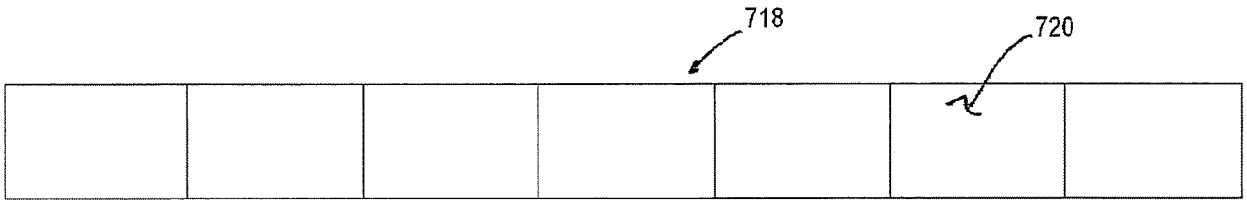
FIGS. 24A-24C illustrate manufacture of an insert piece useful with the recipient verification system of FIG. 23.
Figure 24B:
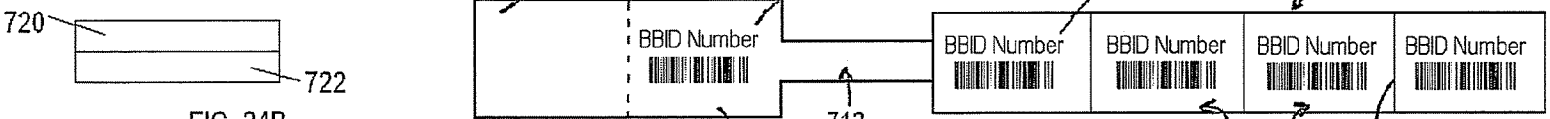

The insert piece 714 can be formed from a laminate structure 718 as shown in FIGS. 24A and 24B. The laminate structure 718 includes a face stock layer 720 and a liner layer 722. The face stock layer 720 can assume any other forms described above, and is generally formed to be printable, flexible, water-resistant, and durable. An adhesive backing (not shown) retains the face stock layer 720 onto the liner layer 722. The liner layer 722 can assume any of the forms previously described, and in general is flexible, water-resistant, and durable.

Figure 24C:
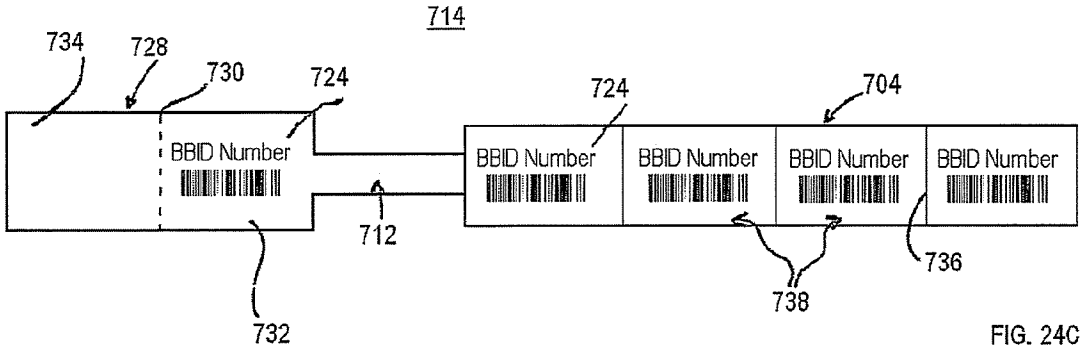

The laminate structure 718 is subjected to printing and die cutting operations, as reflected in the resultant insert piece 714 of FIG. 24C. For example, band identification indicia 724 as described above is printed to the face stock layer 720 (FIG. 24B) at various locations as shown. Full thickness cuts are formed through a thickness of the laminate 718 (FIGS. 24A, 24B) to define a perimeter of the insert piece 714 in forming the label strip 704 the tether 712, and a head 728. A line of weakening 730 is formed in the head 728 to define a permanent label segment 732 and a backing segment 734. As described below, the backing segment 734 is foldable relative to the permanent label segment 732 via the line of weakening 730, with the permanent label segment 732 displaying the band identification indicia 724. Additional lines of weakening (e.g., perforations) 736 are formed through the face stock layer 720 along the label strip 704 to provide a plurality of removable labels 738, each displaying the band identification indicia 724 (i.e., each removable label 738 is defined by a printed segment of the face stock layer 720 that is otherwise removable from the underlying liner layer 722 apart from other ones of the removable labels 738).

Returning to FIG. 23, the base piece 726 can assume any of the forms described above with respect to the base piece 606 (FIG. 17), and can include one or more holes 740 along a length of the strap 708 for engagement with the closure device 706 as previously explained. In general terms, the base piece 716 can be formed of a clear, flexible, water-resistant, and durable material. The base piece 716 further includes upper and lower entrapment (or shield) segments 742, 744 that facilitate final assembly of the recipient verification system 700. The base piece 716 can optionally further include opposing slots 746*a*, 746*b* in the lower entrapment segment 744 that provide a replacement feature as described above.

Figure 25A:
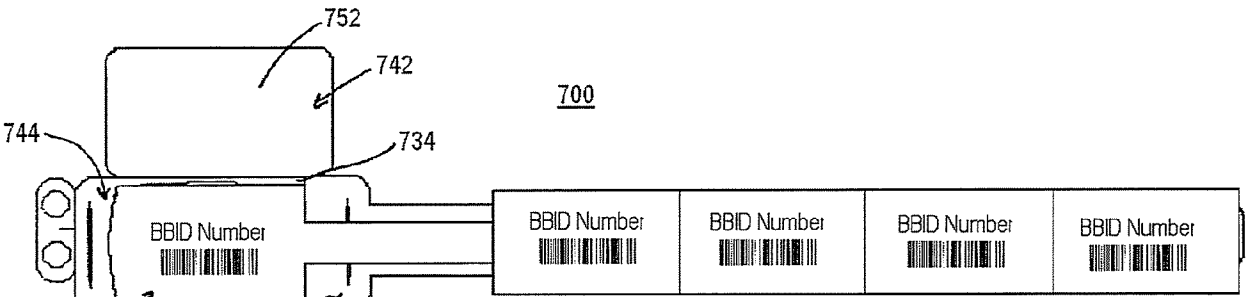
FIGS. 25A-25C illustrate assembly of the recipient verification system of FIG. 23.
Figure 25B:
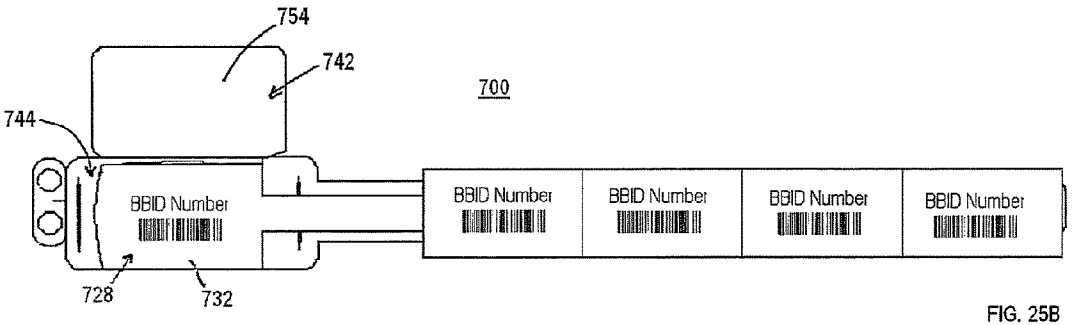
Figure 25C:
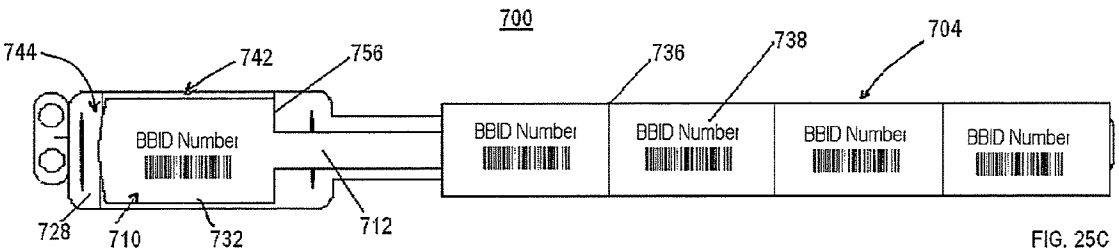

Construction of the recipient verification system 700 initially entails folding the backing segment 734 "behind" the permanent label segment 732 as reflected in FIG. 23. The folded head 728 is then joined to the base piece 716. For example, in some constructions, the lower entrapment segment 744 provides an adhesive surface (hidden in FIG. 23) initially covered by a liner 748. The liner 748 is removed, and the backing segment 734 attached to the exposed adhesive surface 750 as shown in FIG. 25A. The upper entrapment segment 742 is similarly attached to the permanent label segment 732. For example, the upper entrapment segment 742 can include an adhesive surface (hidden in FIG. 25A) that is initially covered by a liner 752. With this one acceptable approach, the liner 752 is removed, thereby exposing the adhesive surface 754 as shown in FIG. 25B. The upper entrapment segment 742 is then folded downwardly (relative to the orientation of FIG. 25B), to the exposed adhesive surface 754 bonding with the permanent label segment 732 (and optionally with the lower entrapment segment 744 outside a perimeter of the head 728) as shown in FIG. 25C. The resulting pocket 710 is thus defined between the permanent label segment 732 and the backing segment 734 (hidden in FIG. 25C, but shown, for example, in FIGS. 23 and 24C). Alternatively, the pocket 710 can be described as being formed by, or partially by, the upper and lower entrapment segments 742, 744. Regardless, an interior region of the so-defined pocket 710 is accessible via an opening at a leading end 756 thereof (e.g., the head 728 is positioned such that the permanent label segment 732 is aligned with or slightly beyond an edge of the exposed adhesive surface 754 (FIG. 25B) of the upper entrapment segment 744 to permit access to a spacing between the label and backing segments 732, 734).

In the use state of FIG. 25C, the label strip 704 is removed from the interior region of the pocket 710, with the removable labels 738 available to a user. The recipient verification system 700 can be repeatedly transitioned between the use state and a storage state (not shown) by folding the label strip 704 onto itself (e.g., at the lines of weakening 736), and then inserting the folded label strip 704 and the tether 712 partially or entirely into the pocket 710 via the open leading end 756. Regardless, the label strip 704, and thus the removable labels 738, are permanently attached to the band 702 via the tether 712.

Figure 26:
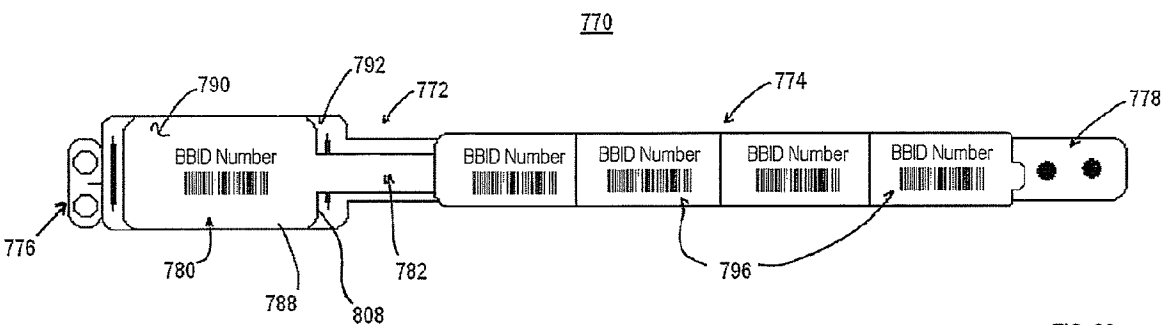
FIG. 26 is a top view of another recipient verification system in accordance with principles of the present disclosure.

Another embodiment of a recipient verification system 770 in accordance with the present disclosure is shown in FIG. 26, and includes a band 772 and a label strip 774. The system 770 is akin to previous embodiments described above, with the band 772 including, in some embodiments, a closure device 776, a strap 778, a pocket 780, and a tether 782. With the construction of FIG. 26, however, the system 770 is entirely formed from an integral laminate structure.

Figure 27A:
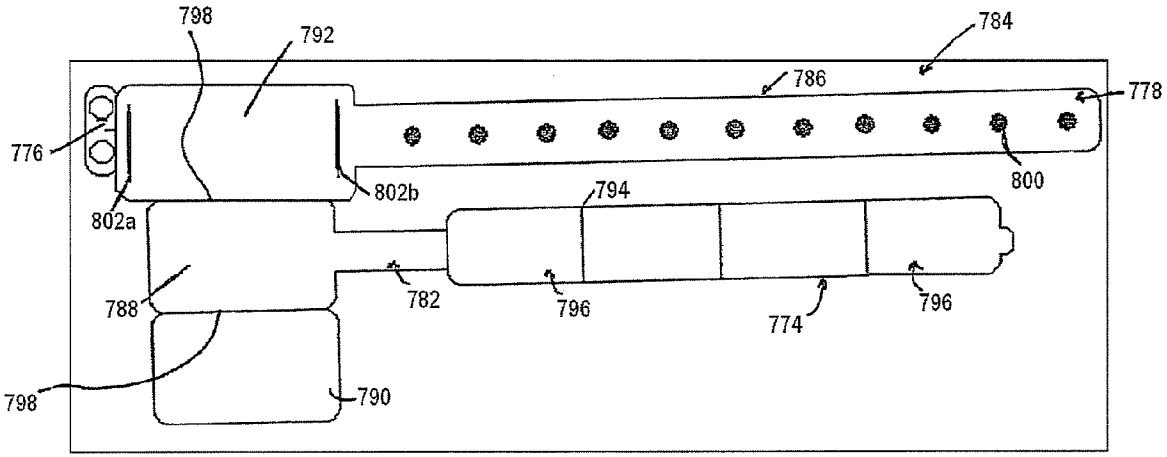
FIGS. 27A-27D illustrate assembly of the recipient verification system of FIG. 26.

In particular, FIG. 27A illustrates a variable laminate structure 784 consisting of various materials as described below, and subjected to a die cutting operation including full thickness cuts 786 (referenced generally) formed through an entire thickness thereof. The full thickness cuts 786 demarcate the laminate structure 784 to define the label strip 774, the closure device 776, the strap 778, and the tether 782. In addition, the full thickness cuts 786 form the perimeters of a head 788, an upper shield segment 790, and a lower pocket segment 792. In general terms, the laminate structure 784 includes at least one layer made from a printable, flexible, at least water-resistant, durable, and opaque material. The lower pocket segment 792 is backed with a permanent adhesive, while the strap 778, the head 788, and the upper shield segment 790 are free from adhesive. The label strip 774 includes a face stock layer backed with a pressure sensitive adhesive that in turn is encompassed by a release liner. Lines of weakening (e.g., perforations) 794 are formed through the face stock layer along the label strip 774 to define a plurality of removable labels 796. Optionally, fold lines 798 can be imparted into the laminate structure 784 at an intersection between the head 788 and the upper shield segment 790, as well as between the head 788 and the lower pocket segment 792. Optionally, holes 800 are formed along the strap 778 for interfacing with the closure device 776 as with previous embodiments, as are slots 802*a*, 802*b* along the lower pocket segment 792 to serve as a replacement feature as described above.

Figure 27B:
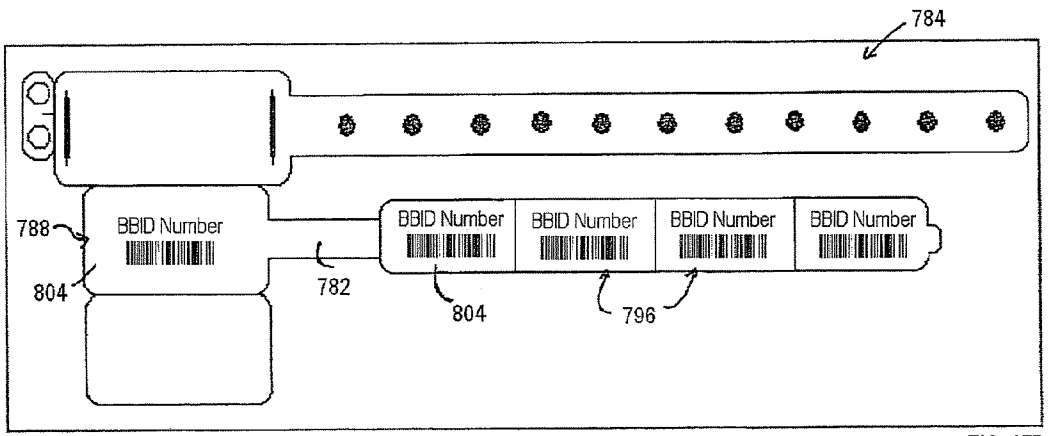
Figure 27C:
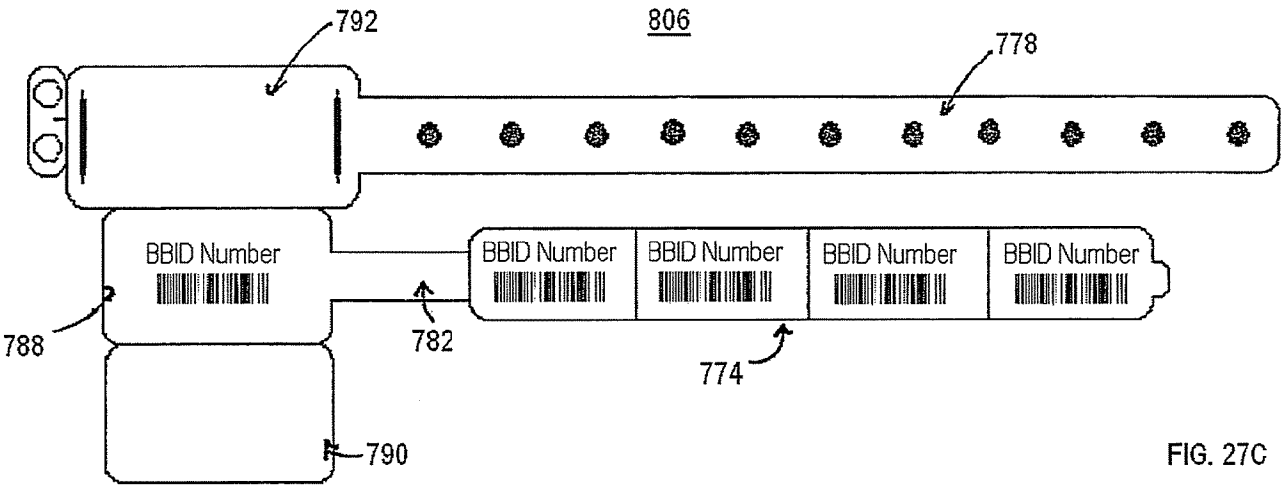

In addition to the die cutting operations above, the laminate 784 is subjected to a printing operation. For example, band identification indicia 804 as described above is printed onto the head 788 and the removable labels 796 as shown in FIG. 27B. As point of reference, while the die cutting operation has been described as being performed prior to the printing operation, a reverse sequencing is also contemplated. Regardless, a printed piece 806 is formed, and then removed from the remainder of the laminate structure 784 via the full thickness cuts 786 as shown in FIG. 27C.

Figure 27D:
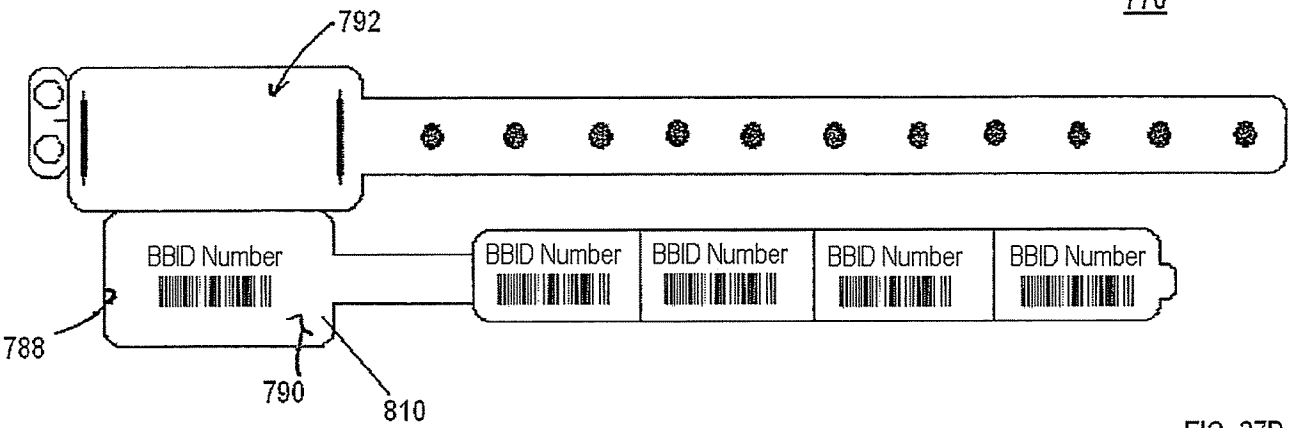

With additional reference to FIG. 27D, further assembly of the recipient verification system 770 includes folding the upper shield segment 790 onto the head 788, thereby encompassing the band identification indicia 804 otherwise printed onto the head 788 (thus serving as a permanent label). The lower shield segment 792 is folded behind the head 788 (relative to the orientation of FIG. 27D), and then bonded along at least a portion of the perimeter of the head 788, resulting in the completed recipient verification system 770 of FIG. 26. The pocket 780 is thus defined between the lower pocket segment 792 and the head 788/upper pocket segment 790. An interior region of the so-defined pocket 780 is accessible via an opening defined between the head 788 and the lower pocket segment 792 at a leading end 808. More particularly, at least a leading edge 810 (FIG. 27D) of the head 788 is not bonded to the lower pocket segment 792, nor is any area of the upper shield segment 790 that might otherwise extend beyond the leading edge 810. Thus, at the leading end 808 of the pocket 280, an unbonded spacing exists, and is exteriorly accessible, between the head 788/upper shield segment 790 and the lower pocket segment 792.

In the use state of FIG. 26, the label strip 774 is removed from the interior region of the pocket 780 with the removable labels 796 available to a user. The recipient verification system 770 can be repeatedly transitioned between the use state and a storage state (not shown) by folding the label strip 774 onto itself (e.g., at the lines of weakening 794), and then inserting the folded label strip 774 and the tether 782 into the pocket 780 via the open leading end 808. Regardless, the label strip 774, and thus the removable labels 796, are permanently attached to the band 772 via the tether 782.

Figure 28:
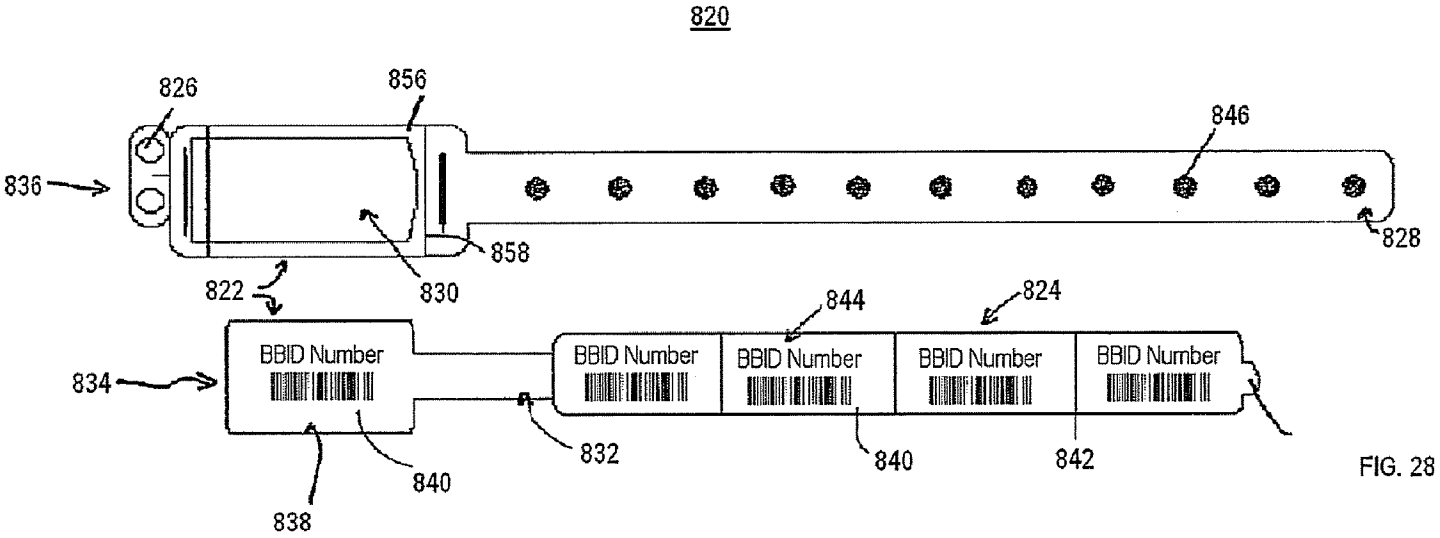
FIG. 28 is a top, exploded view of another recipient verification system in accordance with principles of the present disclosure.

Another embodiment of a recipient verification system 820 in accordance with the present disclosure is shown in FIG. 28, and includes a band 822 (referenced generally) and a label strip 824. The system 820 is akin to the system 650 (FIG. 20) described above, with the band 822 including, in some embodiments, a closure device 826, a strap 828, a pocket 830, and a tether 832. Further, in some constructions, the label strip 824 and the tether 832 are initially formed as an insert piece 834 that is subsequently assembled to other components of the band 822 that are otherwise initially formed as a base piece 836.

The insert piece 834 can be formed in a variety of manners, for example via a laminate structure subjected to die cutting and printing operations as described above with respect to the insert piece 664 (FIG. 20). Regardless, the resultant insert piece 834 includes the label strip 824, the tether 832, and a head 838. Band identification indicia 840 as described above is printed onto the head 838, as well as onto various locations along a length of the label strip 824. Lines of weakening (e.g., perforations 842) are formed through a face stock layer of the label strip 824 to define a plurality of removable labels 844, each displaying the band identification indicia 840 (i.e., each removable label 844 is defined by a printed segment of the face stock layer that is otherwise removable from an underlying liner layer apart from other ones of the removable labels 844).

Figure 29:
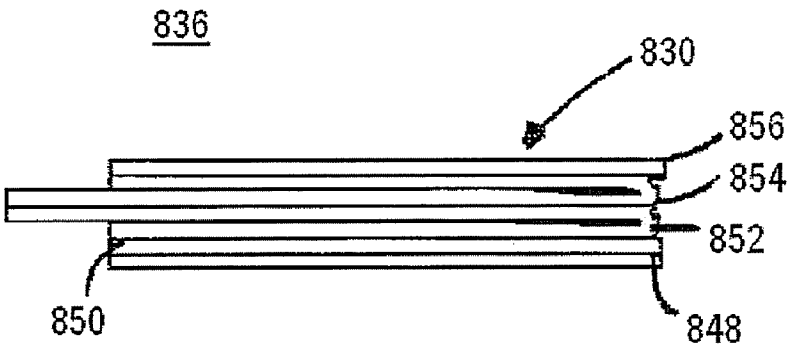
FIG. 29 is a side view of a pocket portion of the recipient verification system of FIG. 28.

The base piece 836 includes the closure device 826 and the strap 828 in a manner akin to previous embodiments, with the strap 828 optionally forming holes 846 for selective interface with the closure device 826. Unlike some previous configurations, the pocket 830 is completely formed by the base piece 836, and can incorporate a number of different layers. For example, as shown in FIG. 29, the pocket 830 includes a lower pocket segment 848, an upper pocket segment 850, first and second release liners 852, 854, and an upper shield segment 856. The lower pocket segment 848 can be contiguously formed with the strap 828 (FIG. 28), and is bonded to the upper pocket segment 850 along a position of a perimeter thereof. With this construction, an interior region of the pocket 830 is defined between the lower and upper pocket systems 848, 850. An upper surface of the upper pocket segment 850 (i.e., opposite the lower pocket segment 848) is coated with an adhesive, with the first release liner 852 initially covering the so-applied adhesive and folded back onto itself as shown. An inner surface of the upper shield segment 856 is similarly coated with an adhesive that is covered by the second release liner 854, that again is folded back onto itself. The release liners 852, 854 are freely movable relative to one another.

Figure 30A:
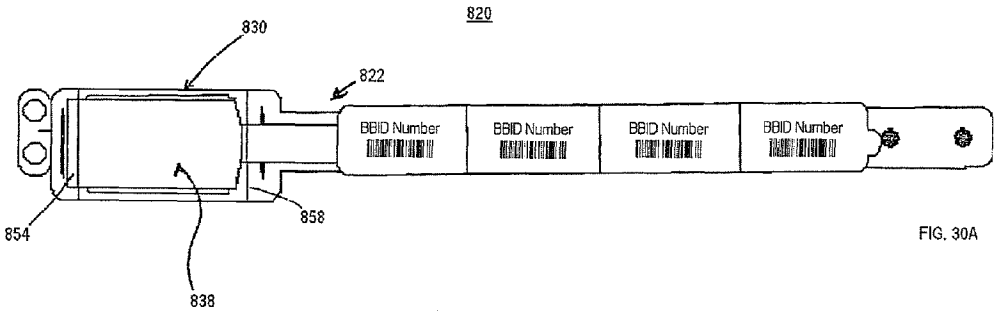
FIG. 30A illustrates assembly of the recipient verification system of FIG. 28.

With reference to FIGS. 28 and 29, construction of the recipient verification system 820 includes insertion of the head 838 into the pocket 830, and in particular between the first and second release liners 852, 854 as generally reflected in FIG. 30A (it being understood that the second release liner 854 is visible in FIG. 30A, whereas the first release liner 852 is hidden). The release liners 852, 854 are then pulled from the band 822, thereby exposing the adhesive surfaces associated with the upper pocket segment 850 and the upper shield segment 856. The head 838 is thus encapsulated between the segments 850, 856 apart from the pocket interior region. Upon final construction, and as shown in FIG. 30B, an interior region of the pocket 830 can be accessed via an opening formed at a leading end 858 of the upper pocket segment 850 (FIG. 29).

Figure 30B:
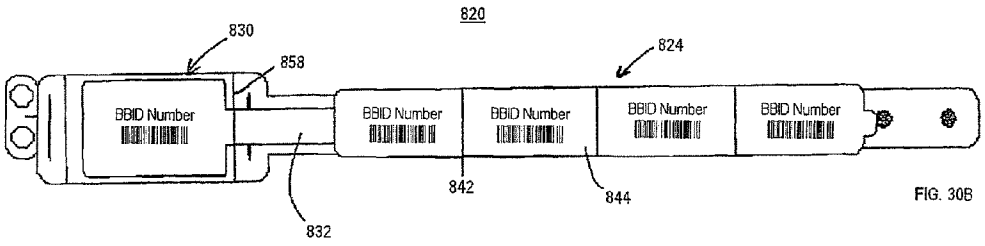
FIG. 30B is a top view of the recipient verification system of FIG. 29 upon final assembly and in a use state.

In the use state of FIG. 30B, the label strip 824 is removed from the interior region of the pocket 830, with the removable labels 844 available to a user. The recipient verification system 820 can be repeatedly transitioned between the use state and a storage state (not shown) by folding the label strip 824 onto itself (e.g., at the lines of weakening 842), and then inserting the folded label strip 824 and the tether 832 into the pocket 830 via the open end 858. Regardless, the label strip 824, and thus the removable labels 844, are permanently attached to the band 822 via the tether 832.

Figure 31A:
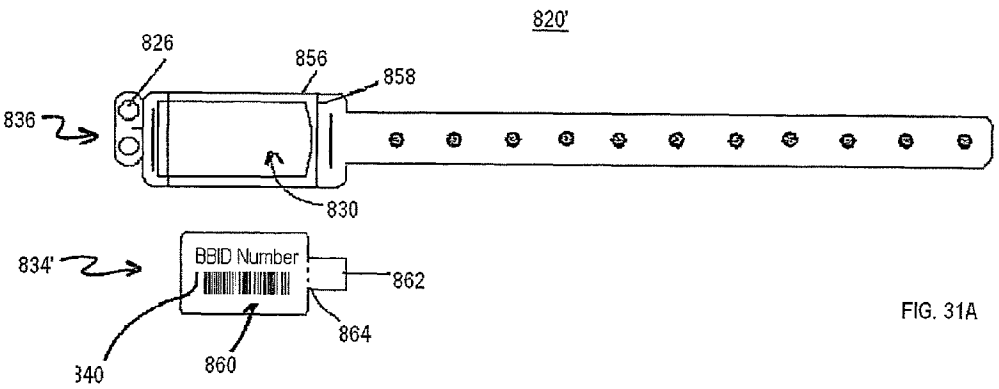
FIG. 31A is a top, exploded view of another recipient verification system in accordance with principles of the present disclosure.

While the recipient verification system 820 has been described as the insert piece 834 (FIG. 28) including the label strip 824 and the tether 832, other constructions are contemplated. For example, a related embodiment patient verification system 820' is shown in FIG. 31A, and includes the base piece 836 as described above and an alternative insert piece 834'. The insert piece 834' can be a laminate structure, and includes a head 860 and an optional tab 862. The insert piece 834' can incorporate various types of information, such as the band identification indicia 840 as shown. Alternatively, and/or in addition, other information and/or other formats (e.g., patient information, handwritten insert card, RFID tag, etc.) can be provided on or with the head 860. Regardless, the tab 862, where provided, can be separable from the head 860 via a line of weakening (e.g., perforations) 864. The tab 862 can serve as a grasping surface for assembly of the insert piece 834'. Alternatively, the tab 862 can display various information as desired, facilitating use of the tab 862 as a separate label (e.g., specimen tube label).

Figure 31B:
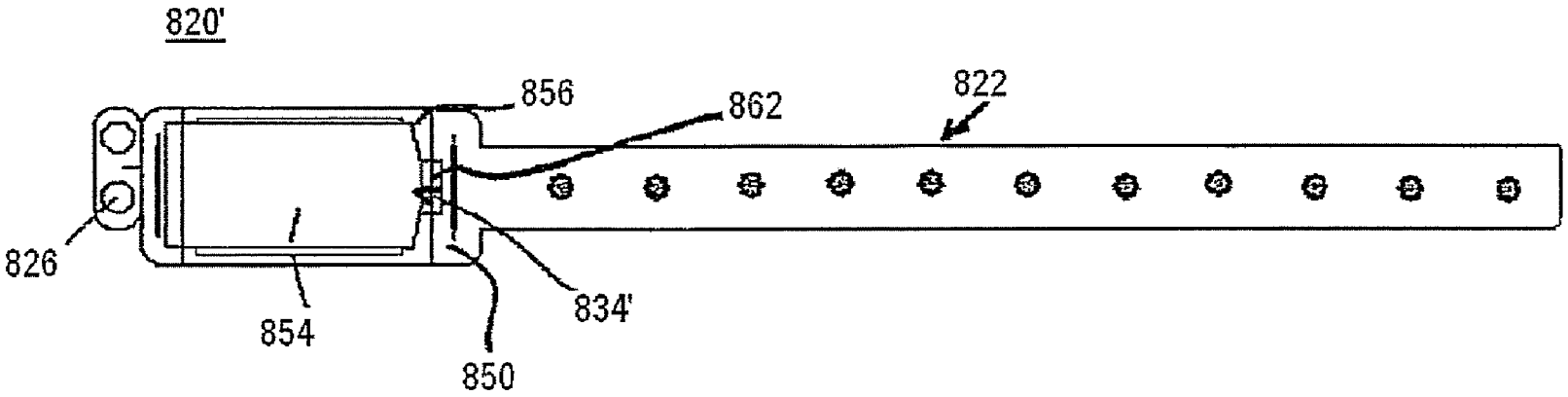
FIG. 31B illustrates assembly of the recipient verification system of FIG. 31A.
Figure 31C:
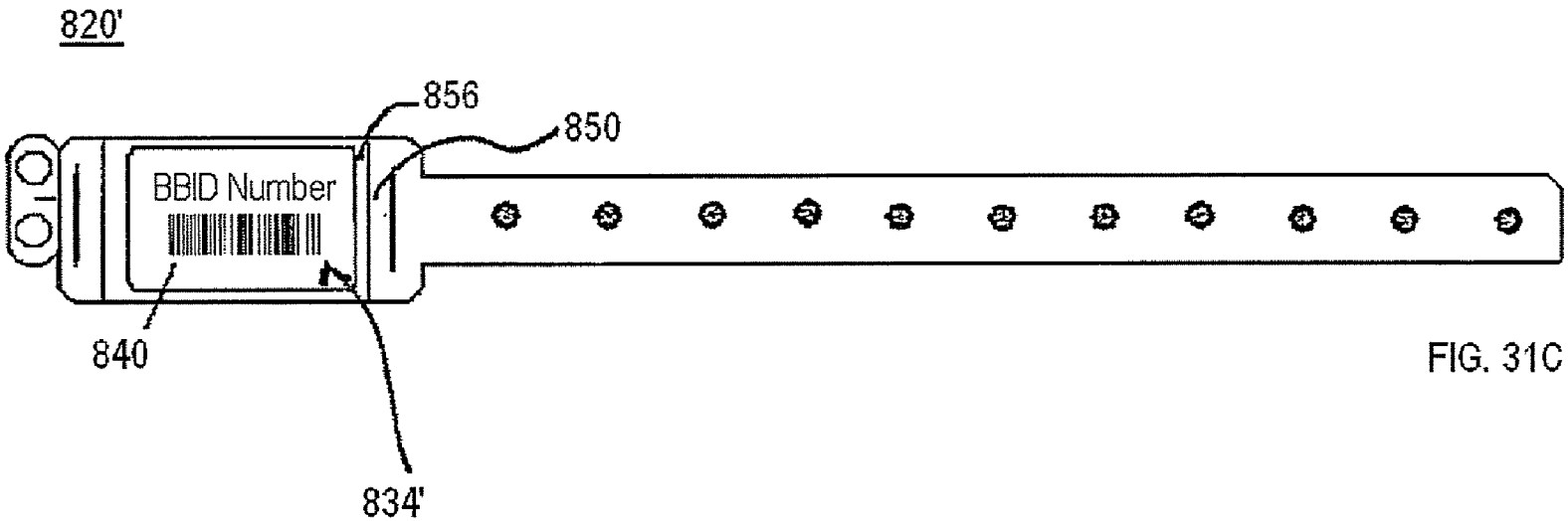
FIG. 31C is a top view of the recipient verification system of FIG. 31A upon final assembly.

Assembly of the recipient verification system 820' is shown in FIGS. 31B and 31C, and initially includes insertion of the insert piece 834' between the release liners 852, 854 (FIG. 29) as described above. As shown in FIG. 31B, then, the second release liner 854 is disposed between the insert piece 834' and the upper shield segment 856. The first release liner 852 (hidden in FIG. 31B) is disposed between the insert piece 834' and the upper pocket segment 850. The release liners 852, 854 are then removed as described above (e.g., pulling the release liners 852, 854 from the band 822), resulting in the assembled state of FIG. 31C. More particularly, with removal of the release liners 852, 854, the upper shield segment 856 and the upper pocket segment 850 bond to the insert piece 834'. Where provided, the optional tab 862 (FIG. 31B) can be removed from the head 860 via the line of weakening 864 (FIG. 31A).

Figure 32:
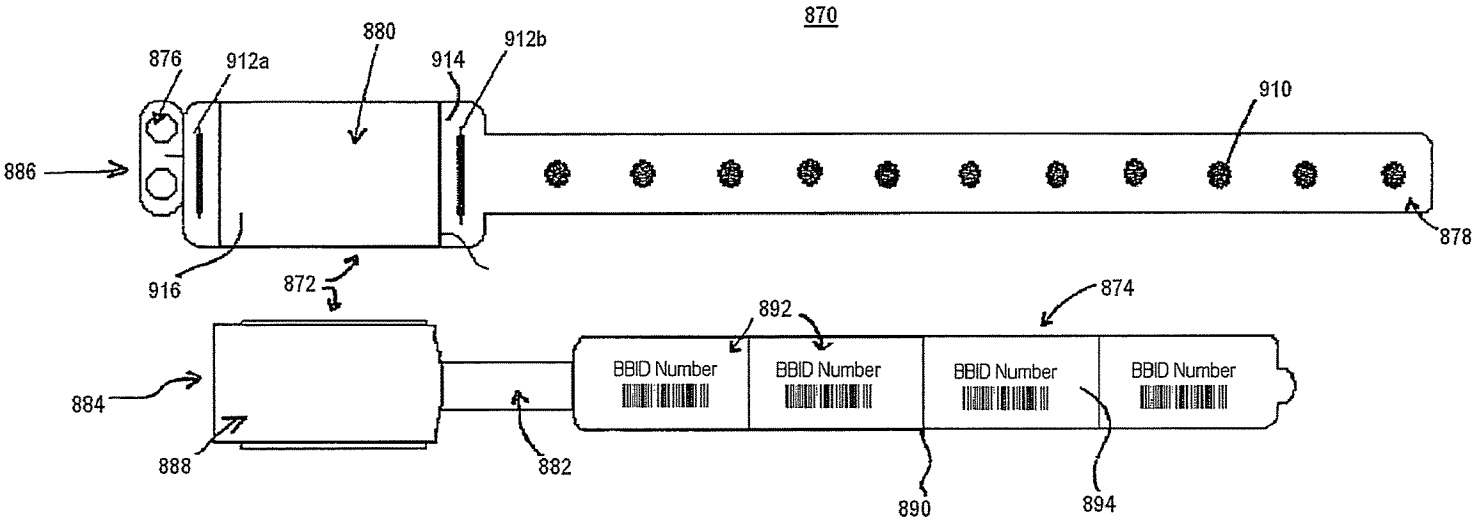
FIG. 32 is a top, exploded view of another recipient verification system in accordance with principles of the present disclosure.

Another embodiment of a recipient verification system 870 in accordance with the present disclosure is shown in FIG. 32 and includes a band 872 (referenced generally) and a label strip 874. The system 870 is akin to the system 820 (FIG. 28) described above, with the band 872 including, in some embodiments, a closure device 876, a strap 878, a pocket 880, and a tether 882. The label strip 874 and the tether 882 are initially formed as an insert piece 884 that is subsequently assembled to other components of the band 872 that are otherwise initially formed as a base piece 886.

In general terms, the insert piece 884 can be akin to the insert piece 664 (FIG. 20) described above, generally formed by a variable laminate structure subjected to die cutting and printing operations. The resultant insert piece 884 includes the label strip 874, the tether 882, and a head assembly 888. Lines of weakening (e.g., perforations 890) are formed through a portion of a thickness of the label strip 874 (e.g., through a face stock layer) to define a plurality of removable labels 892. Band identification indicia 894 as described above is printed onto each of the removable labels 892.

Figure 33:
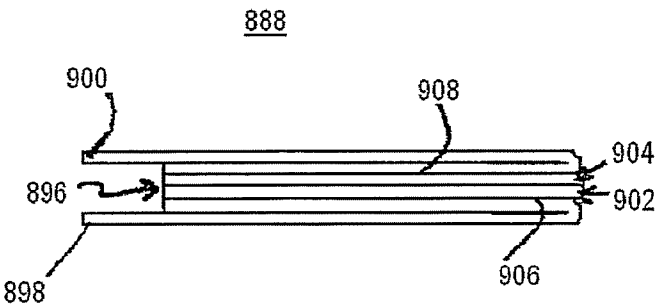
FIG. 33 is a side view of a portion of an insert piece useful with the recipient verification system of FIG. 32.

The head assembly 888 is shown in greater detail in FIG. 33, and includes (prior to final completion of the system 870) a support structure 896, and first and second release liners 898, 900. The support structure 896 is shown in FIG. 33 as consisting of first and second layers 902, 904. The first layer 902 can be a face stock layer, whereas the second layer 904 is a liner layer such that the support structure 896 contiguously forms the label strip 874 and the tether 882 as with some previous embodiments. Alternatively, the support structure 896 can include three or more layers, or can be a single layer. Regardless, a first outer surface 906 of the support structure 896 (e.g., an outer surface of the first layer 902) is coated with an adhesive that in turn is covered by the first release liner 898. A second outer surface 908 of the support structure 896 (e.g., an outer surface of the second layer 904) is similarly coated with an adhesive that is covered by the second release liner 900. The release liners 898, 900 are folded back onto themselves as shown.

Returning to FIG. 32, the base piece 886 can be identical to the base piece 836 (FIG. 28) described above, and thus includes holes 910 along the strap 878, as well as optional slots 912*a*, 912*b* at opposite sides of the pocket 880 that serve as a replacement feature as previously explained. Regardless, the pocket 880 includes a lower pocket segment 914, an upper pocket segment (hidden), and an upper shield segment 916 (referenced generally). An interior region of the pocket 880 is defined between the lower pocket segment 914 and the upper pocket segment, similar to the arrangement of the pocket segments 848, 850 previously described with respect to FIG. 29. Unlike the construction of FIG. 29, however, the upper pocket segment and the upper shield segment 916 of FIG. 32 are not coated with an adhesive.

Figure 34A:
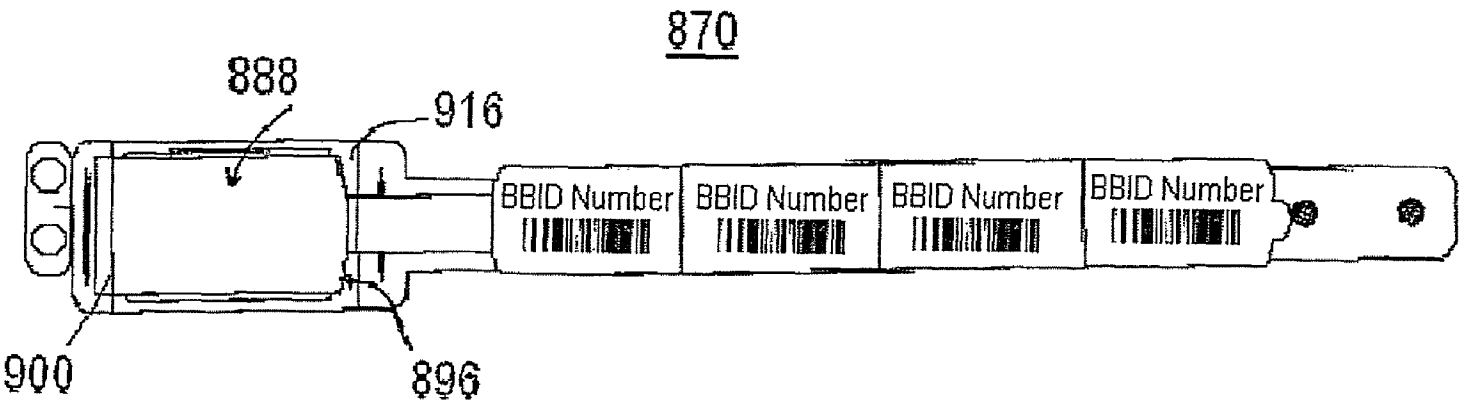
FIG. 34A is a top view illustrating assembly of the recipient verification system of FIG. 32.
Figure 34B:
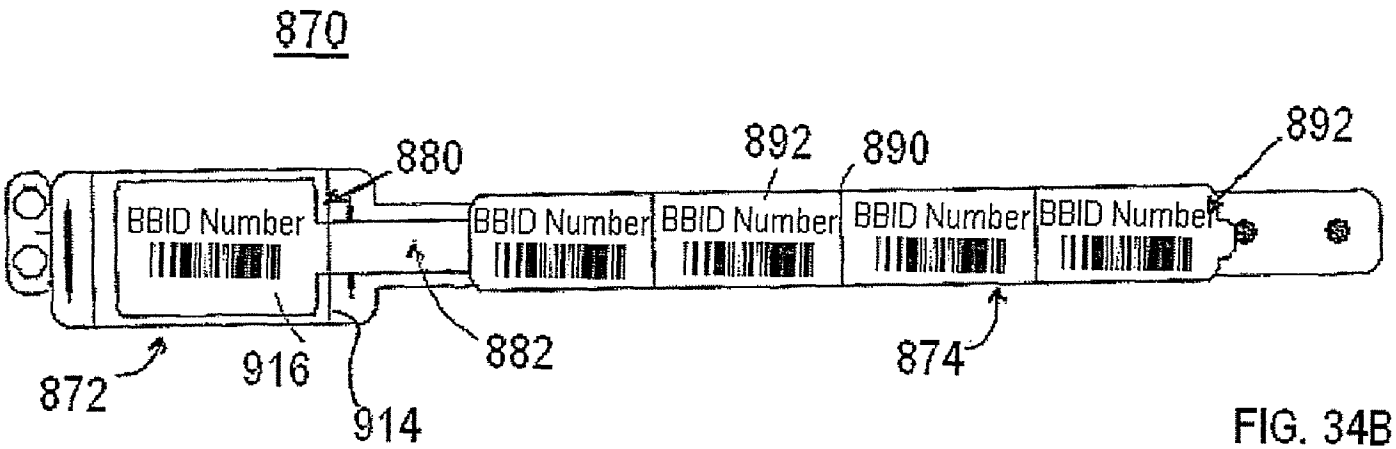
FIG. 34B is a top view of the recipient verification system of FIG. 32 upon final assembly and in a use state.

With reference to FIGS. 33 and 34A, assembly of the recipient verification system 870 initially entails insertion of the head assembly 888 at the pocket 880. In particular, the head assembly 888 is inserted between the upper shield segment 916 and the upper pocket segment (hidden). As shown in FIG. 34A, then, upon final insertion, the release liners 898, 900 (one of which is shown) extend from the upper shield segment 916. The release liners 898, 900 are then removed, thereby exposing the adhesive surfaces 906, 908 (FIG. 33), resulting in bonding of the support structure 896 to the upper shield segment 916 and the upper pocket segment as shown in FIG. 34B. As with the system 820 of FIG. 30B, the recipient verification system 870 can be repeatedly transitioned between the use state and a storage state (not shown) by folding the label strip 874 onto itself (e.g., at the lines of weakening 890), and then inserting the folded label strip 874 and the tether 882 into the pocket 880 formed between the lower pocket segment 914 and the upper pocket segment. Regardless, the label strip 874, and thus the removable labels 892, are permanently attached to the band 872 via the tether 882.

Figure 35A:
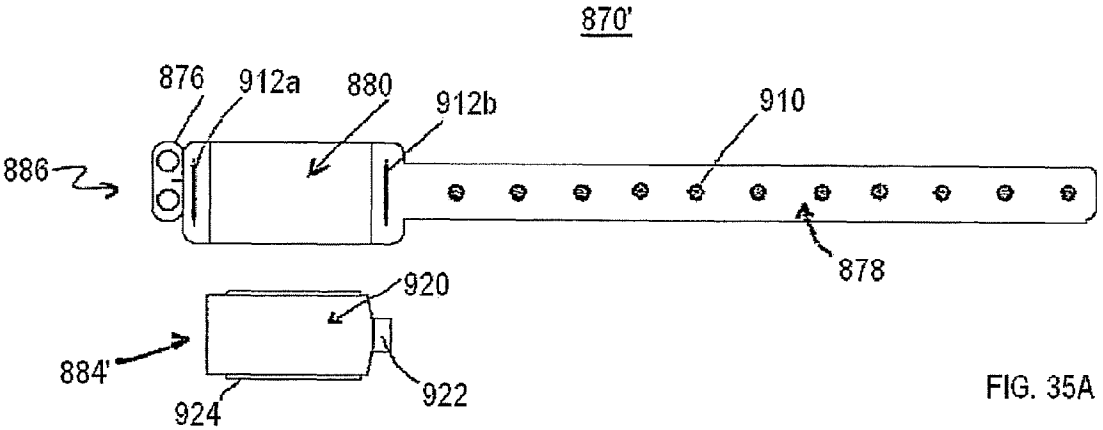
FIG. 35A is a top, exploded view of another recipient verification system in accordance with principles of the present disclosure.
Figure 35B:
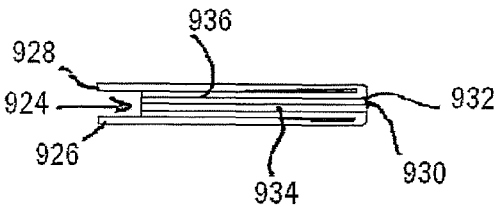
FIG. 35B is a side view of an insert piece useful with the recipient verification system of FIG. 35A.

While the system 870 has been described as including the label strip 874 and the tether 882, other constructions are also contemplated. For example, FIG. 35A illustrates a related recipient verification system 870' including the base piece 886 as described above, along with an alternative insert piece 884'. The insert piece 884' includes a head assembly 920 and an optional tab 922. The head assembly 920 is shown in greater detail in FIG. 35B, and initially consists of a support structure 924, and opposing, first and second release liners 926, 928. As with the head assembly 888 (FIG. 33) described above, the support structure 924 can incorporate one or more layers, such as the first and second layers 930, 932 shown in FIG. 35B. Regardless, the support structure 924 defines opposing surfaces 934, 936 that are coated with an adhesive. The adhesive surfaces 934, 936 are, in turn, initially covered by a respective one of the release liners 926, 928. As described in greater detail below, the second surface 936 can further include or display information indicia.

Returning to FIG. 35A, the tab 922, where provided, can be identical to the tab 862 (FIG. 31A) described above, and can be separable from the head assembly 920 via a line of weakening (not shown). Once again, the tab 922 may include printed indicia or other information to serve as a separate label where desired.

Figure 36A:
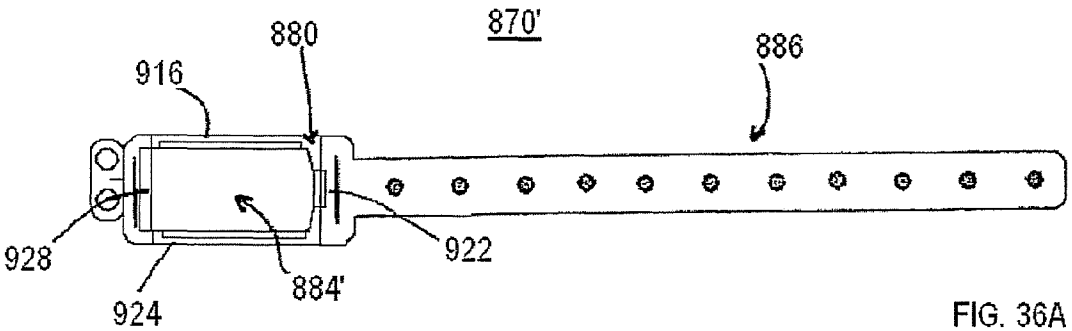
FIGS. 36A and 36B illustrate assembly of the recipient verification system of FIG. 35A.
Figure 36B:
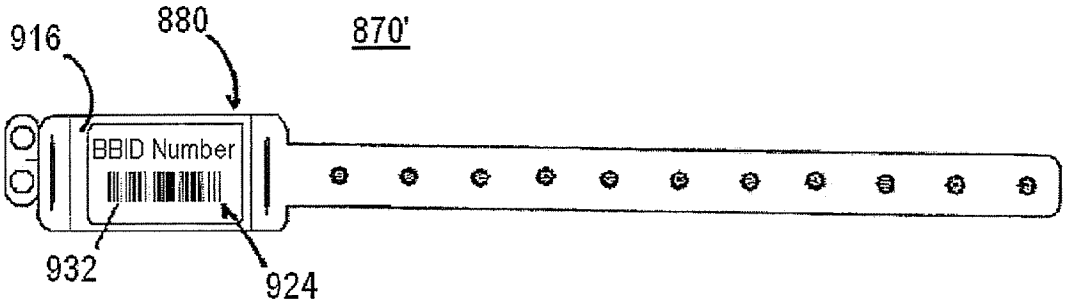

Initial assembly of the recipient verification system 870' is shown in FIG. 36A, and include insertion of the insert piece 884' at the pocket 880. As illustrated, the second release liner 928 is disposed between the upper shield segment 916 and the support structure 924. Further, though hidden in the view, the first release liner 926 (FIG. 35B) is disposed between the support structure 924 and the upper pocket segment (hidden). The release liners 926, 928 are then removed as described above (e.g., pulling the release liners 926, 928 from the base piece 886), resulting in the support structure 924 being bonded to the upper shield segment 916 and the upper pocket segment. Where provided, the tab 922 (FIG. 36A) can then be removed.

Figure 37:
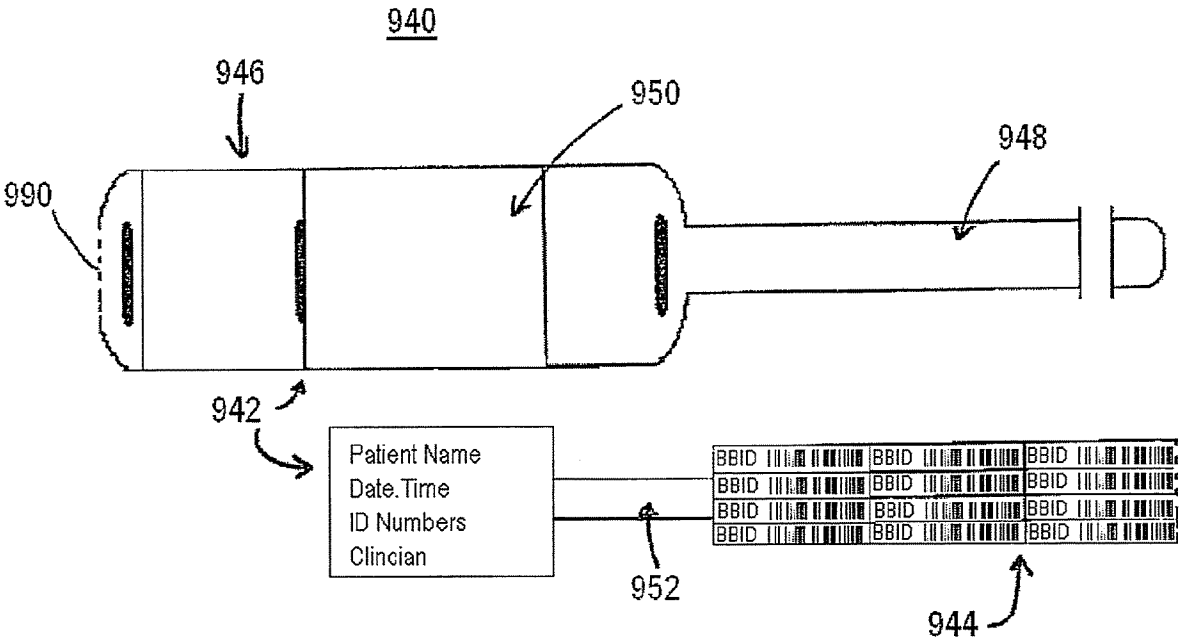
FIG. 37 is a top, exploded view of another recipient verification system in accordance with principles of the present disclosure.

Yet another embodiment recipient verification system 940 in accordance with the present disclosure is shown in FIG. 37 and includes a band 942 (referenced generally) and a label strip 944. As with previous embodiments, the band 942 includes a closure device 946 (referenced generally), a strap 948, a pocket 950 (referenced generally), and a tether 952. In some constructions, the band 942 and the label strip 944 can initially be formed as an integral structure as described below.

Figure 38A:
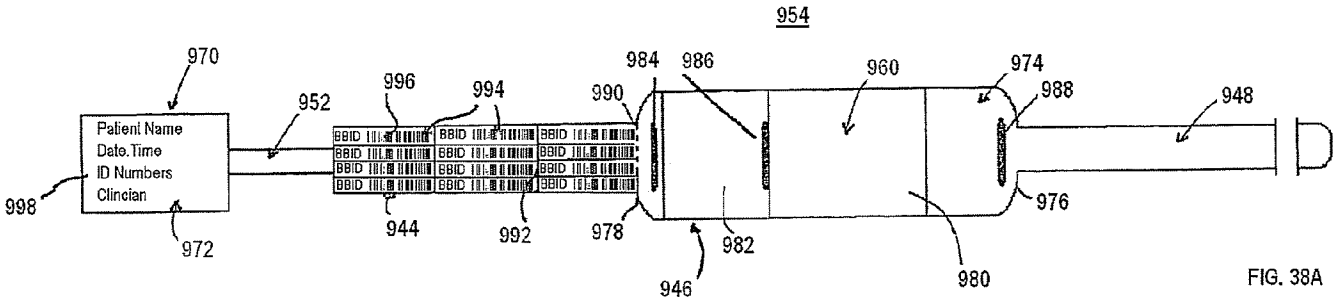
FIG. 38A is a top view of a laminate piece useful in forming the recipient verification system of FIG. 37.
Figure 38B:
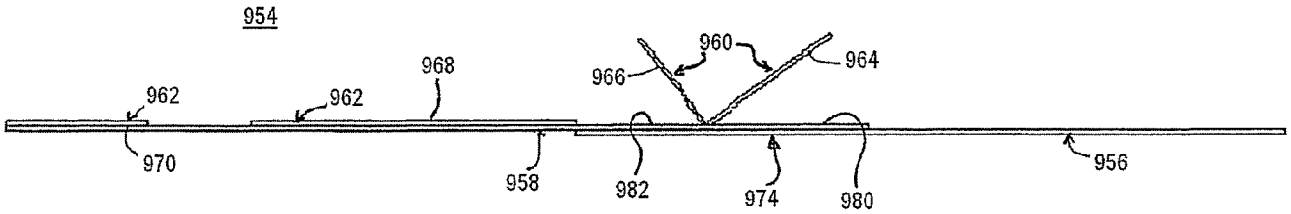
FIG. 38B is a side view of the laminate piece of FIG. 38A.

In particular, FIGS. 38A and 38B illustrate a single piece structure 954 formed from a variable laminate. As best shown in FIG. 38B, the piece 954 can include a base substrate or layer 956, an intermediate substrate or layer 958, a shield substrate or layer 960, and a face stock layer 962. The base layer and intermediate layer 956, 958 can be formed from a variety of materials as described above, and are generally flexible, printable, water-resistant, and durable. The shield layer 960 is also a flexible, water-resistant and durable material that is transparent or semi-transparent. As assembled to the intermediate layer 958, the shield layer 960 defines opposing first and second shield segments 964, 966. In the initially formed state of FIG. 38B, the shield segments 964, 966 are movable relative to the intermediate layer 958 as shown, with an interior surface of each of the shield segments 964, 966 (i.e., the surface "facing" the intermediate layer 958) being coated with an adhesive and covered with a release liner (not shown). The face stock layer 962 is carried by the intermediate layer 958 via a releasable adhesive (e.g., pressure sensitive adhesive). The face stock layer 962 is thus removable from the intermediate layer 958, and forms a removable label segment 968 and a permanent label segment 970.

With specific reference to FIG. 38A, the piece 954 can be die cut from a variable laminate structure, resulting in the strap 948, the tether 952, and the label strip 944. In addition, the piece 954 forms a head 972 and a support 974. As shown, the strap 948 extends from a first end 976 of the support 974, whereas the label strip 944 extends from an opposing, second end 978. Arrangement of the shield layer 960 to the support 974 defines a pocket region 980 and a closure region 982 as best identified in FIG. 38B. As shown, then, the pocket region 980 is defined along the intermediate layer 958 immediately opposite the first shield segment 964, whereas the closure region 982 is defined along the intermediate layer 958 immediately opposite the second shield segment 966. First and second closure slots 984, 986 are formed through a thickness of the laminate structure 954 at the closure region 982 as shown, with the closure slots 984, 986 combining with the second shield segment 966 to define the closure device 946 as described below. Additionally, an optional reclosure slot 988 can be formed through the base layer 956 adjacent the pocket region 980. A line of weakening (e.g., partial or slot cuts) 990 can be formed at the intersection of the label strip 944 and the support 974 as shown. Additional lines of weakening 992 are formed through the face stock layer 962 along the removable label segment 968 to define a plurality of removable labels 994.

Prior to or following the die cutting operations above, the piece 954 is subjected to a printing operation in which band identification indicia 996 is applied to each of the removable labels 994. Auxiliary indicia 998 is optionally applied to the face stock layer 962 along the permanent label segment 970, and can take various forms. In some embodiments, the auxiliary indicia 998 provides patient identification information (e.g., patient name, date/time of admission, treating clinician, etc.). In addition or alternatively, the auxiliary indicia 998 can be identical to the band identification indicia 996.

Figure 39A:
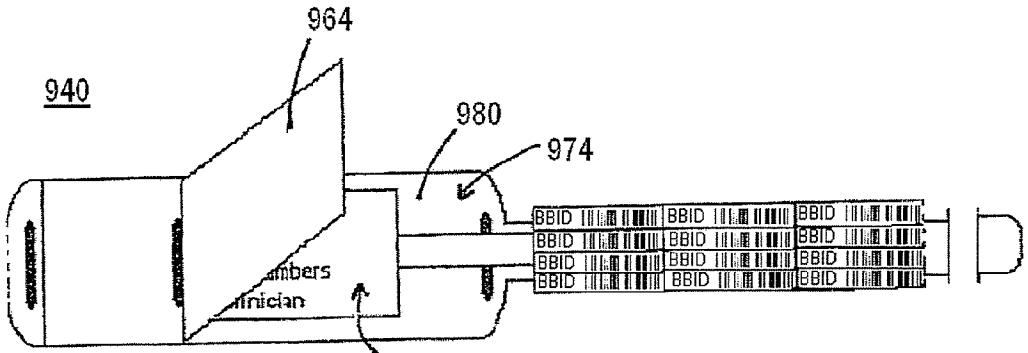
FIGS. 39A and 39B illustrate assembly of the recipient verification system of FIG. 37.
Figure 39B:
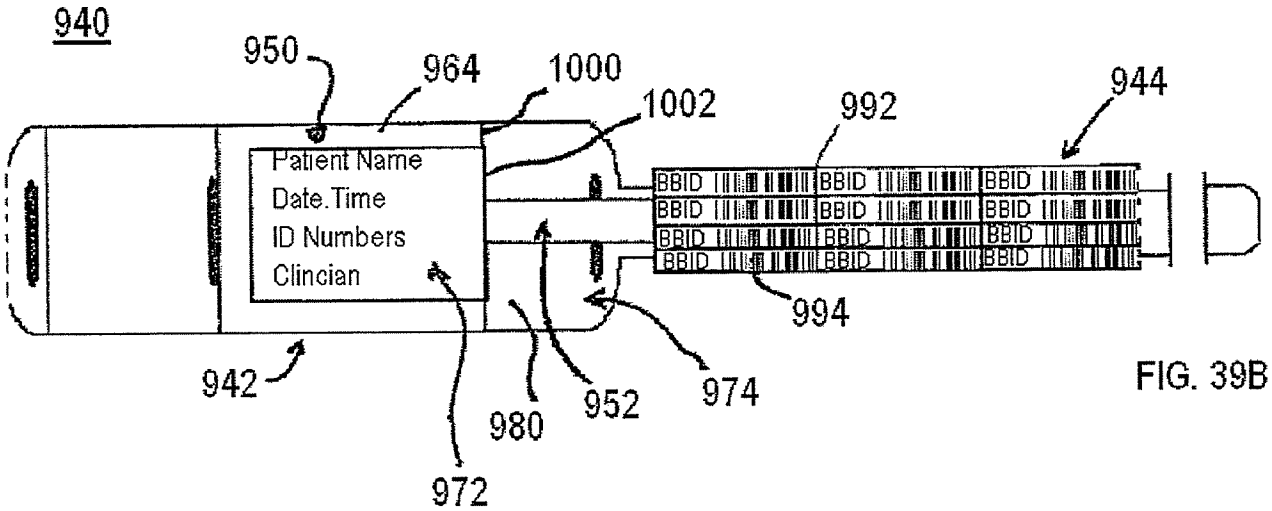

Upon completion of the one-piece structure 954, the recipient verification system 940 is constructed by initially separating the label strip 944 (and thus the tether 952 and the permanent label segment 970 attached thereto) from the support 974 via the line of weakening 990. As shown in FIG. 39A, the first shield segment 964 is lifted away from the pocket region 980 of the support 974, and the head 972 placed onto the pocket region 980. A release liner (not shown) associated with the first shield segment 964 is removed, and the first shield segment 964 placed over and against the head 972, and thus bonded to the head 972. In addition, because a size of the head 972 is less than that of the first shield segment 964 and the pocket region 980, the adhesive surface associated with the first shield segment 964 contacts and bonds to the pocket region 980 of the support 974. As shown in FIG. 39B, a leading edge 1000 of the first shield segment 964 is aligned with, or slightly "behind", an end 1002 of the head 972. Thus, the first shield segment 964, the head 972, and the pocket region 980 of the support 974 combine to define the pocket 950 (e.g., an interior region of the pocket 950 is defined between the head 972 and the support 974, with the pocket region 980 of the support 974 thus serving as a lower pocket segment and the head 972 serving as an upper pocket segment). Access to the interior region of the pocket 950 is provided at the end 1002 of the head 972 (i.e., an area at which the first shield segment 964 is not bonded to the pocket region 980).

In the use state of FIG. 39B, the label strip 944 is removed from the interior region of the pocket 950, with the removable labels 994 available to a user. The recipient verification system 940 can be repeatedly transitioned between the use state and a storage state (FIG. 39C) by folding the label strip 944 onto itself (e.g., at the lines of weakening 992), and then inserting the folded label strip 944 and the tether 952 into the pocket 950 via the open end 1002. Regardless, the label strip 944, and thus the removable labels 994, are permanently attached to the band 942 via the tether 952.

Figure 40A:
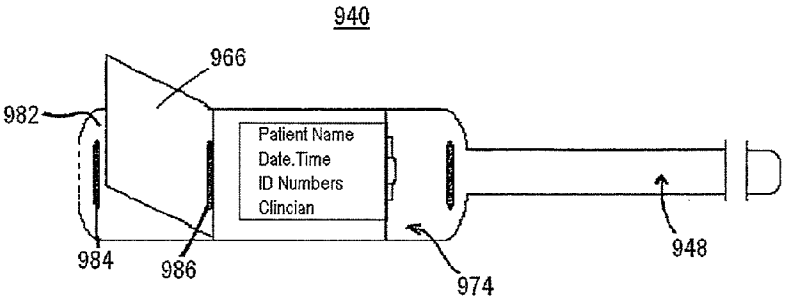
FIGS. 40A and 40B illustrate assembly of a closure device portion of the recipient verification system of FIG. 37.
Figure 40B:
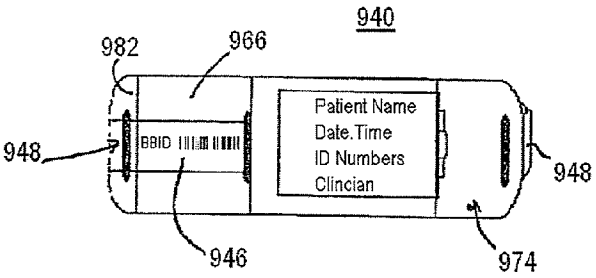

The recipient verification system 940 can be secured to a recipient (e.g., patient) in a variety of manners. With one approach, the second shield segment 966 is lifted away from the closure region 982 of the support 974 as shown in FIG. 40A. The strap 948 is wrapped around the recipient's appendage (e.g., wrist). The so-wrapped strap 948 is then inserted upwardly through the second closure slot 986, pulled along the closure region 982, and then inserted downwardly through the first closure slot 984. A release liner (not shown) associated with the second shield segment 966 is removed, and the second shield segment 966 is then pressed downwardly onto the closure region 982, thereby securing the strap 948 to the closure region 982, and thus the recipient verification system 940 to the recipient. This relationship is reflected in FIG. 40B. As a point of reference, FIG. 40B further reflects that the band identification indicia 946 can optionally be printed onto the strap 948, and thus readily displayed as a permanent label upon final securement of the system 940 to the recipient.

Figure 41:
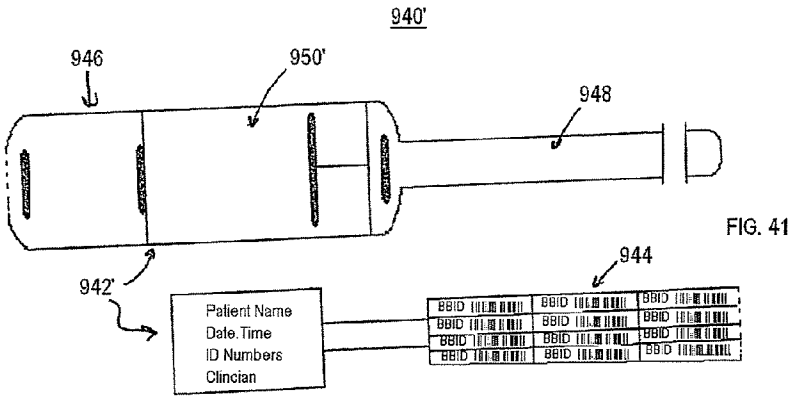
FIG. 41 is a top, exploded view of another recipient verification system in accordance with principles of the present disclosure.

A related embodiment recipient verification system 940' is shown in FIG. 41, and includes a band 942' (referenced generally) and the label strip 944. The closure device 946, the strap 948, and the tether 952 components can be identical to the descriptions provided above. A pocket 950' (referenced generally) is also provided, but is constructed in a differing manner.

Figure 42A:
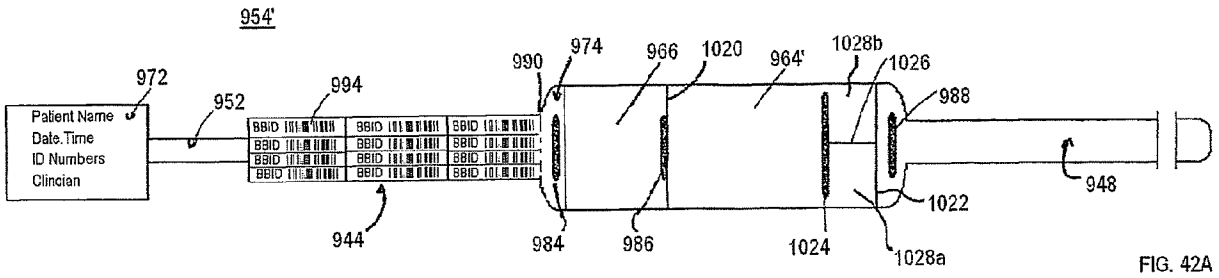
FIG. 42A is a top view of a laminate piece useful in forming the recipient verification system of FIG. 41.
Figure 42B:
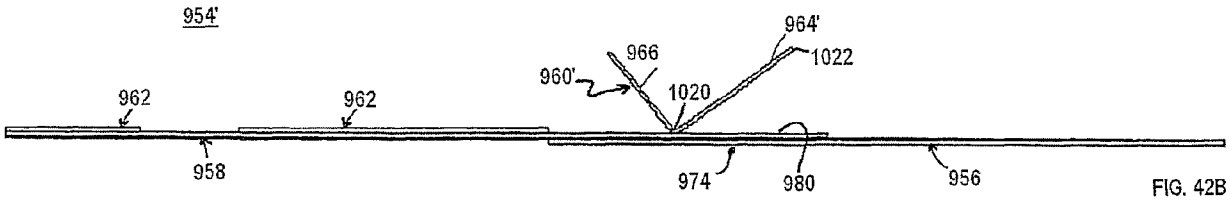
FIG. 42B is a side view of the laminate piece of FIG. 42A.

More particularly, and with reference to FIGS. 42A and 42B, the system 940' can again be initially provided as a variable laminate piece 954', die cut from a laminate structure including the base layer 956, the intermediate layer 958, and the face stock layer 962. A shield layer 960' is also provided, and is assembled to the intermediate layer 958 in a manner defining a first shield segment 964' and the second shield segment 966. As best shown in FIG. 42A, the first shield segment 964' is slightly longer than the first shield segment 964 (FIG. 38A) described above, extending between opposing, first and second sides 1020, 1022. The first side 1020 is attached to the intermediate layer 958, whereas the second side 1022 is initially free of the intermediate layer 958 (e.g., the first shield segment 964' is coated with an adhesive that is initially covered by a release liner (not shown)). Further, the first shield segment 964' forms an opening 1024 adjacent the second side 1022, and a relief slot 1026 extending from the opening 1024 to the second side 1022. A lateral length of the opening 1024 is commensurate with a width of the head 972 for reasons made clear below. Finally, tabs 1028*a*, 1028*b* are defined at opposite sides of the relief slot 1026.

Figure 39C:
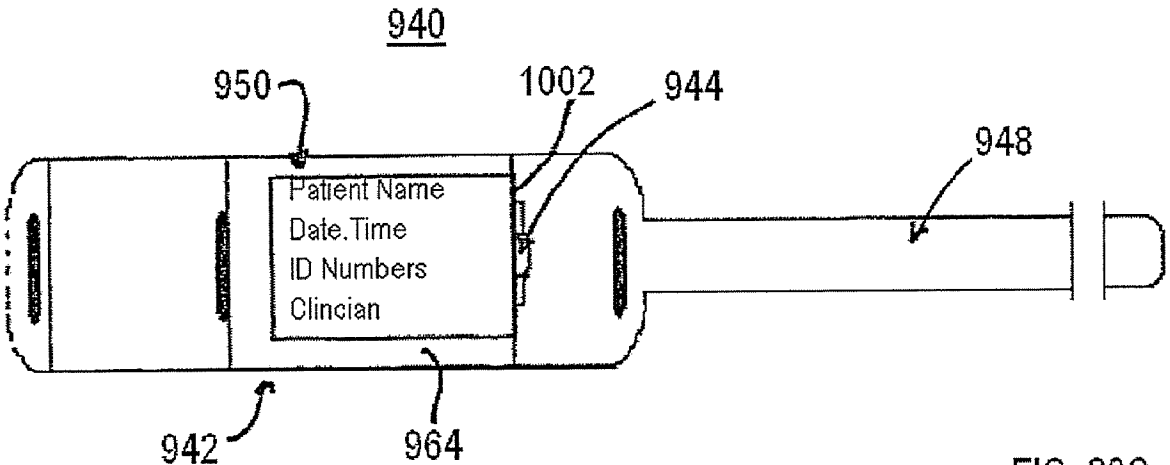
FIG. 39C is a top view of the recipient verification system of FIG. 37 upon final assembly and in a storage state.
Figure 43A:
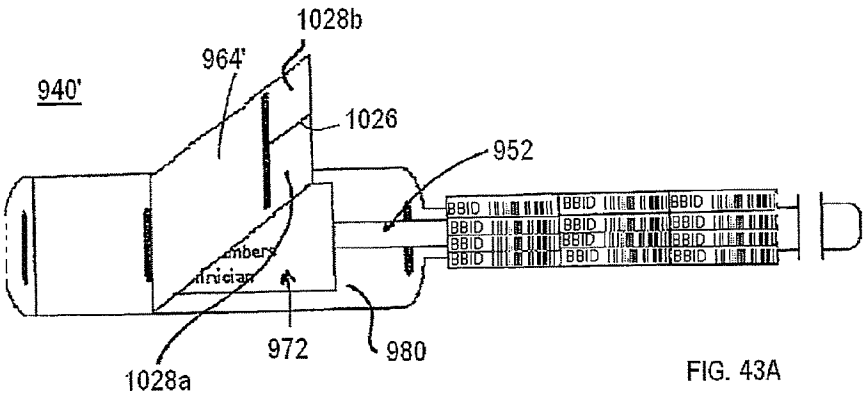
FIGS. 43A and 43B illustrate assembly of the recipient verification system of FIG. 41.
Figure 43B:
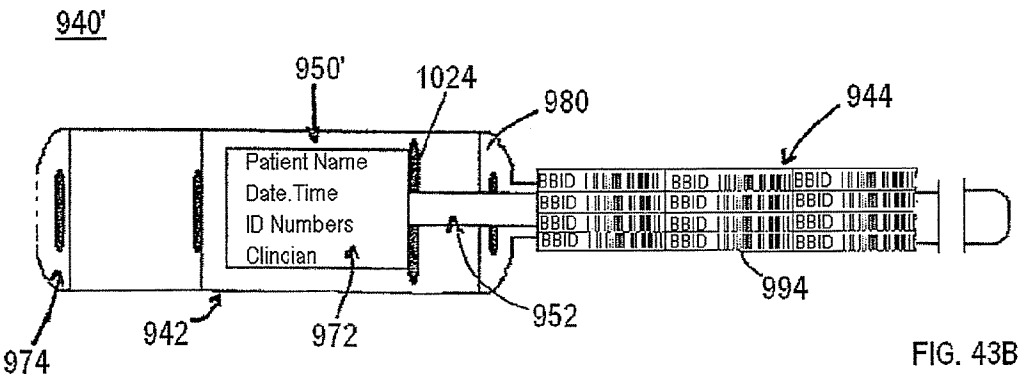

Assembly of the recipient verification system 940' can be highly akin to the descriptions provided above with respect to the recipient verification system 940 (FIGS. 39A-39C). In general terms, the label strip 944 is detached from the support 974, and the first shield segment 964' lifted away from the pocket region 980 of the support 974. As shown in FIG. 43A, the head 972 is placed onto the pocket region 980, and a release liner (not shown) provided with the first shield segment 964' removed. The first shield segment 964' is then directed onto the head 972, thereby bonding the first shield segment 964' to the head 972 and the pocket region 980. The tether 952 is inserted through the relief slot 1026, with the tabs 1028*a*, 1028*b* then bonded to the pocket region 980. The pocket 950' is thus formed, with an interior region thereof being defined between the head 972 and the pocket region 980 of the support member 974 as shown in FIG. 43B (i.e., the pocket region 980 of the support 974 serves as a lower pocket segment and the head 972 serves as an upper pocket segment). Access to the interior region is provided via the opening 1024.

Figure 43C:
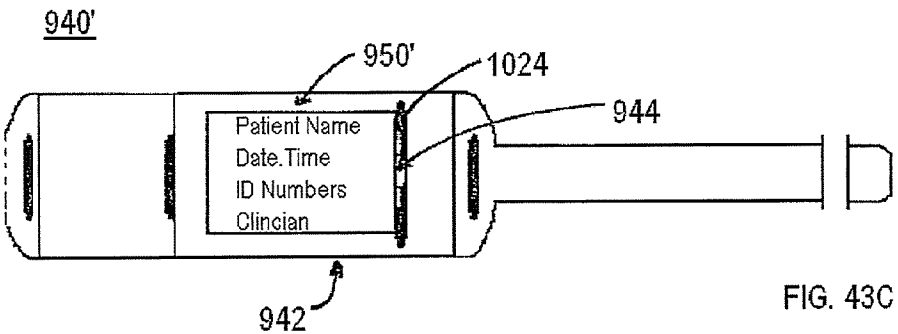
FIG. 43C is a top view of the recipient verification system of FIG. 41 upon final assembly and in a storage state.

As with previous embodiments, in the use state of FIG. 43B, the label strip 944 is removed from the pocket 950', with the removable labels 994 available to a user. The recipient verification system 940' can be repeatedly transitioned between the use state and the storage state of FIG. 43C by folding the label strip 944 onto itself, and then inserting the folded label strip 944 and the tether 952 into the pocket 950' via the opening 1024. Regardless, the label strip 944, and thus the removable labels 994, are permanently attached to the band 942 at all times via the tether 952.

Figure 44A:
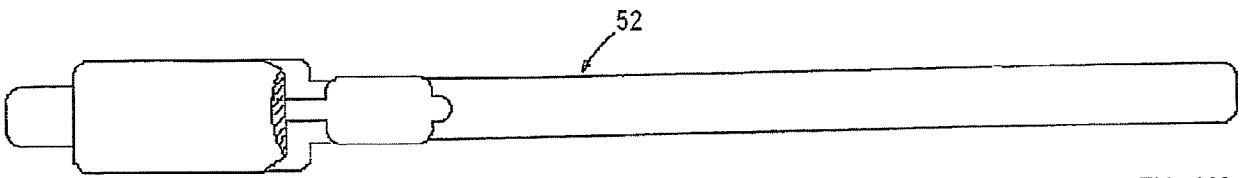
FIGS. 44A-44C are top views illustrating another embodiment of a label strip in accordance with principles of the present disclosure, along with a band.
Figure 44B:
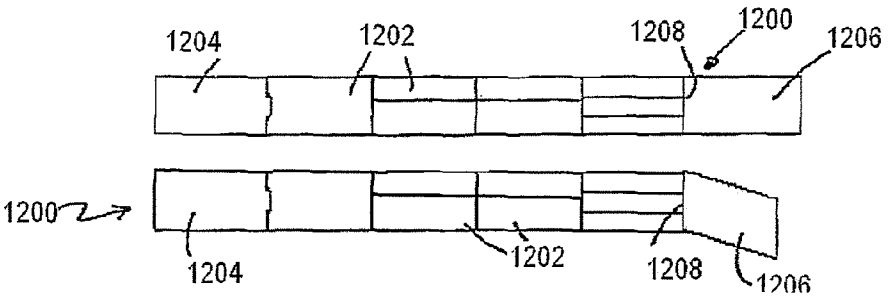
Figure 44C:
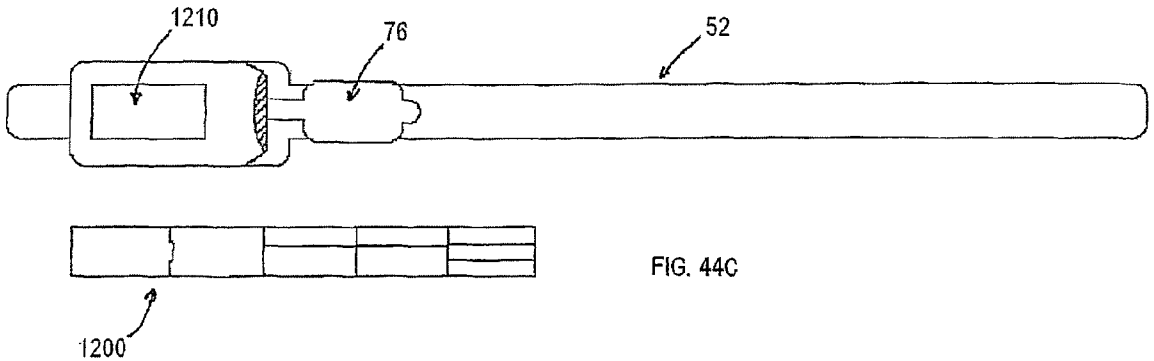

Returning to FIG. 1A, the label strips of the present disclosure (e.g., the label strip 54) have been described as assuming a variety of forms. For example, in addition to optionally forming one or more fold lines (e.g., the first fold line 150 of FIG. 4A), the label strip 54 can be generated to provide the band indicia 130 that is otherwise permanently applied to the band 52. FIGS. 44A-44C illustrate one such embodiment. In particular, FIG. 44A illustrates the band 52 as described above, along with one embodiment of a label strip 1200. The label strip 1200 is akin to the label strip 54 (FIG. 1A) previously described, and generally provides a plurality of adhesive-backed labels 1202 maintained by a backing or release liner (not shown). The label strip 1200 provides a base section 1204 that may or may not display information, but is adapted for securement to the head 76. In addition, the label strip 1200 includes a tag section 1206 opposite the base section 1204. The tag section 1206 displays desired indicia (such as the band identification indicia 130 previously described with respect to FIG. 2C), and is separable from a remainder of the label strip 1200 via a line of perforations or other partial-cut line 1208.

With the above construction, following assembly of the band 52, the label strip 1200 is generated, including applying the desired, printed indicia onto the tag section 1206. The tag section 1206 is then removed from a remainder of the label strip 1200 as shown in FIG. 44B. A release liner or other backing provided with the tag section 1200 is subsequently removed, and a resultant, adhesive-backed tag 1210 permanently adhered to the band 52 as shown in FIG. 44C. The identification indicia associated with the adhesive tag 1210 is thus permanently associated with the band 52, whereas a remainder of the label strip 1200 is physically attached to the head 76 (and thus the band 52 as previously described).

Figure 45A:
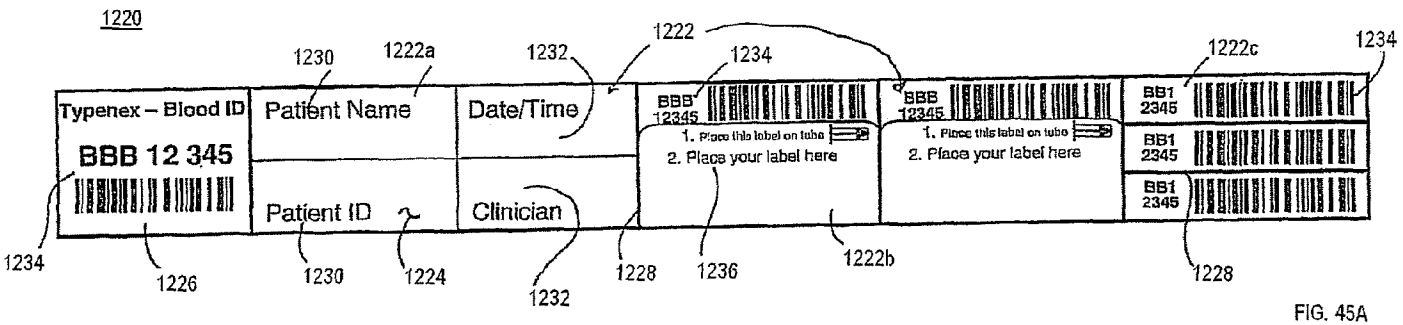
FIGS. 45A-45I illustrate various embodiment label strips useful with the recipient verification systems of the present disclosure.
Figure 45B:
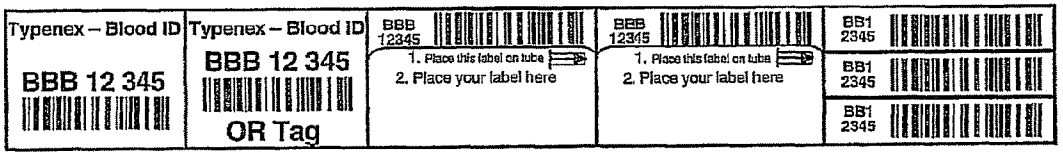
Figure 45C:
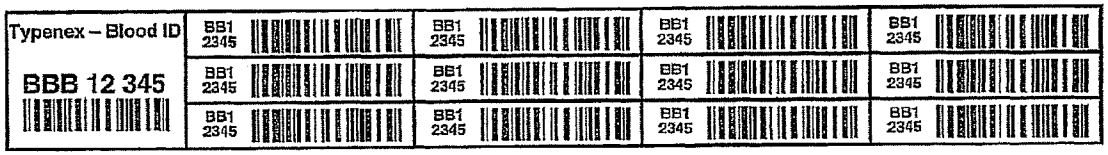
Figure 45D:
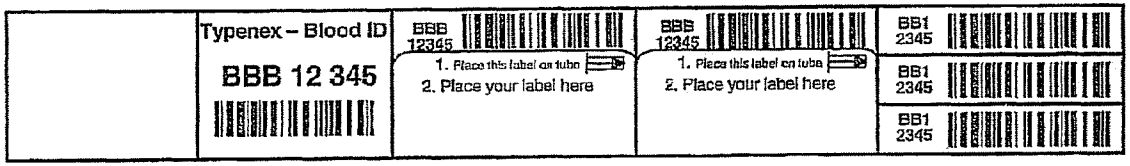
Figure 45E:
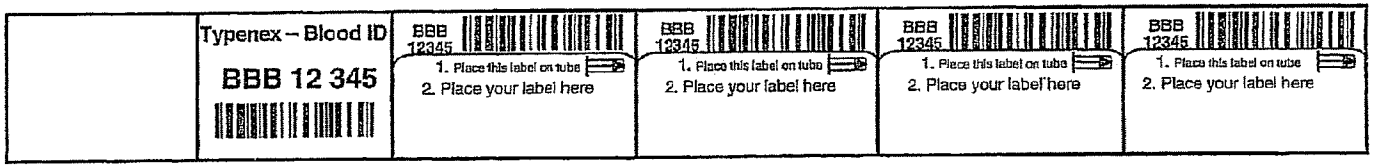
Figure 45F:
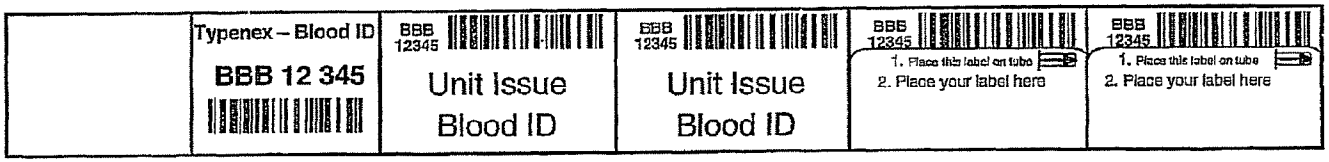
Figure 45G:
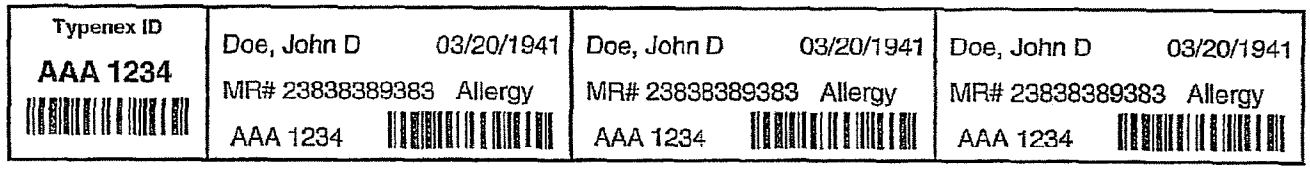
Figure 45H:
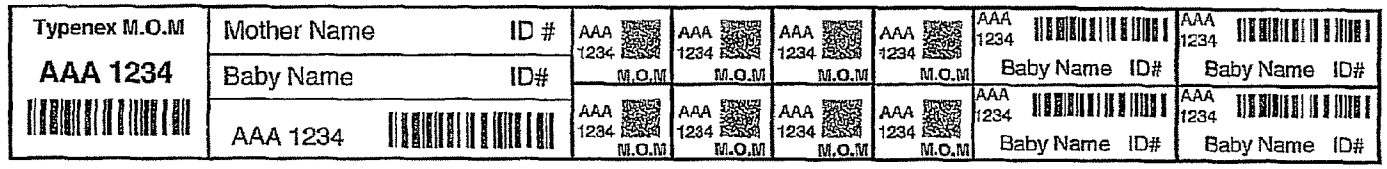
Figure 45I:
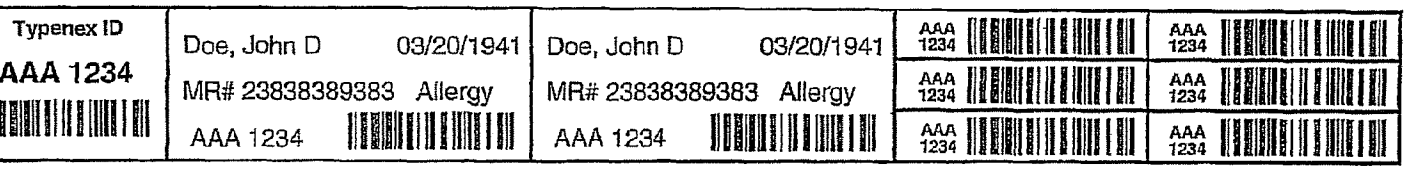

In addition to facilitating assembly of the recipient verification system, label strips in accordance with principles of the present disclosure may provide a variety of different label formats. In fact, features of the present disclosure include the ability to generate label strips with customizable labels pursuant to user preferences. The placement and format/appearance of the customized label(s) may facilitate adherence to set protocols. For example, FIG. 45A illustrates one example of a customized label strip 1220, formed to provide a plurality of differently-formatted labels 1222. Once again, the label strip 1220 includes an adhesive-backed label stock material or layer 1224 removably maintained by a backing or release liner (not shown). Following initial formation of the label stock layer 1224 onto the backing, a user prompts corresponding equipment to define the plurality of labels 1222 in the label strip 1220, along with the printed indicia displayed on each of the labels 1222. For example, in some embodiments, the user is provided with appropriate software and/or hardware for enabling customized formation of the label strip 1220. In related embodiments, the user can electronically create and order customized label strips, for example over the internet whereby a manufacturer's selectable label size and/or display options are made available. In fact, methods in accordance with the present disclosure include posing a series of questions or other inquiries (via, for example, a manufacture's website) intended to assemble the various procedure(s) that a particular recipient will undergo at the institution making use of the recipient verification system; based upon the information provided, the system manufacturer will self-create an optimal, customized label strip. Even further, an electronic system can be provided in which scanned information from a separate label is used to automatically generate the label strip 1220.

As a point of reference, regardless of the procedures by which the customized label strip 1220 (or any of the label strips of the present disclosure) is formed, manufacture of the corresponding recipient verification system is a two-step process in some embodiments. First, the band is prepared. The band can take any of the forms set forth in the present disclosure, or can have a more conventional design. Regardless, preparation of the band can include the band manufacturer printing information (e.g., the band identification indicia described elsewhere) onto the band with a first printer. The label strip is subsequently prepared downstream of the band preparation process(es), including printing of desired label information/appearance via a second printer. Printing of the label strip can be done by the end-user; thus, for example, the band manufacturer provides the end-user with a completed band (i.e., including information printed onto the band), and the end-user then prepares/prints the label strip using a printer located at the end-user's site. Alternatively, the band manufacturer can provide a pre-printed label strip to the end-user, along with the completed band. In this regard, the band manufacturer can use two different printers in separately preparing the band and the label strip, or a single printer can be employed for both components.

Returning to the but one acceptable example of the label strip 1220 of FIG. 45A, the labels 1222 are formed to include a first label format 1222*a*, a second label format 1222*b*, and a third label format 1222*c*. Further, a base section 1226 is defined (akin to the base section 146 of FIG. 3A). Each of the labels 1222 are separable or demarcated from one another by cut lines 1228 (e.g., perforations, partial cuts, score lines, etc.). With this in mind, the first label type 1222*a* displays subject indicia 1230, and provides open space 1232 for entry of recipient-specific information responsive to the corresponding subject indicia 1230. As a point of reference, while the subject indicia 1230 in FIG. 44A is medical-related, a wide variety of other subject matter can be displayed.

The second label type 1222*b* is uniquely formatted for application to a test tube specimen as described below, and includes or displays band identification indicia 1234 (e.g., alphanumeric and/or bar code), and instructions for use indicia 1236. As previously described, the band identification indicia 1234 represents a unique code assigned to an individual band; when the recipient is initially processed by the institution using the recipient verification system (e.g., a patient admitted to a hospital), the unique code is assigned to the recipient, and all relevant recipient information can optionally be electronically associated with the so-assigned band identification code in a database maintained by the institution. The instructions for use indicia 1236 informs a caregiver as to an optimal implementation of the second label type 1222*b* with a test tube specimen as described below.

The third label type 1222*c* also displays the band identification band indicia 1234, and is of a smaller overall size as compared to others of the labels 1222.

Finally, in some embodiments, the band identification indicia 1234 is applied to, and displayed by, the base section 1226. Alternatively, other indicia can be printed onto the base section 1226, or the base section 1236 can be left blank.

The identification indicia 1234 can be presented on the labels 1222 (as well as optionally the base section 1226) in identical or differing formats. Possible formats include, for example, human readable numbers and/or letters, bar code, magnetic strip, RFID chip, smart chip, etc. Further, the label types and corresponding size and displayed information can be varied for different, customized label strips. For example, FIGS. 45B-45I illustrate but a few alternative, customized label strips contemplated by the present disclosure.

As mentioned above, in some embodiments, label strips in accordance with the present disclosure can provide a label type specifically designed for use with a test tube specimen. As a point of reference, most caregiver institutions (e.g., hospitals) have specific regulations in place for handling of patient test tube specimens. In particular, several information items must accompany the test tube specimen, including patient name, medical record number, date of birth, date and time the sample was drawn, and the initials of the person who drew the sample. Additional information can include a unique code number, test type, etc. This information must be applied on the test tube in a manner that promotes legibility by the human eye and by automated equipment. Unfortunately, issues are often encountered by caregivers in applying the requisite information to the test tube specimen. There is very limited space to place the information, and selected informational items are often times presented on two or more, separate labels. An improperly labeled patient specimen can result in patient safety risks or the need to recollect the sample (that in turn causes increased cost, loss of time, patient inconvenience, and additional opportunities for error). The optional specimen test tube label type 1222*b* (FIG. 45B) addresses these concerns.

Figure 46:
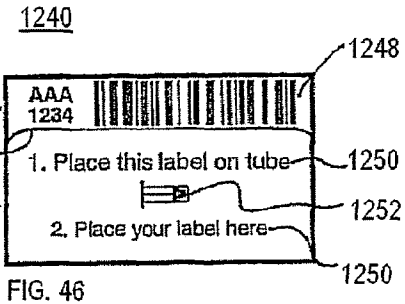
FIG. 46 is a top view of a test tube specimen label in accordance with principles of the present disclosure.

In particular, one embodiment of a test tube specimen label 1240 is shown in FIG. 46. The label 1240 includes an identification region 1242 and an instruction region 1244. The regions 1242, 1244 are visually separated from one another by a printed line 1246 or other visual identifier. Regardless, the identification region 1242 includes band identification indicia 1248 as described above. The instruction region 1244 occupies a majority of a surface area of the label 1240 and includes written instructions 1250 and an icon 1252. The written instructions 1250 describe, in words, how the label 1240 should be applied to a test tube, with the icon 1252 supplementing this explanation with a graphical illustration of proper label placement.

Figure 47A:
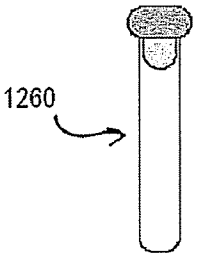
FIGS. 47A-47D illustrate application of the label of FIG. 19 to a test tube.
Figure 47B:
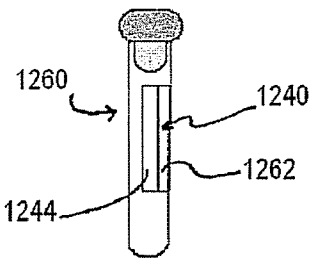

FIG. 47A illustrates a test tube 1260 in simplified form within which a patient specimen has been (or will be) collected. Conventional test tubes 1260 are elongated tubes, having a length significantly greater than a corresponding diameter. In FIG. 47B, the test tube specimen label 1240 has been applied to an exterior surface 1262 of the test tube 1260. In accordance with the instructions 1250 and/or the icon 1252 (FIG. 46), the label 1240 has been desirably applied to the test tube 1260 such that a length of the label 1240 extends parallel with a length of the test tube 1260. Though, for ease of illustration, the various indicias or instructions described above are not shown in FIG. 47B, the identification region 1242 and the instruction region 1244 have been designated in the view.

Figure 47C:
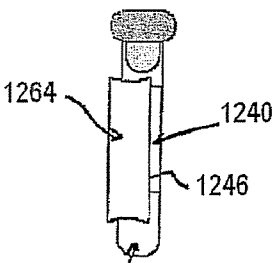
Figure 47D:
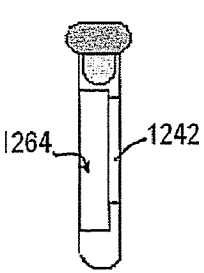

Following application of the test tube specimen label 1240, a second, conventional test-specific label 1264 is applied to the test tube 1260 as shown in FIGS. 47C and 47D. Though the second, conventional label 1264 is shown as not displaying information for ease of illustration, it will be understood that the second label 1264 displays requisite, test-related information. Regardless, the identification indicia 1250 and/or 1252 (FIG. 46) informs the caregiver to apply the second label 1264 over only a portion of the test tube specimen label 1240, and in particular the instruction region 1244. The demarcation line 1246 further informs the caregiver as to proper placement of the second label 1264. Upon final application (FIG. 47D), then, the identification region 1242 is not covered by the second label 1264, such that the identification indicia 1248 (FIG. 46) is readily and consistently viewable.

It will be understood that the various label formats described above are but a few acceptable examples, and the present disclosure is in no way limited to a particular label format. Thus, the format and type of displayed information can vary as a function of the desired end use. For example, the icon 1252 (FIG. 46) is but one acceptable icon envisioned by the present disclosure. Other icon formats can also be employed, as part of the label strip, the band, or both, that provide a visual indication of a desired end use for the recipient verification system in question. Similarly, the labels and/or corresponding band can be utilized in a variety of fashions as desired, including as part of a scanning process in which the recipient verification system is scanned prior to each procedure (e.g., a conventional PDA process of many hospitals).

Returning to FIGS. 1A and 1B, the closure device 56 can assume a wide variety of forms, several of which have been described above. In essence, any type of security fastener appropriate for use with the bands of the present disclosure can be employed. For example, adhesive-type closure devices and clip-type closure devices are acceptable so long as they are irreversibly openable, or can only be opened by means of a special tool.

Figure 48A:
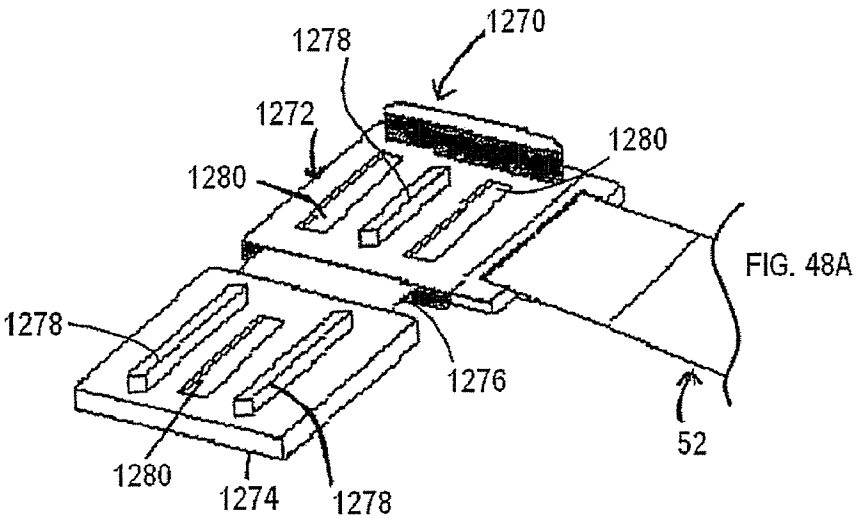
FIGS. 48A-48C illustrate a closure device useful with the recipient verification systems of FIGS. 1A and 1B.

With the above parameters in mind, one example of a closure device 1270 useful with recipient verification systems of the present disclosure is shown in FIG. 48A. The closure device 1270 is attached to the band 52, and includes a base 1272 and a cap 1274. The cap 1274 is movably connected to the base 1272, for example via a living hinge 1276. Regardless, the base 1272 and the cap 1274 form corresponding tongue 1278 and groove 1280 structures configured such that when the tongue 1278 is inserted into the corresponding groove 1280, the tongue 1278 is permanently captured. With the arrangement of FIG. 48A, the tongues 1278 of the cap 1274 are laterally spaced from the tongue 1278 of the base 1272, thereby establishing a tortuous path upon final deployment.

Figure 48B:
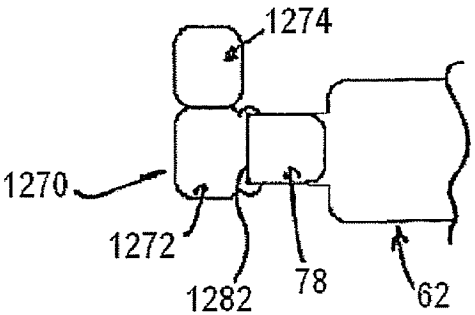
Figure 48C:
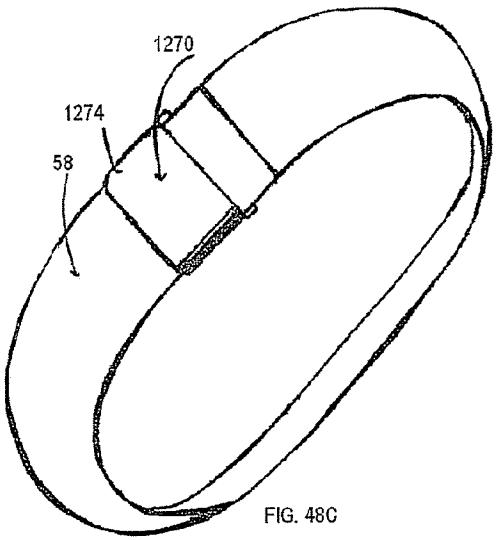

As shown in the simplified illustration of FIG. 48B, the closure device 1270 is initially assembled to the band 52, for example by heat sealing the strap connection segment 78 to the base 1272. In this regard, the base 1272 can form a slot 1282 through which the strap connection segment 78 can be threaded. Regardless, upon deployment of the strap 58 about a recipient's appendage as reflected by the wrapped orientation of FIG. 48C, the strap 58 is placed along the base 1272 (best shown in FIG. 48A) followed by placement of the cap 1274 over the strap 58 and into engagement with the base 1272. The resultant, secured or locked state of the closure device 1270 thus ensures that the band 52 cannot be removed from the recipient's appendage without tampering.

Figure 49B:
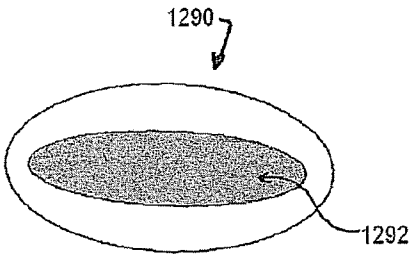
FIGS. 49A-49B illustrate an alterative closure device useful with the recipient verification systems of the present disclosure.
Figure 49A:
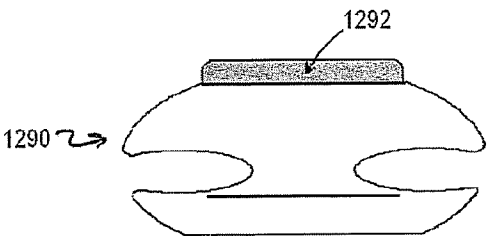

Another embodiment closure device 1290 in accordance with principles of the present disclosure is shown in FIGS. 49A and 49B. The closure device 1290 is a clip-type device incorporating a push button actuation assembly 1292 (referenced generally) that is easy to close and encourages a caregiver to leave appropriate space or room under the corresponding band (not shown, but akin to the band 52 of FIGS. 1A and 1 when wrapping about the recipient's appendage. The closure device 1290 incorporates teeth or similar staking-type structures (not shown) that trap or otherwise lock the band.

Figure 50B:
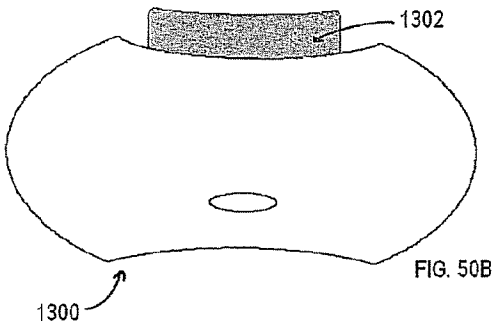
FIGS. 50A and 50B illustrate another embodiment closure device useful with the recipient verification systems of the present disclosure.
Figure 50A:
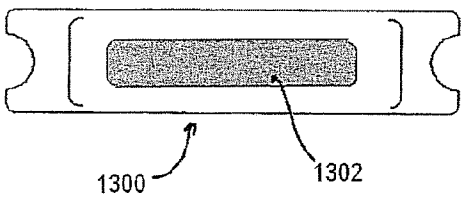

Yet another embodiment closure device 1300 in accordance with principles of the present disclosure is shown in FIGS. 50A and 50B. The closure device 1300 is akin to the closure device 1290 (FIGS. 49A and 49B) described above, and incorporates a push button actuation mechanism 1302 (referenced generally). As compared to the closure device 1290, however, the closure device 1300 of FIGS. 50A and 50B provides band closure relative to a top of the device 1300. With this approach, a user is afforded the ability to more easily monitor whether or not the closure device 1300 is truly closed, thereby preventing premature removal of the corresponding band (not shown).

Figure 51:
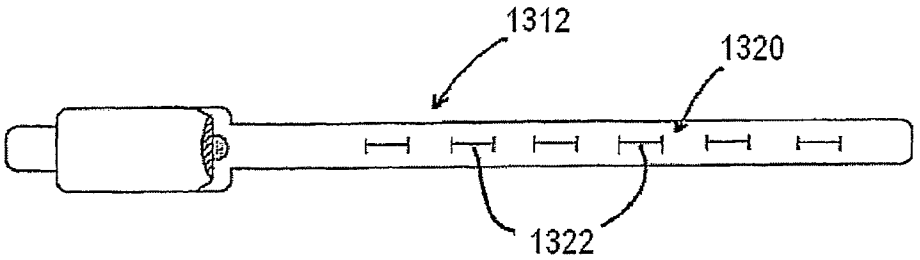
FIG. 51 illustrates another embodiment closure device and corresponding band useful with the recipient verification systems of the present disclosure.
Figure 51:
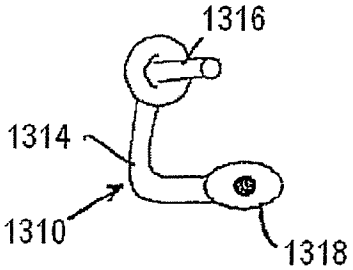

Yet another embodiment closure device 1310 along with a corresponding band 1312 is shown in FIG. 51. The closure device 1310 is of a type commonly employed with identification wristbands, and includes an intermediate member 1314 interconnecting male and female ends 1316, 1318. The intermediate member 1314 permits movement of the ends 1316, 1318 relative to one another, with the male end 1316 being permanently captured upon insertion into the female end 1318.

With the above construction of the closure device 1310 in mind, the band 1312 is akin to the band embodiments described above, and includes a strap 1320. In order to accommodate implementation of the closure device 1310, the strap 1320 forms a plurality of holes 1322. In some embodiments, the holes 1322 are initially formed as slits through the strap 1320 during a die cutting process. Subsequently, the ends of these slits are heat sealed during the sealing process to impede propagation of the slits in the strap 1320 material. Once the holes 1322 have been provided in the strap 1320, the closure device 1310 (or any other, similarly constructed security closure) can be employed, with the male end 1316 being inserted through a desired one of the holes 1322 in effectuating closure of the band 1312 about a recipient's appendage.

Figure 52A:
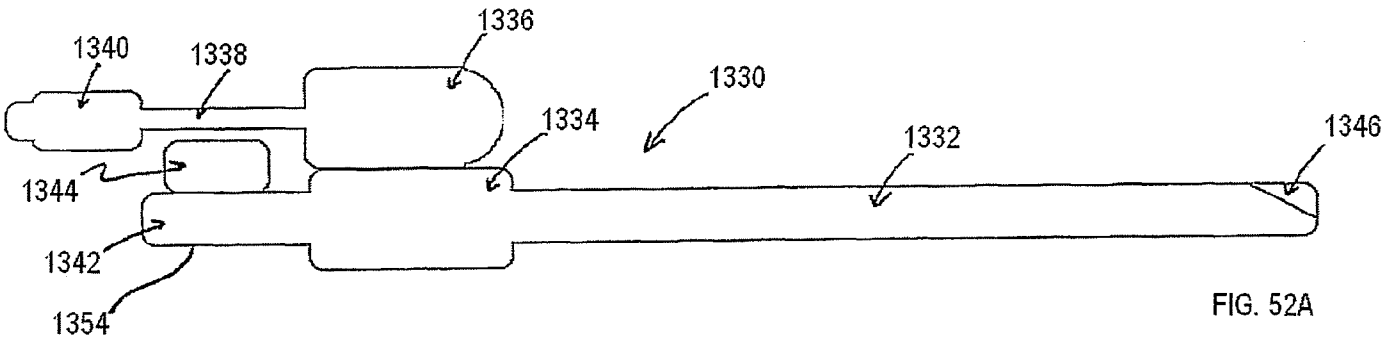
FIGS. 52A and 52B illustrate another embodiment band integrally forming a closure device and useful with the recipient verification systems of the present disclosure.
Figure 52B:
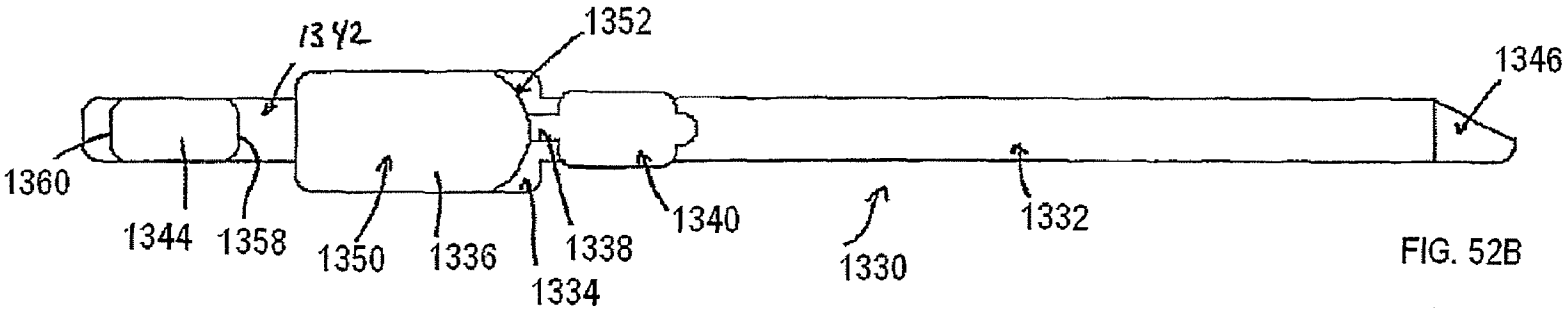

In yet other embodiments, the closure device can be provided as an integral feature of the corresponding band. For example, FIGS. 52A and 52B illustrate another embodiment band 1330 in accordance with principles of the present disclosure and integrally providing a closure device. The band 1330 is akin to the bands previously described, and generally includes or defines (in the initial, laminate structure state of FIG. 52A) a strap 1332, a lower pocket segment 1334, an upper pocket segment 1336, a tether 1338, and a head 1340. In addition, the band 1330 includes a strap connection segment 1342 and a cover piece 1344.

The strap 1332 extends from the lower pocket segment 1334 as with previous embodiments. During manufacture, adhesive 1346 (referenced generally) is applied to one or both of the strap connection segment 1342 and the cover piece 1344. The strap connection portion 1342 extends from the lower pocket segment 1334 opposite the strap 1332. The cover piece 1344 is attached to, and extends directly from, the strap connection portions 1342 as shown.

During assembly, and as shown in FIG. 52B, the pocket segments 1334, 1336 are secured to one another to form a pocket 1350 as previously described, with the tether 1338 and the head 1340 being selectively disposed within, and withdrawable from, the pocket 1350 via an opening 1352. In addition, the cover piece 1344 is folded on and sealed to the strap connection portion 1342 along a side edge 1354. Once so-assembled, the strap connection portion 1342 and the cover piece 1344 combine to define a tunnel 1356 that is open at opposing ends 1350, 1360 thereof. The previously-applied adhesive can be covered by a release liner (not shown).

Assembly of the band 1330 about a recipient's appendage includes folding the tail end 1348 onto itself, wrapping the strap 1332 around the recipient, and then threading the tail end 1348 through the tunnel 1356 via the ends 1358, 1360. The adhesive 1346 carried within the tunnel 1356 is then exposed and employed to secure the strap 1332.

Figure 53:
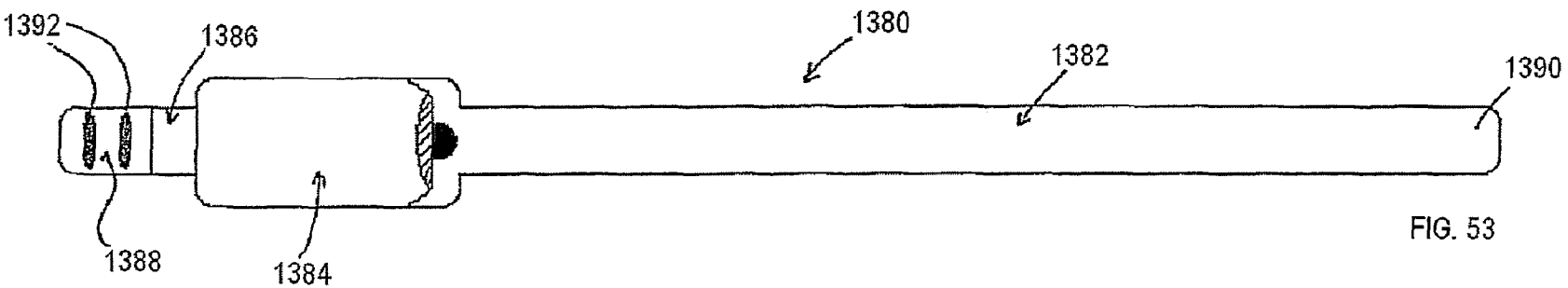
FIG. 53 illustrates another embodiment band integrally forming a closure device and useful with the recipient verification systems of the present disclosure.

FIG. 53 illustrates a related embodiment band 1380 integrally forming a closure device in accordance with principles of the present disclosure. The band 1380 includes a strap 1382, a pocket 1384, and a connection portion 1386, initially covered by a release liner (not shown). An adhesive 1388 (referenced generally) is applied to the strap 1382 adjacent a tail end 1390. In addition, the strap connection portion 1386 forms one or more slots 1392 sized to slidably receive the strap 1382. With this construction, application of the band 1380 includes wrapping the strap 1382 about the recipient's appendage, and threading the tail end 1390 through the slot(s) 1392. The adhesive 1388 is then exposed (e.g., the release liner removed), and utilized to secure the strap 1382 onto the connection portion 1386.

In addition to permanently associating recipient verification information and usable labels with a particular recipient, recipient verification systems in accordance with aspects of the present disclosure can be employed to correlate two or more recipients (e.g., patients) with one another. One such scenario in which recipient correlation is desirable is a mother and a baby (or babies) following birth. More particularly, caregivers commonly desire to provide expressed breast milk from the mother to her newborn infant via a container (e.g., a bottle). Under these circumstances, the expressed breast milk may be temporarily stored in one or more containers, and later given to the infant. With these and similar protocols, it is highly desirable that sufficient measures be taken to ensure that the infant only receives container breast milk from his or her mother. The present disclosure contemplates systems for providing such assurances.

Figure 54A:
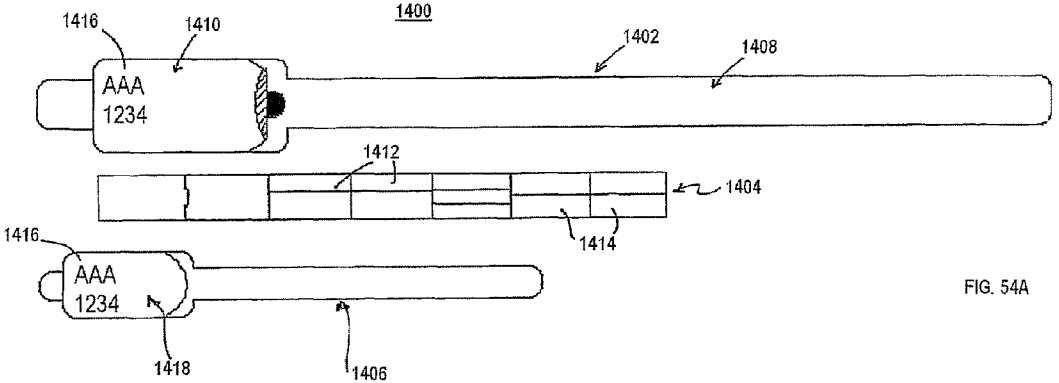
FIGS. 54A-54D illustrate another recipient verification system in accordance with principles of the present disclosure.

For example, FIG. 54A illustrates a recipient verification system 1400 in accordance with principles of the present disclosure including a first, mother band 1402, a label strip 1404, and a second, infant band 1406. The mother band 1402 can assume any of the forms previously described, and generally includes a strap 1408 and a pocket 1410 within which the label strip 1404 is selectively retained. The label strip 1404 can also assume any of the forms previously described, and includes a plurality of labels 1412, such as milk container labels 1414. Though not illustrated in FIG. 54A, at least the milk container labels 1414 include or display identification indicia corresponding with identification indicia 1416 carried by the band 1402.

Figure 54B:
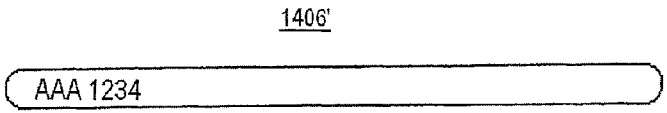

The infant band 1406 is sized for placement about an infant's appendage, and thus can assume a variety of forms. In some embodiments, the infant band 1406 can include a pocket 1418 within which one or more labels may be selectively maintained. Alternatively, no labels need be associated with the infant band 1406. Regardless, the infant band 1406 includes or displays the identical identification indicia 1406. Depending upon caregiver preference, the infant band 1406 can assume a more simplified format, such as the alternative infant band 1406' of FIG. 54B.

Figure 54D:
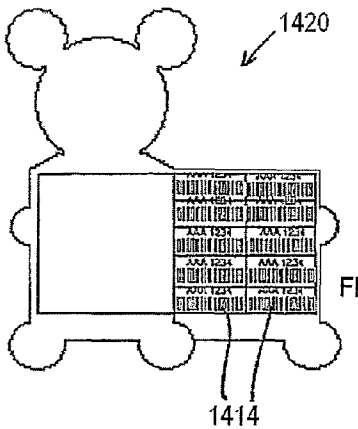
Figure 54C:
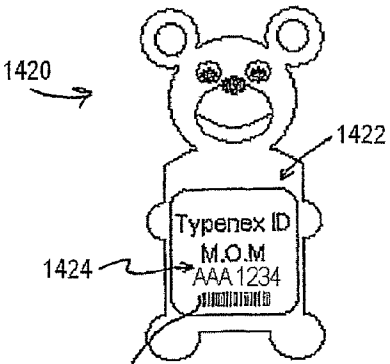

During use, and returning to FIG. 54A, the mother band 1402 (and the attached label strip 1404) is secured about an appendage of the mother, whereas the infant band 1406 is secured about an appendage of the mother's baby. Under circumstances where breast milk from the mother is stored in a separate container (not shown), the label strip 1404 is withdrawn from the pocket 1410, and one of the milk container labels 1414 removed therefrom. The removed milk container label 1414 is then adhered to the container, with the identification indicia 1416 provided on the label 1414 and the infant band 1406 providing a means for ensuring that the so-labeled container is given to the correct baby.

Where desired, the recipient verification system 1400 can further include a packet or booklet 1420 of additional ones of the milk container labels 1414 as shown in FIGS. 54C and 54D. The booklet 1420 can assume a variety of forms, and in some embodiments has a fanciful shape (e.g., in the form of a teddy bear). A cover 1422 of the booklet 1420 includes a primary label 1424 displaying various information as desired, including the identification indicia 1416 described above. As shown in FIG. 54D, multiple ones of the milk container labels 1414 are removably maintained within the booklet 1420.

Although the present disclosure has been described with reference to preferred embodiments, workers skilled in the art will recognize that changes can be made in form and detail without departing from the spirit and scope of the present disclosure.

What is claimed is:

1. A recipient verification system comprising:

a strap for placement about a wearer's appendage;

a pocket coupled to the strap and forming an interior region that is exteriorly accessible via a first, open end of the pocket;

a tether having a leading side and a trailing side, wherein a portion of the tether is permanently captured at the pocket; and a label strip attached to the leading side of the tether;

wherein the tether and the attached label strip are repeatedly transitionable between a first state in which at least a majority of the tether and at least a majority of the label strip are within the interior region, and a second state in which at least a majority of the label strip is outside of the interior region;

wherein the trailing side of the tether includes a label and further wherein upon final assembly, the label is permanently attached to the pocket.

2. The recipient verification system of claim 1, wherein the pocket is defined by a cover layer bonded to the strap.

3. The recipient verification system of claim 1, wherein the pocket further defines a second end opposite the first end, and further wherein the trailing end of the tether is fixed to the second end.

4. The recipient verification system of claim 3, wherein the leading side is slidable through the first end in transitioning between the first and second states.

5. The recipient verification system of claim 1, wherein the tether further includes an intermediate segment immediately adjacent the leading side, and further wherein the leading side forms a head for receiving the label strip, the head having a width greater than a width of the intermediate segment.

6. The recipient verification system of claim 5, wherein the leading side further forms a tab opposite the intermediate segment, the tab having a width that is less than a width of the head.

7. The recipient verification system of claim 1, wherein the trailing side of the tether is slidably captured within the interior region such that an entirety of the tether is slidable relative to the strap between the first and second states.

8. The recipient verification system of claim 1, wherein the trailing side of the tether is fixed to the first end of the pocket.

9. The recipient verification system of claim 1, wherein the tether and the label strip are integrally connected by a continuous carrier web.

10. The recipient verification system of claim 9, wherein the label strip carries a plurality of removable, adhesive-backed labels.

11. The recipient verification system of claim 9, wherein the continuous carrier web includes a first section defining the trailing side of the tether, a second section extending from the first section, and a third section extending from the second section opposite the first section at which the label strip is provided, the second section having a width that is less than a width of the first section.

12. The recipient verification system of claim 9, wherein the continuous carrier web includes a first segment forming a cover layer of the pocket and a second segment forming the tether, and further wherein the first segment is folded over the second segment.

13. The recipient verification system of claim 9, wherein the continuous carrier web includes a first segment forming the strap and a second segment forming the tether, and further wherein the second segment is folded over the first segment.

14. The recipient verification system of claim 1, wherein the first state includes the tether being folded upon itself within the interior region.

15. A recipient verification system comprising:

a strap for placement about a wearer's appendage;

a pocket coupled to the strap and forming an interior region that is exteriorly accessible via a first, open end of the pocket;

a tether having a leading side and a trailing side, wherein a portion of the tether is permanently captured at the pocket; and a label strip attached to the leading side of the tether, wherein the tether and the label strip are integrally connected by a continuous carrier web;

wherein the tether and the attached label strip are repeatedly transitionable between a first state in which at least a majority of the tether and at least a majority of the label strip are within the interior region, and a second state in which at least a majority of the label strip is outside of the interior region;

wherein the continuous carrier web includes a first section defining the trailing side of the tether, a second section extending from the first section, and a third section extending from the second section opposite the first section at which the label strip is provided, the second section having a width that is less than a width of the first section.

16. A recipient verification system comprising:

a strap for placement about a wearer's appendage;

a pocket coupled to the strap and forming an interior region that is exteriorly accessible via a first, open end of the pocket;

a tether having a leading side and a trailing side, wherein a portion of the tether is permanently captured at the pocket; and a label strip attached to the leading side of the tether, wherein the tether and the label strip are connected by a continuous carrier web;

wherein the tether and the attached label strip are repeatedly transitionable between a first state in which at least a majority of the tether and at least a majority of the label strip are within the interior region, and a second state in which at least a majority of the label strip is outside of the interior region;

wherein the continuous carrier web includes a first segment forming a cover layer of the pocket and a second segment forming the tether, and further wherein the first segment is folded over the second segment.

* * * * *